US009993080B2

(12) United States Patent
Jacobs et al.

(10) Patent No.: US 9,993,080 B2
(45) **Date of Patent: *Jun. 12, 2018**

(54) BEAM MOUNTED CHAIR ASSEMBLY

(71) Applicants: Matthew D. Jacobs, Holland, MI (US); Frederick D. Jacobs, Holland, MI (US); Michiel VandeVen, West Olive, MI (US)

(72) Inventors: Matthew D. Jacobs, Holland, MI (US); Frederick D. Jacobs, Holland, MI (US); Michiel VandeVen, West Olive, MI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/800,182

(22) Filed: Nov. 1, 2017

(65) Prior Publication Data

US 2018/0070727 A1 Mar. 15, 2018

Related U.S. Application Data

(63) Continuation-in-part of application No. 15/640,938, filed on Jul. 3, 2017, now Pat. No. 9,808,085, and a (Continued)

(51) Int. Cl.

| | |
|---|---|
| ***E04H 3/10*** | (2006.01) |
| ***A47C 1/124*** | (2006.01) |
| ***A47C 1/121*** | (2006.01) |
| ***A47C 1/024*** | (2006.01) |
| ***A47C 11/00*** | (2006.01) |
| ***A47C 7/54*** | (2006.01) |
| ***A47C 7/58*** | (2006.01) |

(Continued)

(52) U.S. Cl.

CPC ..... *A47C 1/124* (2013.01); *A47C 1/0242* (2013.01); *A47C 1/121* (2013.01); *A47C 7/24* (2013.01); *A47C 7/543* (2013.01); *A47C 7/58* (2013.01); *A47C 7/60* (2013.01); *A47C 11/005* (2013.01)

(58) Field of Classification Search

CPC .. A47C 1/121; A47C 7/56; A47C 1/12; A47C 7/58; A47C 7/60; A47C 1/124; A47C 7/24; A47C 7/30; A47C 7/543; A47C 11/005

USPC ..... 52/6, 8, 9; 297/236, 232, 248

See application file for complete search history.

(56) References Cited

U.S. PATENT DOCUMENTS 5,984,417 A * 11/1999 Wang ..... A47B 13/06 108/158.11

6,095,603 A * 8/2000 Hock ..... A47C 1/12 297/232

(Continued)

*Primary Examiner* — Chi Q Nguyen

(74) *Attorney, Agent, or Firm* — James E. Shultz, Jr.

(57) ABSTRACT

Beam mounted chair assemblies may include at least two standards supported on a floor, a beam secured to, and supported by, the standards, and a plurality of chair assemblies secured to, and supported by, the beam. Chair assemblies may be secured to a beam via associated chair brackets. Chair brackets may include chair seat pivots that pivotally secure a chair seat in proximity to a chair back such that the chair seat may pivot between an up and a down position. Chair brackets and standards may be secured to a beam such that the chair brackets and standards may be linearly positioned along a full length of the beam without interfering with one another. The beam mounted chair assemblies may include electrical power and/or data wiring and associated components.

20 Claims, 62 Drawing Sheets

Related U.S. Application Data continuation-in-part of application No. 15/675,865, filed on Aug. 14, 2017, and a continuation-in-part of application No. 15/710,768, filed on Sep. 20, 2017, and a continuation-in-part of application No. PCT/US2016/025803, filed on Apr. 3, 2016.

(51) Int. Cl.
*A47C 7/60* (2006.01)
*A47C 7/24* (2006.01)

(56) References Cited

U.S. PATENT DOCUMENTS

| | | | | |
|---|---|---|---|---|
| 6,683,394 | B1 * | 1/2004 | Gevaert | A47C 1/12 174/480 |
| 7,073,858 | B2 * | 7/2006 | Fisher | A47C 1/12 297/232 |
| 8,820,836 | B2 * | 9/2014 | Stewart | A47C 1/12 297/232 |
| 9,326,610 | B2 * | 5/2016 | Jacobs | A47C 1/12 |
| 9,631,384 | B2 * | 4/2017 | Jacobs | E04H 3/126 |
| 9,693,630 | B2 * | 7/2017 | Jacobs | A47C 1/121 |
| 9,808,085 | B1 * | 11/2017 | Jacobs | A47C 1/121 |
| 2011/0156448 | A1 * | 6/2011 | Fletcher | A45B 11/00 297/16.1 |
| 2013/0038103 | A1 * | 2/2013 | Scott | B64D 11/06 297/248 |

* cited by examiner

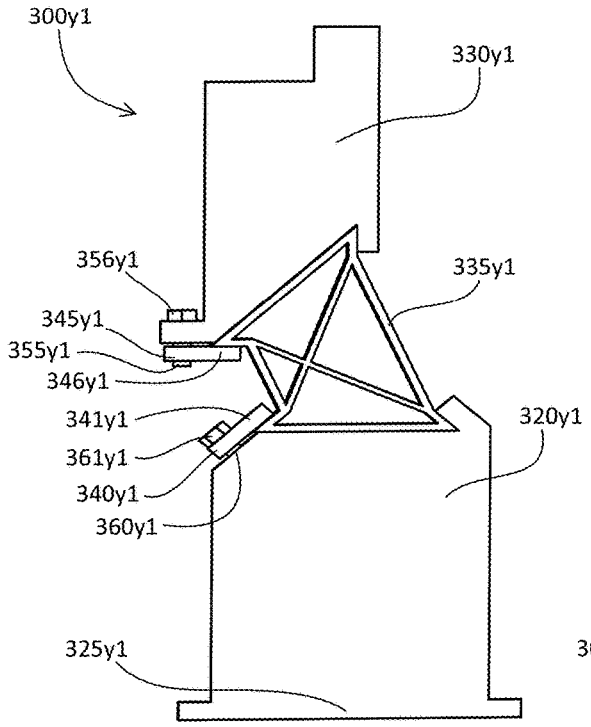
Fig. 3Y1
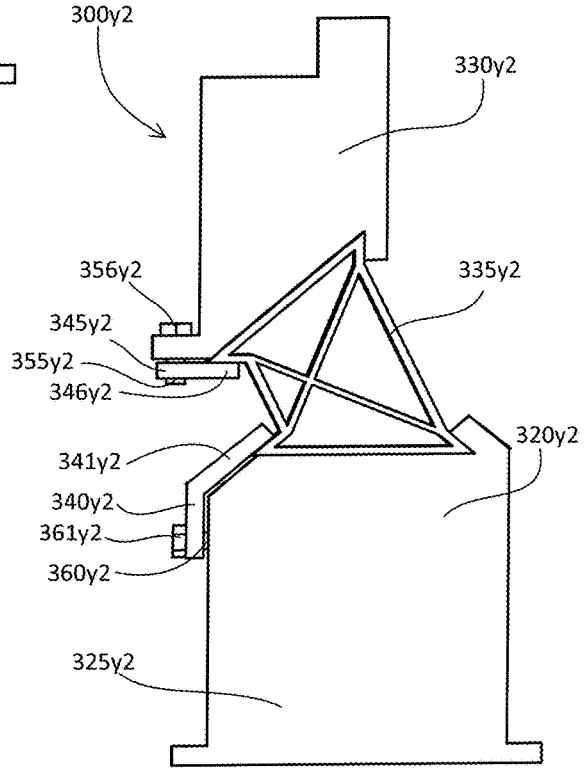
Fig. 3Y2

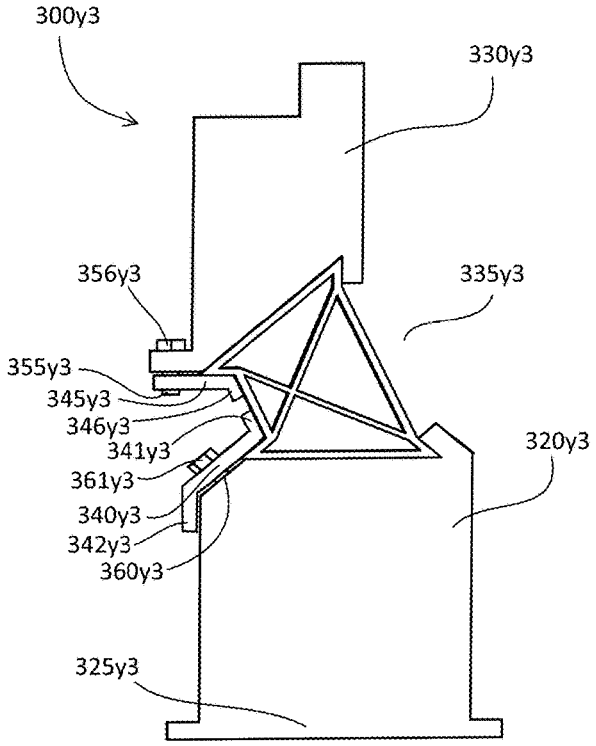
Fig. 3Y3
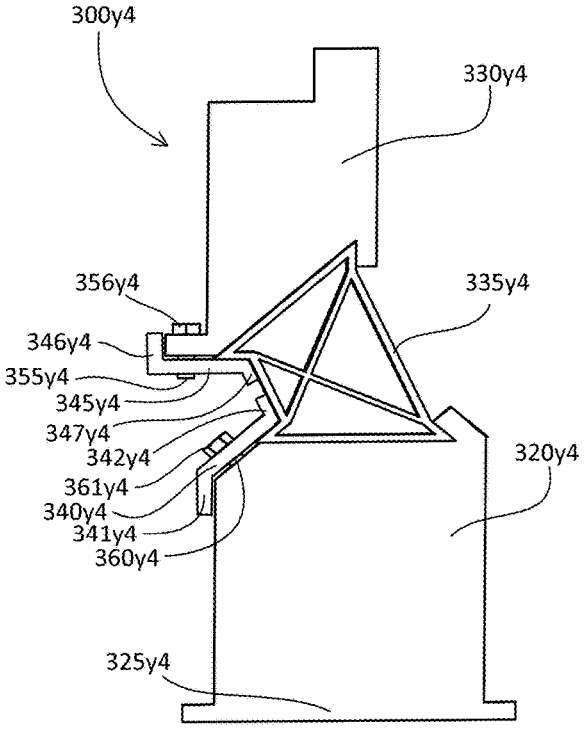
Fig. 3Y4

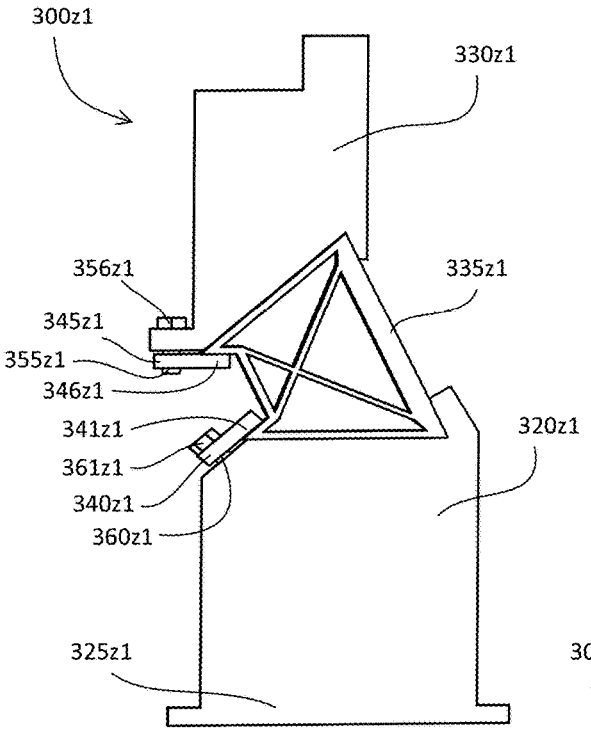
Fig. 3Z1
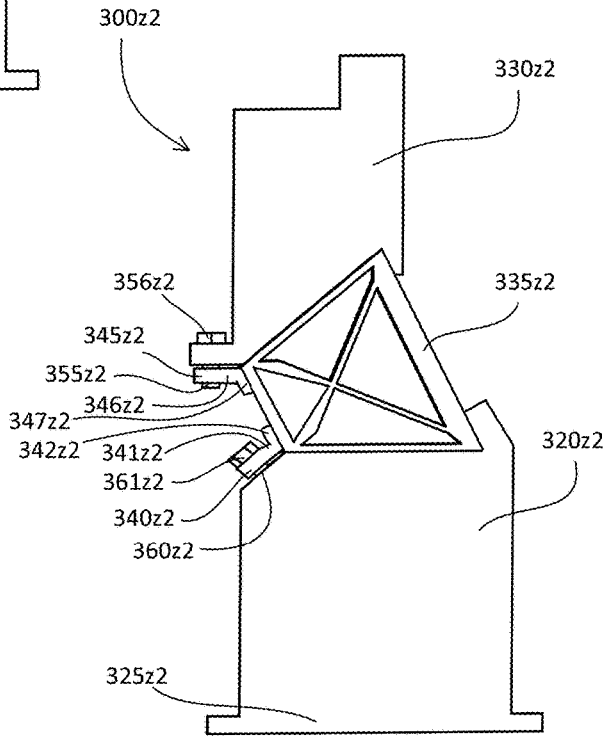
Fig. 3Z2

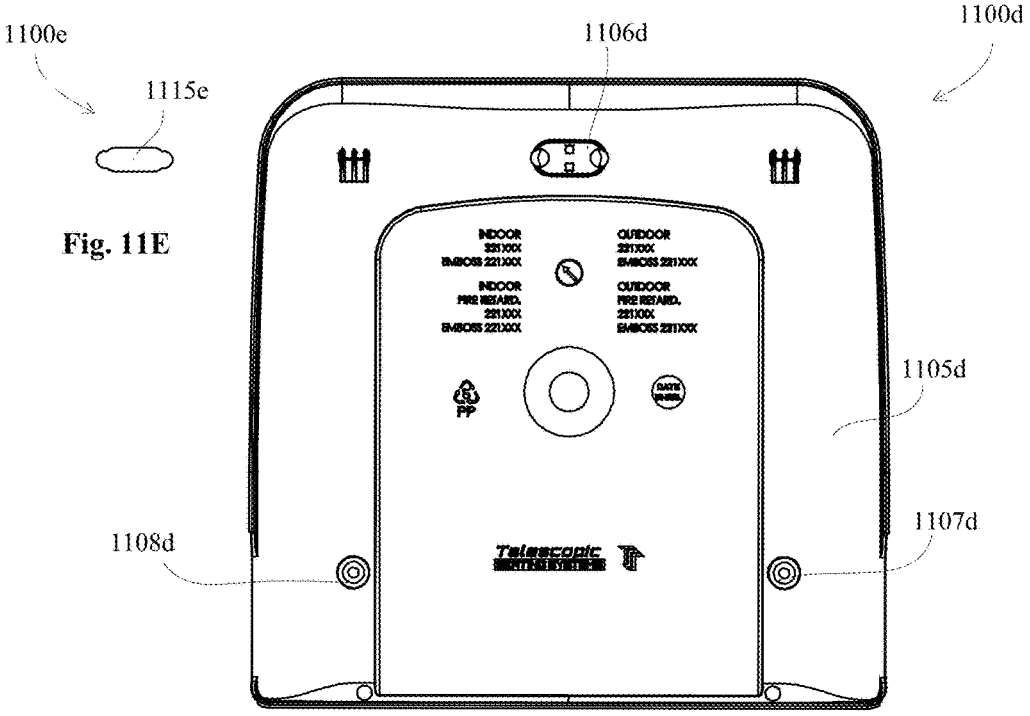
Fig. 11E
Fig. 11D
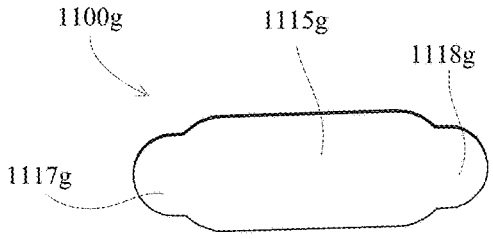
Fig. 11G
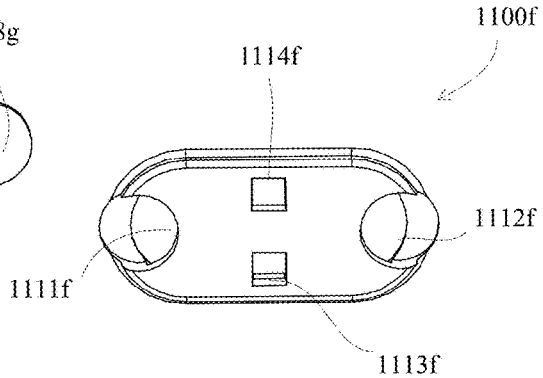
Fig. 11F

BEAM MOUNTED CHAIR ASSEMBLY

CROSS REFERENCE TO RELATED APPLICATIONS

The present application is a continuation-in-part of U.S. patent application Ser. No. 15/640,938, now U.S. Pat. No. 9,808,085, entitled BEAM MOUNTED CHAIR ASSEMBLIES, CHAIR ASSEMBLIES OF USE WITHIN THE BEAM MOUNTED CHAIR ASSEMBLIES, COMPONENTS FOR USE WITHIN THE CHAIR ASSEMBLIES AND PARTS FOR USE WITHIN THE COMPONENTS, filed Jul. 3, 2017; Ser. No. 15/710,768, filed Sep. 20, 2017, entitled ROCKER STYLE CHAIRS, MODULAR COMPONENTS FOR USE WITHIN ROCKER STYLE CHAIRS AND PARTS FOR USE WITHIN THE MODULAR COMPONENTS; and Ser. No. 15/675,865, filed Aug. 14, 2017, entitled POWERED CHAIRS FOR PUBLIC VENUES, ASSEMBLIES FOR USE IN POWERED CHAIRS, AND COMPONENTS FOR USE IN ASSEMBLIES FOR USE IN POWERED CHAIRS; and PCT/US16/25803, filed Apr. 3, 2016, entitled, POWERED CHAIRS FOR PUBLIC VENUES, ASSEMBLIES FOR USE IN POWERED CHAIRS, AND COMPONENTS FOR USE IN ASSEMBLIES FOR USE IN POWERED CHAIRS, the disclosures of which are incorporated herein in its entirety by reference.

TECHNICAL FIELD

The present disclosure relates to beam mounted chair assemblies. More particularly, the present disclosure relates to beam mounted chair assemblies for auditoriums, cinemas, concert halls, arenas, gymnasiums, theaters and various other venues, and to chair assemblies for use within the beam mounted chair assemblies, components for use within the chair assemblies and parts for use within the components having associated chair brackets and standards secured to a beam that includes integral electrical power and/or data wiring and components.

BACKGROUND

In the past, buildings such as cinemas, theaters, concert halls, arenas and other areas of public entertainment have been provided with beam mounted chair assemblies. However, more recently there has been a tendency for such buildings to serve more than one purpose. For example, a building for public entertainment may be required on one occasion to serve as a sports hall, and on another occasion to serve as a concert hall or theatre. Similarly, seating arrangements in concert halls, theatres or arenas may need to be reconfigurable to suit the requirements of a particular production being staged.

Tiered seating systems have been devised which, when not in use, can be folded or otherwise collapsed against a wall of the building in which they are situated (e.g. telescopic seating systems such as those disclosed in commonly assigned patent applications Ser. No. 61/856,013, entitled Telescopic Seating Systems, and Foldable Chairs and Related Components for use within Telescopic Seating Systems, filed Jul. 18, 2013 and Ser. No. 61/868,547, entitled Telescopic Seating Systems, and Foldable Chairs and Related Components for use within Telescopic Seating Systems, filed Aug. 21, 2013), thus freeing the floor area for other purposes. However, there has, so far, been no satisfactory solution to the problem of installing reconfigurable seating on a sloped floor.

Seating for an audience in a public building or arena must comply with statutory regulations. These regulations are principally intended to ensure that the building or arena can be evacuated rapidly in the event of an emergency. Thus, there is a minimum spacing which must be observed between adjacent rows of seats, and provision must be made for preventing the rows of seats from moving relatively to one another in a way which would reduce the spacing below this minimum during installation.

One way of meeting the statutory requirements is to secure a beam to standards and secure chairs to the beam while each is installed, but this is unsatisfactory. Furthermore, installation and removal of the seats are very time consuming and require skilled labor when the beam is secured to the beam and the individual chairs are secured to the beam while individually being installed.

SUMMARY

Beam mounted chair assemblies may include at least one standard supported on a floor, a beam supported by the standard, and a plurality of chair assemblies supported by the beam. A beam may include electrical power and/or data wiring and associated components.

Beam mounted chair assemblies may include at least two standards supported on a floor, a beam supported by the standards, and a plurality of chair assemblies supported by the beam. A beam may be stably supported on standards and chair assemblies may be stably supported on the beam such that the beam and the chair assemblies may be set in position during installation without securing the beam to the standards or securing the chair assemblies to the beam.

Beam mounted chair assemblies may include at least two standards supported on a floor, a beam secured to, and supported by, the standards, and a plurality of chair assemblies secured to, and supported by, the beam. Chair brackets and standards may be secured to a beam such that the chair brackets and standards may be linearly positioned along a full length of the beam without interfering with one another.

Chair assemblies may be secured to a beam via associated chair brackets. Chair brackets and standards may be secured to a beam such that the chair brackets and standards may be linearly positioned along a full length of the beam without interfering with one another.

Chair brackets may include chair seat pivots that pivotally secure a chair seat in proximity to a chair back such that the chair seat may pivot between an up and a down position. Chair brackets and standards may be secured to a beam such that the chair brackets and standards may be linearly positioned along a full length of the beam without interfering with one another.

Standards may extend horizontally from an associated structure, vertically from an associated structure (e.g., a floor) or a combination thereof. Chair brackets and standards may be secured to a beam such that the chair brackets and standards may be linearly positioned along a full length of the beam without interfering with one another.

BRIEF DESCRIPTION OF THE FIGURES

The figures described below depict various aspects of the systems and methods disclosed herein. It should be understood that each figure depicts an embodiment of a particular aspect of the disclosed systems and methods, and that each of the figures is intended to accord with a possible embodiment thereof. Further, wherever possible, the following description refers to the reference numerals included in the following figures, in which features depicted in multiple figures are designated with consistent reference numerals.

FIGS. 3A-3H, 3J-3N, 3P-3X, 3Y1-3Y4, 3Z1 and 3Z2 depict various views of standards, beams and chair brackets for use within the beam mounted chair assemblies of FIGS. 2A-2C;

FIGS. 11A-G depict various views of an example display assemblies;

DETAIL DESCRIPTION

Figure 1A:
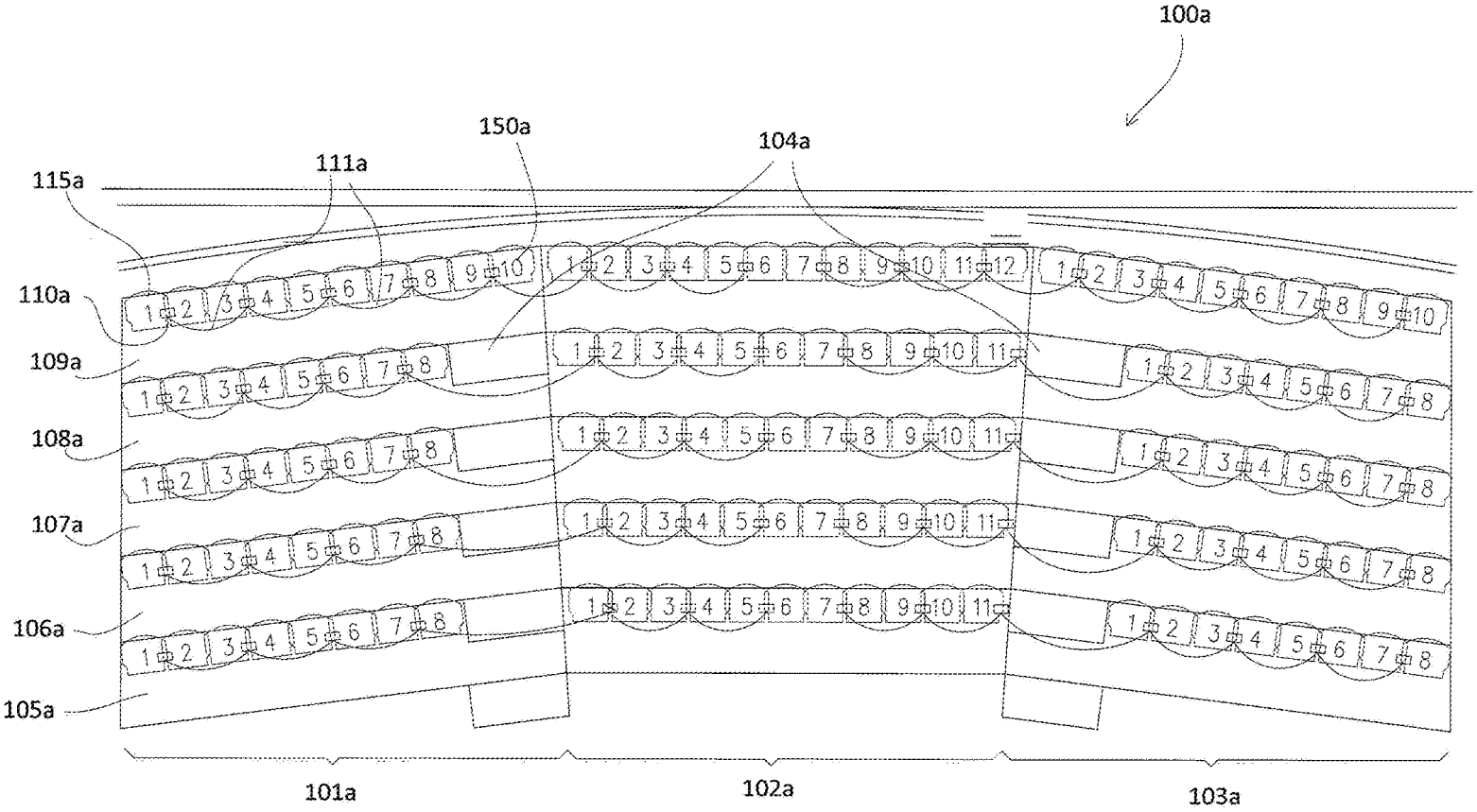
FIGS. 1A-1D depict various views of example beam mounted chair assembly installations.

A beam mounted chair assembly is provided with electrical power and/or data wiring and associated components. The associated chairs may be stably held in place prior to tightening any fasteners thru standard, beam and chair features cooperating with a mechanical moment provided by each chair's center of mass or chair mass properties (e.g., include magnetic beams). Individual chairs may be slid along a full length of a beam without interfering with any standards. While no interference between a standard and a chair bracket is preferred, it should be understood that there may be interference between a standard and a chair bracket in certain circumstances. A clamp system may be provided between a standard and a riser/floor. A lower clamp system may be provided between standards and a beam that stiffens the beam to reduce deflection include torsional deflection such that fewer attachment points (standards) are required. A beam mounted chair assembly may be provided that works for some or all chair installation types (e.g., telescopic chair installations, movable chair installations, fixed position chair installation, etc.). A beam mounted chair standard may be floor mounted. Alternatively, beam mounted chair assemblies of the present disclosure may be incorporated in any installation type (e.g., riser mount, telescopic, movable, linked, etc.).

A beam may be manufactured from a solid material. Alternatively, a beam may be optimized for strength and cost by reducing beam material, for example, by using a box beam or an extruded beam with internal, laterally extending, void areas (e.g., as depicted in FIGS. 3J and K). Interface surfaces between a standard and a beam and/or between a beam and a chair bracket may be substantially flat. Alternatively, interface surfaces between a standard and a beam and/or between a beam and a chair bracket may have non-flat geometry as illustrated, for example, in FIGS. 3G, 3J and 3K. Non-flat interface surfaces between a standard and a beam and/or between a beam and a chair bracket may induce a retention feature under load, for example, when a corresponding clamp is tightened.

Additional member(s) may be added between the standard and the beam to strength the system while minimizing cost. These members will cooperate with the standard and the beam to enhance the system performance. Cooperation between members may be enhanced by features such as pockets or protrusions in any or all adjacent members which engage adjacent members. Adjacent members may be fastened to enhance system performance. Fastening may take the form clamps, welds, bolts, adhesives or other means of linking adjacent members to enhance system performance. Fastening does not require properties to be isotropic and one skilled in the art can envision antistrophic methods which will enhance performance while lowering system cost. A reinforcement beam may extend parallel to a main beam to strengthen an associated beam mounted chair assembly. An added pocket may be provided within associated standard/mounting feet or within the beam to hold a support beam that may be added to spread the mounts. A reinforcement beam and/or a support beam may be an I-beam. Alternatively, a reinforcement beam and/or a support beam may be any shape. A beam may be clamped to a support beam to handle torsion loads. Corners of associated parts of a beam mounted chair assembly may be sharp. Alternatively, corners of associated parts of a beam mounted chair assembly may have radii added for manufacturing, stress reduction, safety, etc. A beam mounted chair assembly may include chairs that are held in place prior to tightening fasteners by using beam and/or chair features that may cooperate with a moment provided by an associated chair's center of mass. Chairs of a beam mounted chair assembly may slide along a full length of a beam to adjust for chair sizes. A beam mounted chair assembly may incorporate associated clamp systems between standards and risers/floors that may be position at any point along a length of a beam. A beam mounted chair assembly design may not require a standard and an associated mounting foot to be offset from one another. A beam design may be symmetrical to reduce installation labor.

Beams may be joined by internal coupling components to allow unrestricted beam length. Coupling components of a standard, a beam and/or a chair bracket may include external features which control insertion depth to aid beam mounted chair assembly installation. Coupling components of a standard, a beam and/or a chair bracket may include features such as slots cut in a round tube to facilitate alignment and to aid assembly. Features described above may vary in geometry (depth, width, quantity, etc.) to aid insertion depth control. For example, a lower clamp system may include features that stiffen an associated beam and/or reduce beam deflection and/or required attachment points. A beam stiffening member and a beam may extend into one another to facilitate installation. Mating surfaces between a beam stiffening member and a beam may extend above or below a top of an associated pocket. Pockets may be attached to a beam allowing for stiffening member/beams of multiple materials and/or component construction.

A beam mounted chair assembly may incorporate fasteners accessible from a top side, a front, a bottom side and/or a back side of an assembly. Beam geometry may be designed to avoid accumulation of water, dirt, debris, etc. A beam mounted chair assembly may incorporate blow molded chair seats and/or chair backs. Blow molded chairs traditionally locate associated chair seat pivot mechanisms below a chair mounting surface. A beam mounted chair assembly may have a chair seat pivot mechanism above an associated chair mounting surface.

Turning to FIG. 1A, beam mounted chair assemblies 115*a*, 150*a* are depicted within an installation 100*a*. The installation 100 a may be within an auditorium, a cinema, a concert hall, an arena, a gymnasium, a theater, a stadium, or any various other venues. The installation 100*a* may include a series of rows of beam mounted chair assemblies 105*a*-109*a* arranged in columns 101*a*-103*a* having isle ways 104*a* between the columns 101*a*-103*a*. the installation 100*a* may include power/data outlets 110*a* and related interconnections 111*a*. Any given beam may include an arched geometry to accommodate chairs in center column 102*a* being farther from an associated stage, for example, when compared to chairs in columns 101*a*, 103*a*.

Figure 1B:
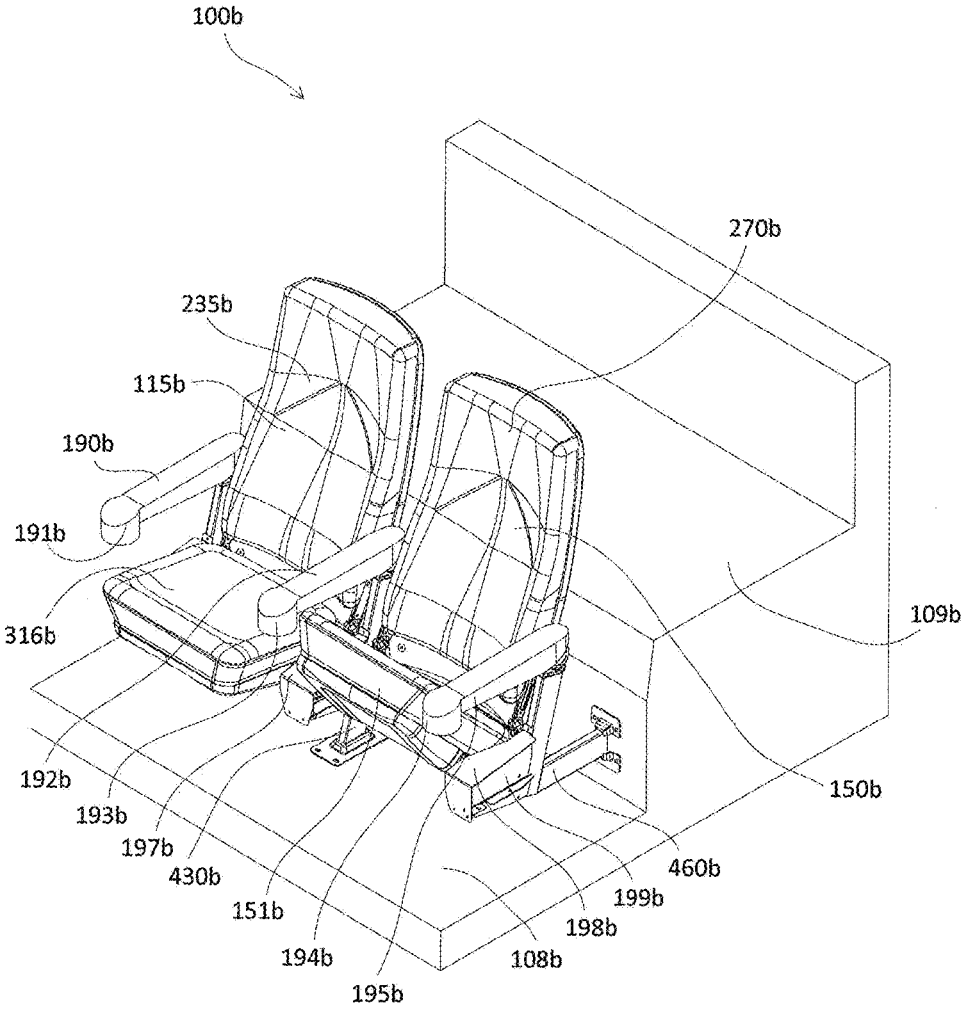

With reference to FIG. 1B, an installation 100*b* may include a plurality of beam mounted chair assemblies 235*b*, 270*b* arranged on a multi-level structure 108*b*, 109*b*. Each set of chairs 235*b*, 270*b* may include a chair seat 316*b*, 151*b*; a chair back 115*b*, 150*b*; a right-hand arm rest 190*b*; a center arm rest 192*b* and a left-hand arm rest 195*b*; a center debris cover 197*b*; a left-hand debris cover 198*b*; and a left-hand panel 199*b*. A beam may be supported by at least one horizontally extending standard 460*b* and/or at least one vertically extending standard 430*b*. Each arm rest 190*b*, 192*b*, 195*b* may include a cup holder 191*b*, 193*b*, 194*b*. Alternatively, or additionally, any given chair assembly 235*b*, 270*b* may include a pivotal work tray or desk, a side separator, end panels, folding tablet arms, drink tables, etc. An armrest 190*b*, 192*b*, 195*b*, a cup holder 191*b*, 193*b*, 194*b*, a pivotal work tray or desk, a side separator, folding tablet arms, drink tables and/or an end panels may be supported by a chair bracket, a beam or a standard via a bracket integral to a chair bracket, a bracket integral to a beam, a bracket integral to a standard or may be supported by an independent bracket and secured to a standard, a beam or a chair bracket.

Figure 1C:
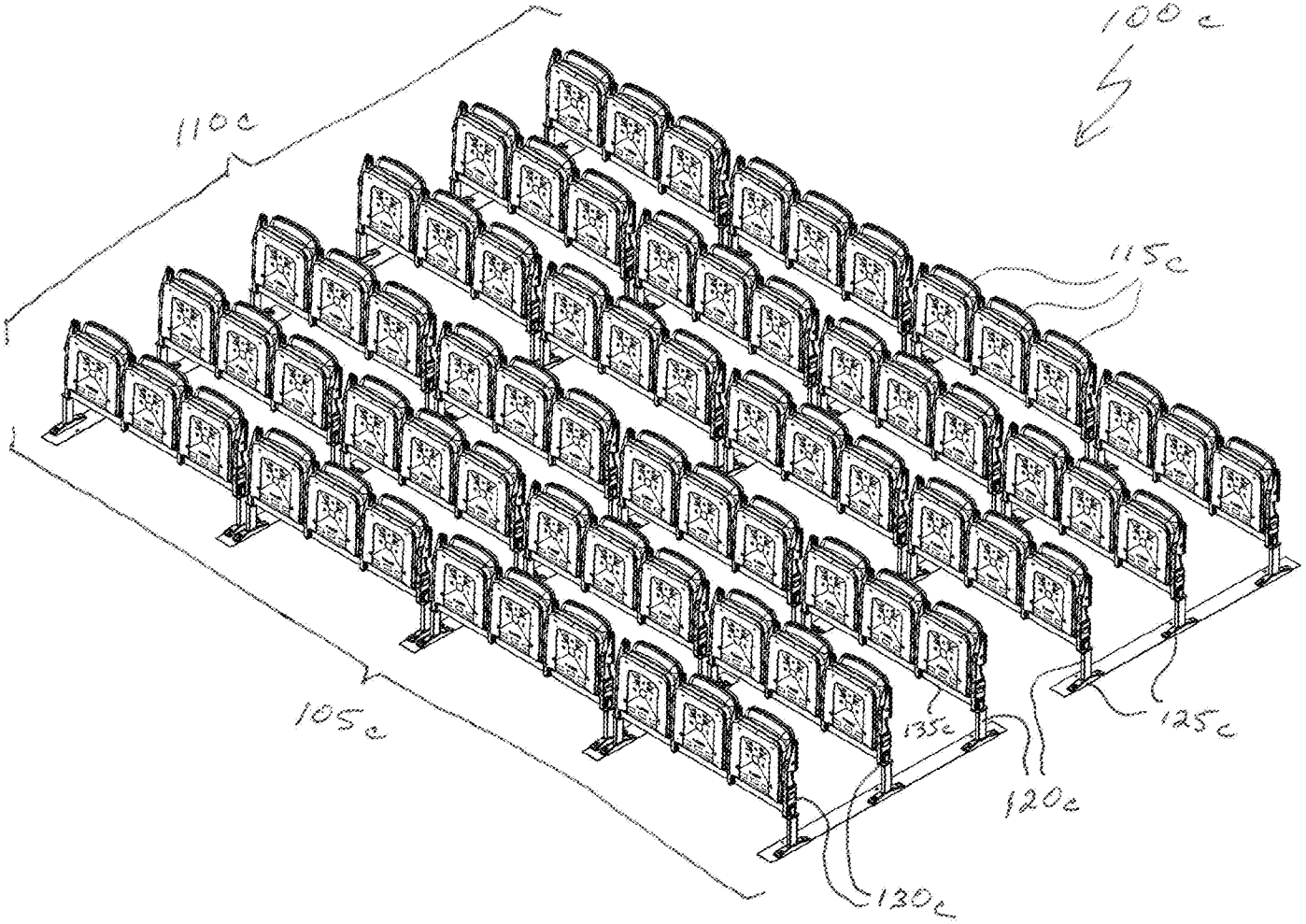
Figure 1D:
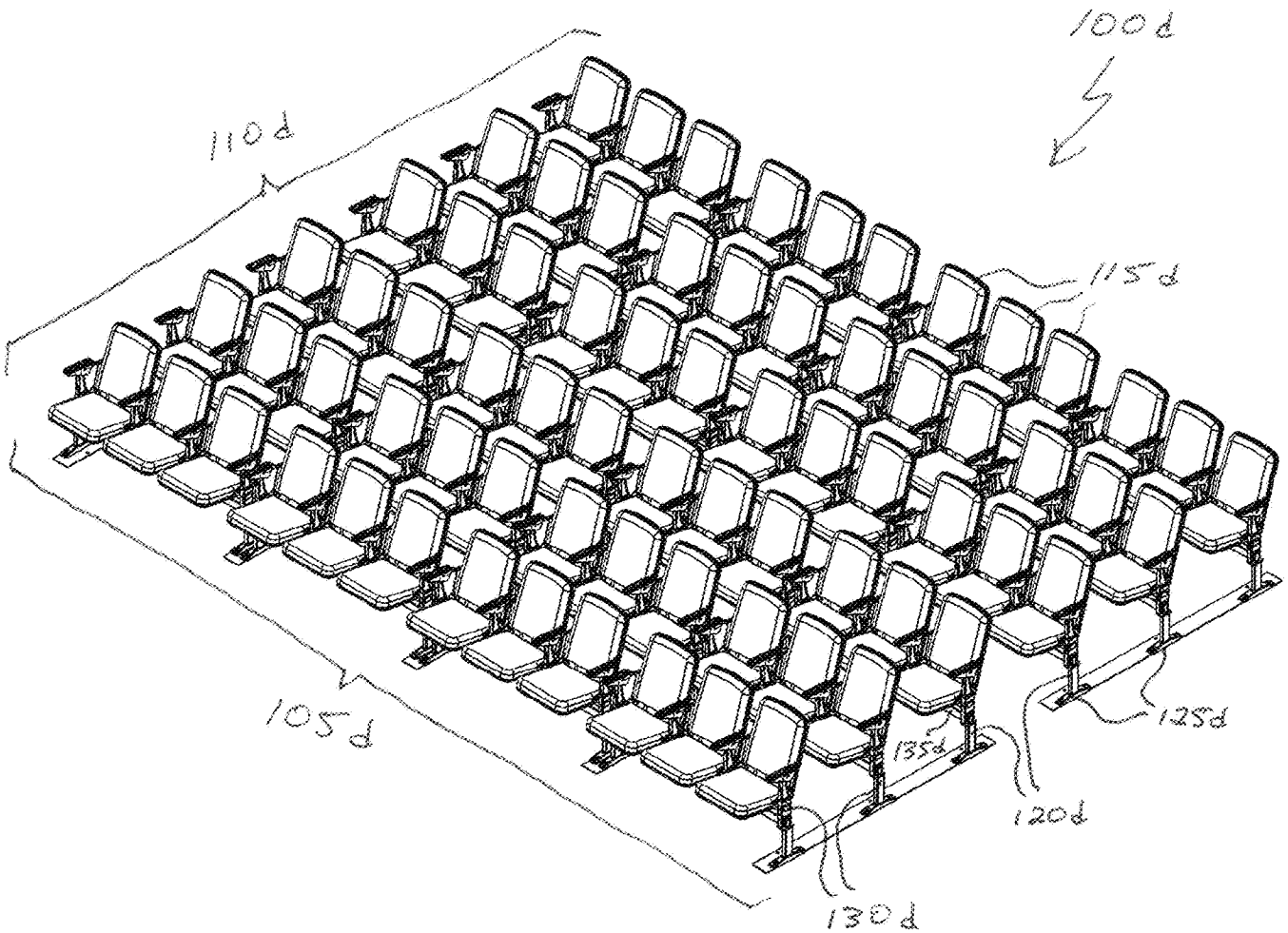

Turning to FIG. 1C, an installation 100*c* is depicted including a plurality of beam mounted chair assemblies 115*c* arranged in a plurality of rows 110*c* and columns 105*c*. Each of the beam mounted chair assemblies 115*c* may include at least one chair bracket 130*c* supported on a beam 135*c*. A beam 135*c* may be supported by at least one standard 120*c*. A standard 120*c* may be supported on a mounting foot 125*c*. With additional reference to FIG. 1D, chairs 115*d* are depicted with chair seats folded down, where the chairs 115*c* have chair seats folded up.

Figure 3A:
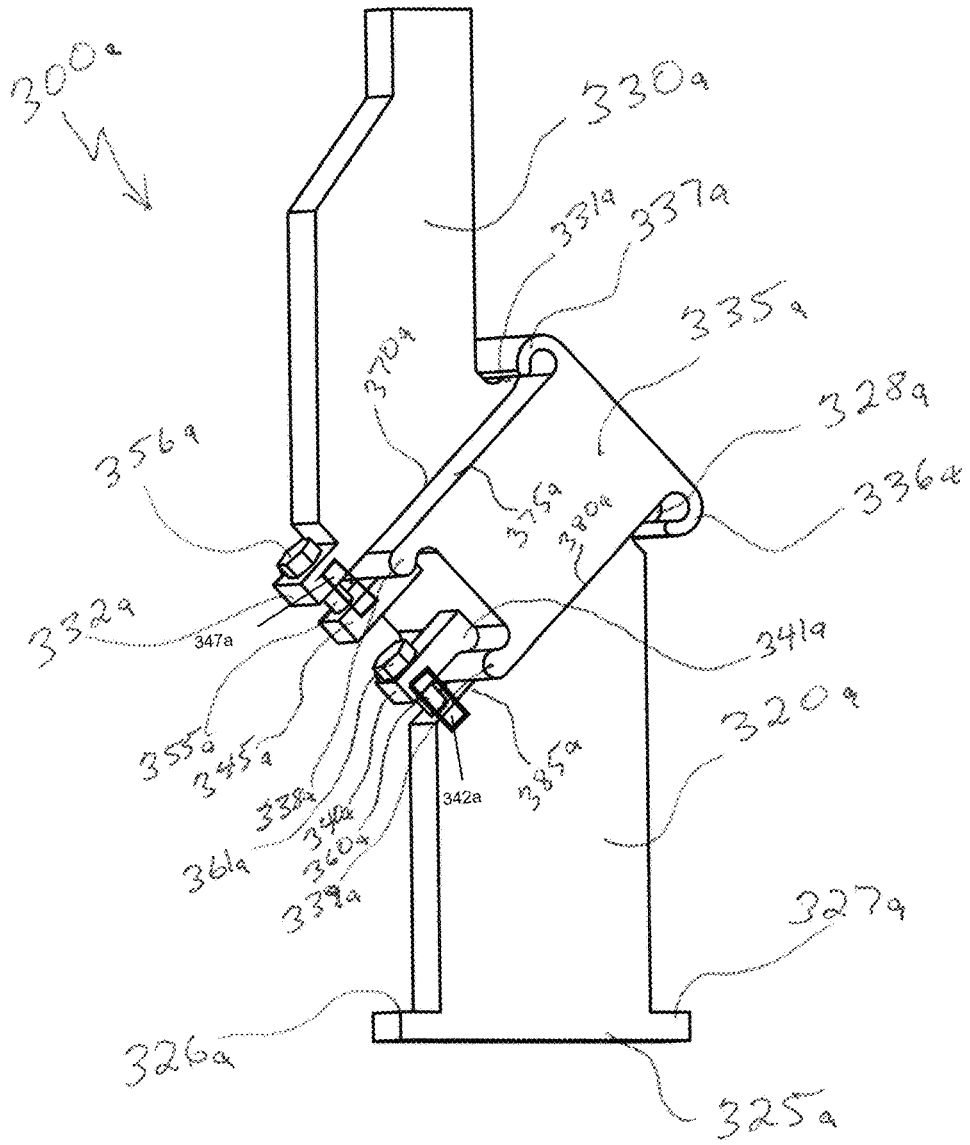
Figure 3B:
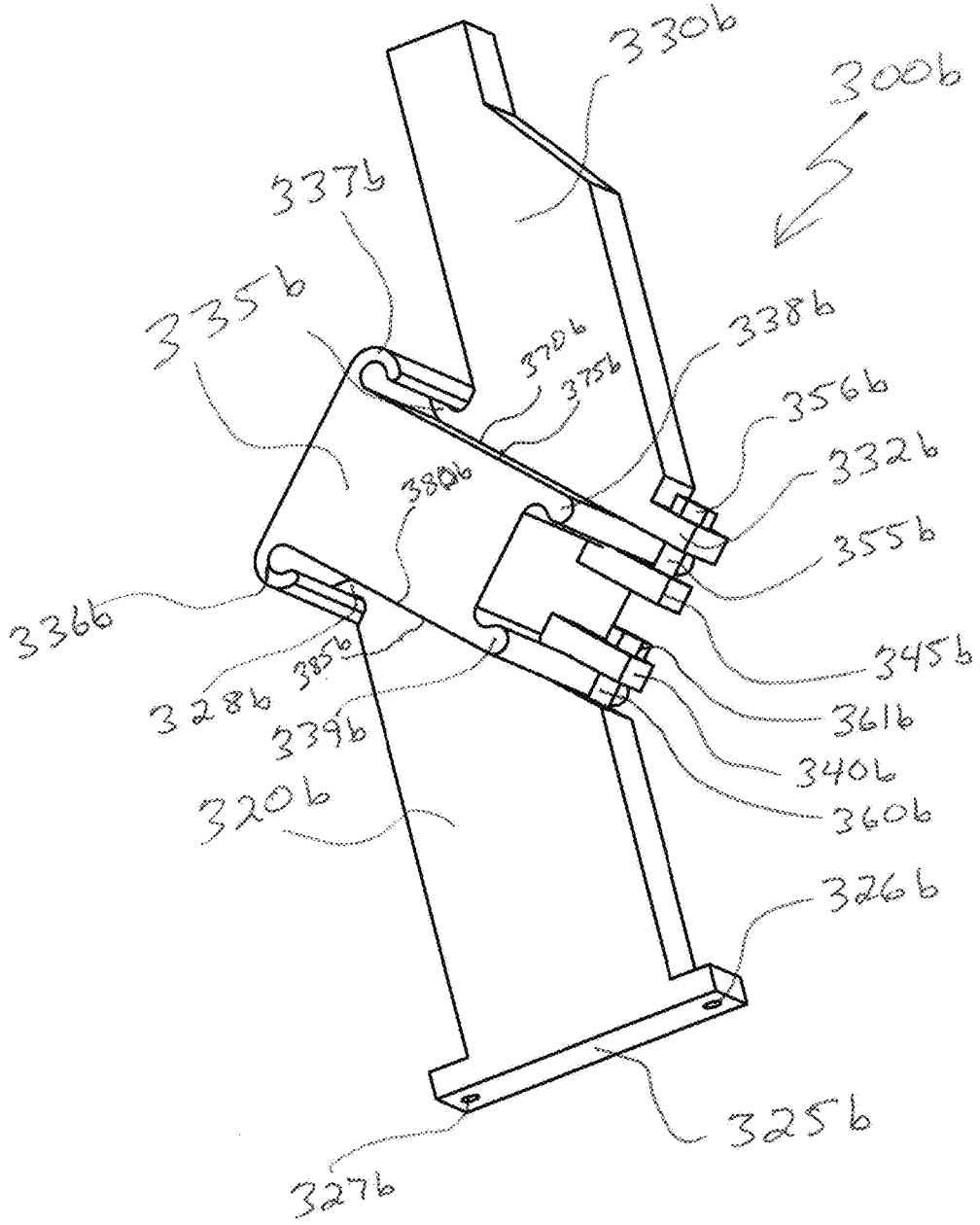
Figure 3C:
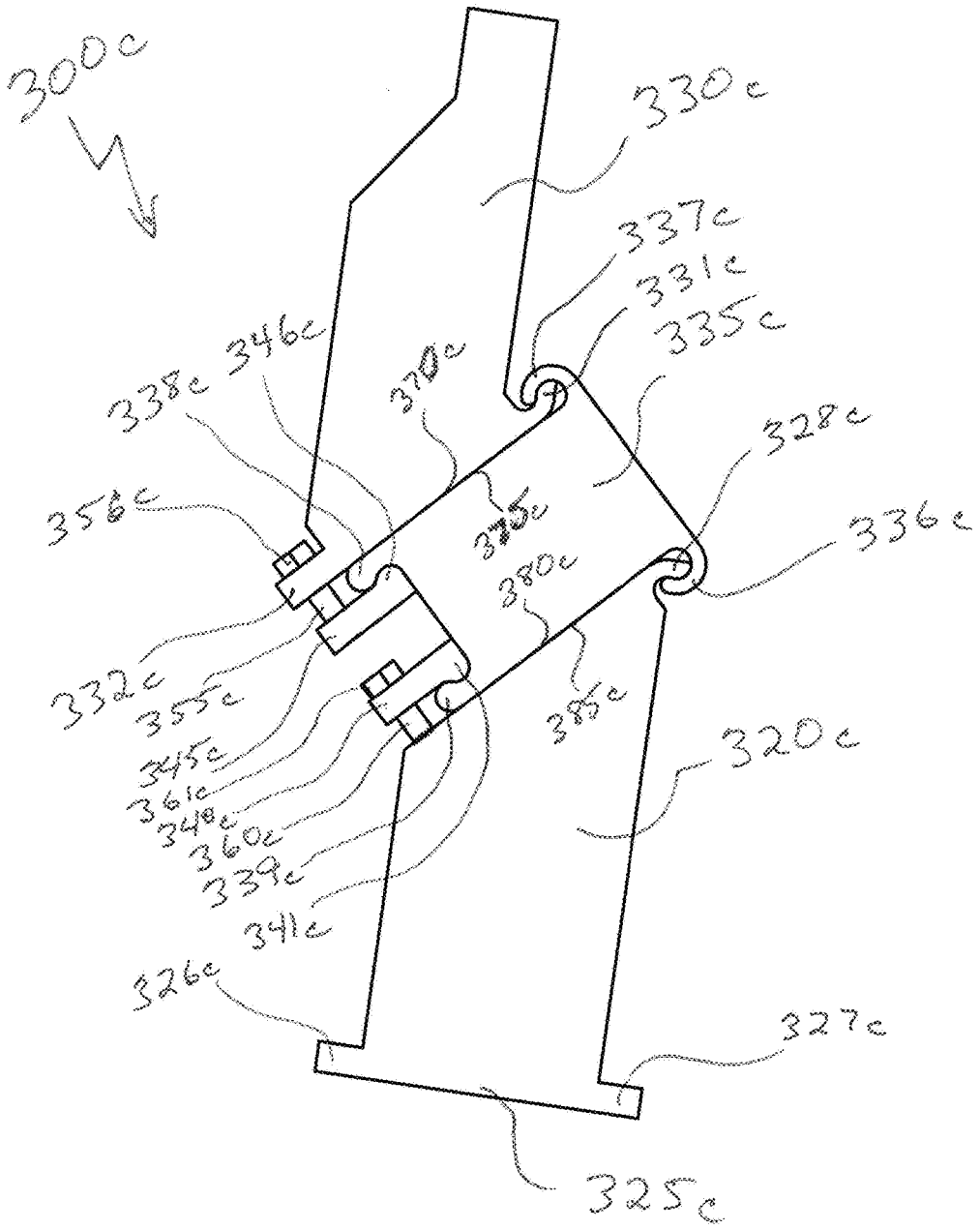
Figure 3D:
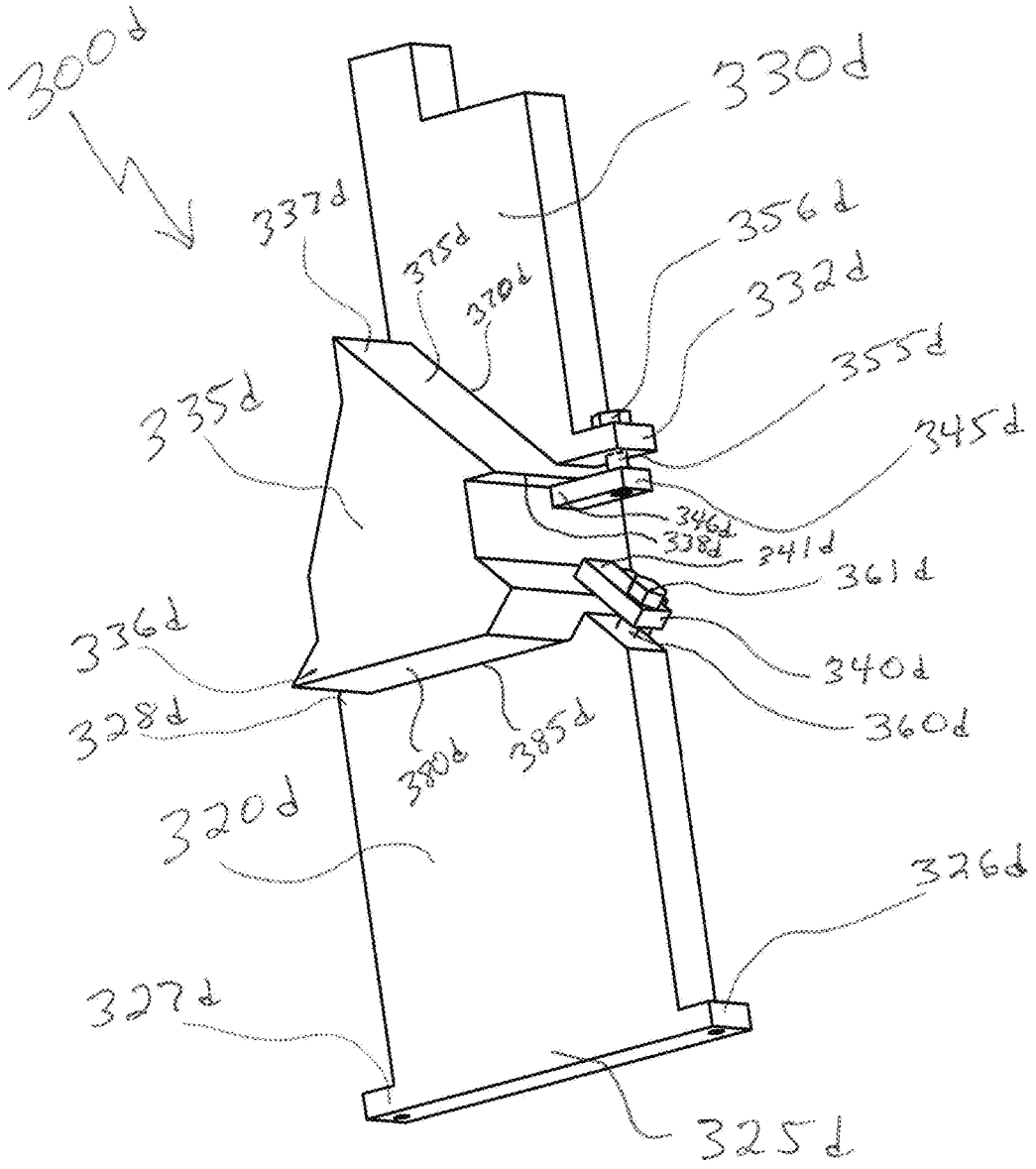
Figure 3E:
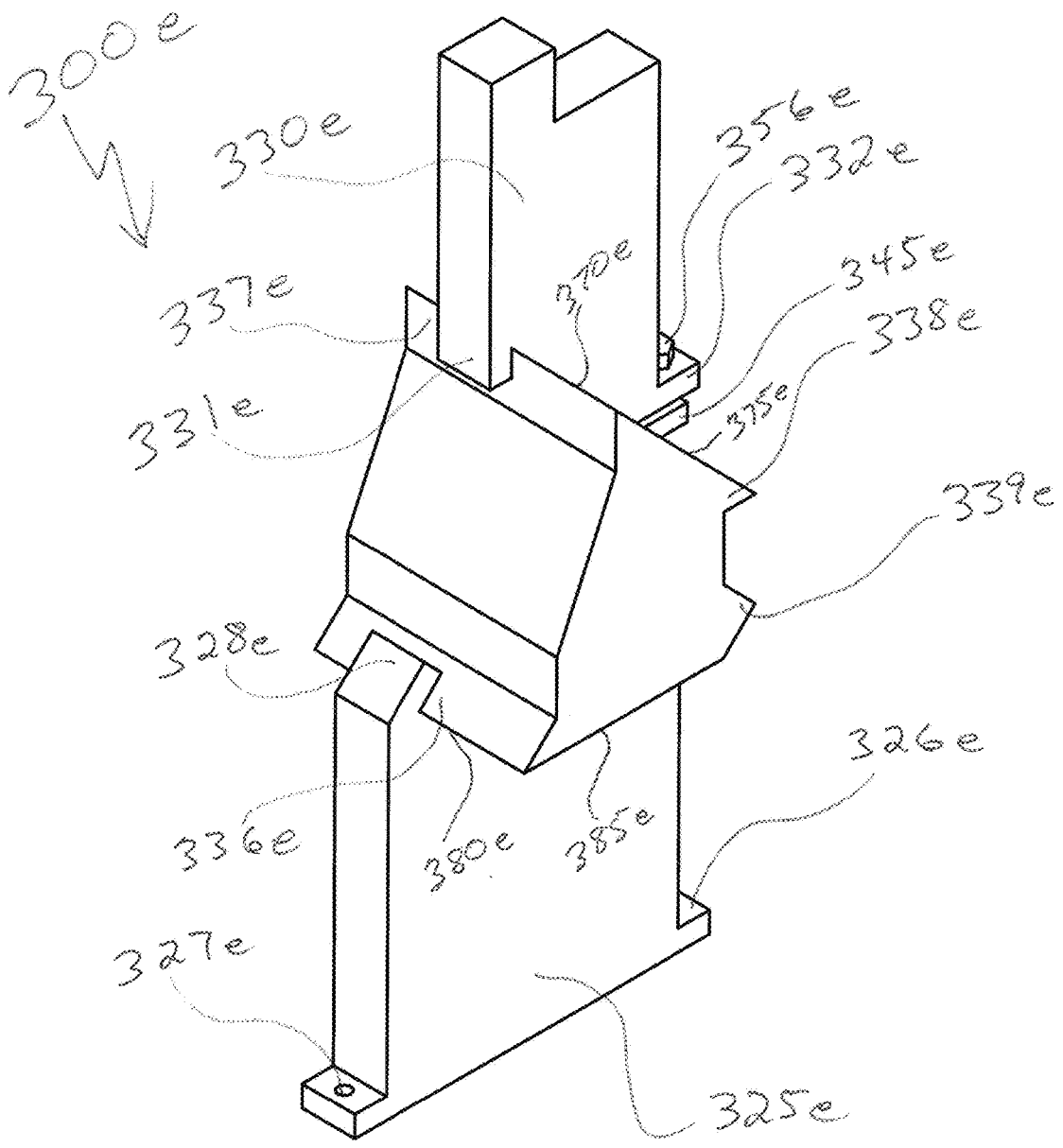
Figure 3F:
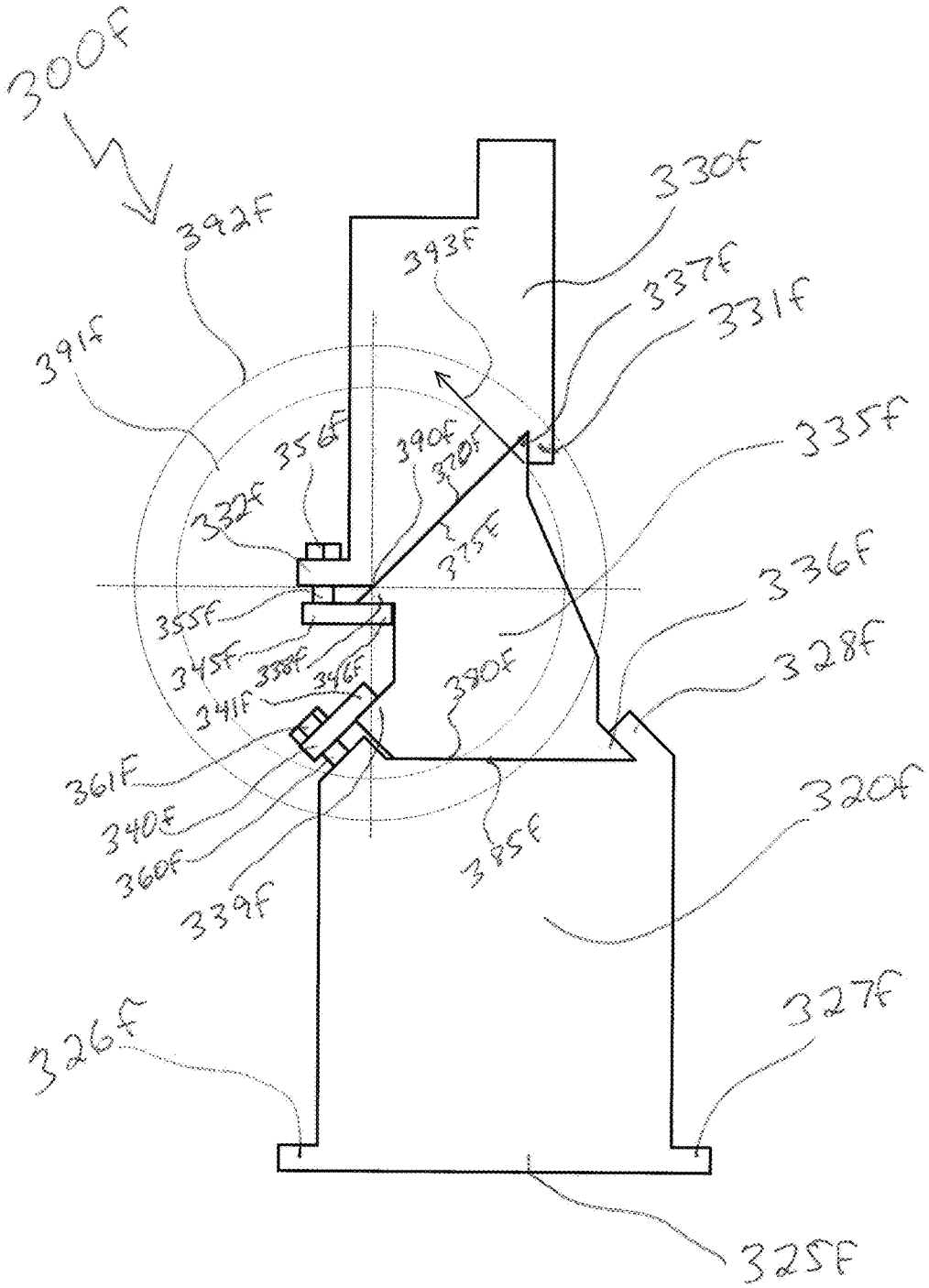
Figure 3G:
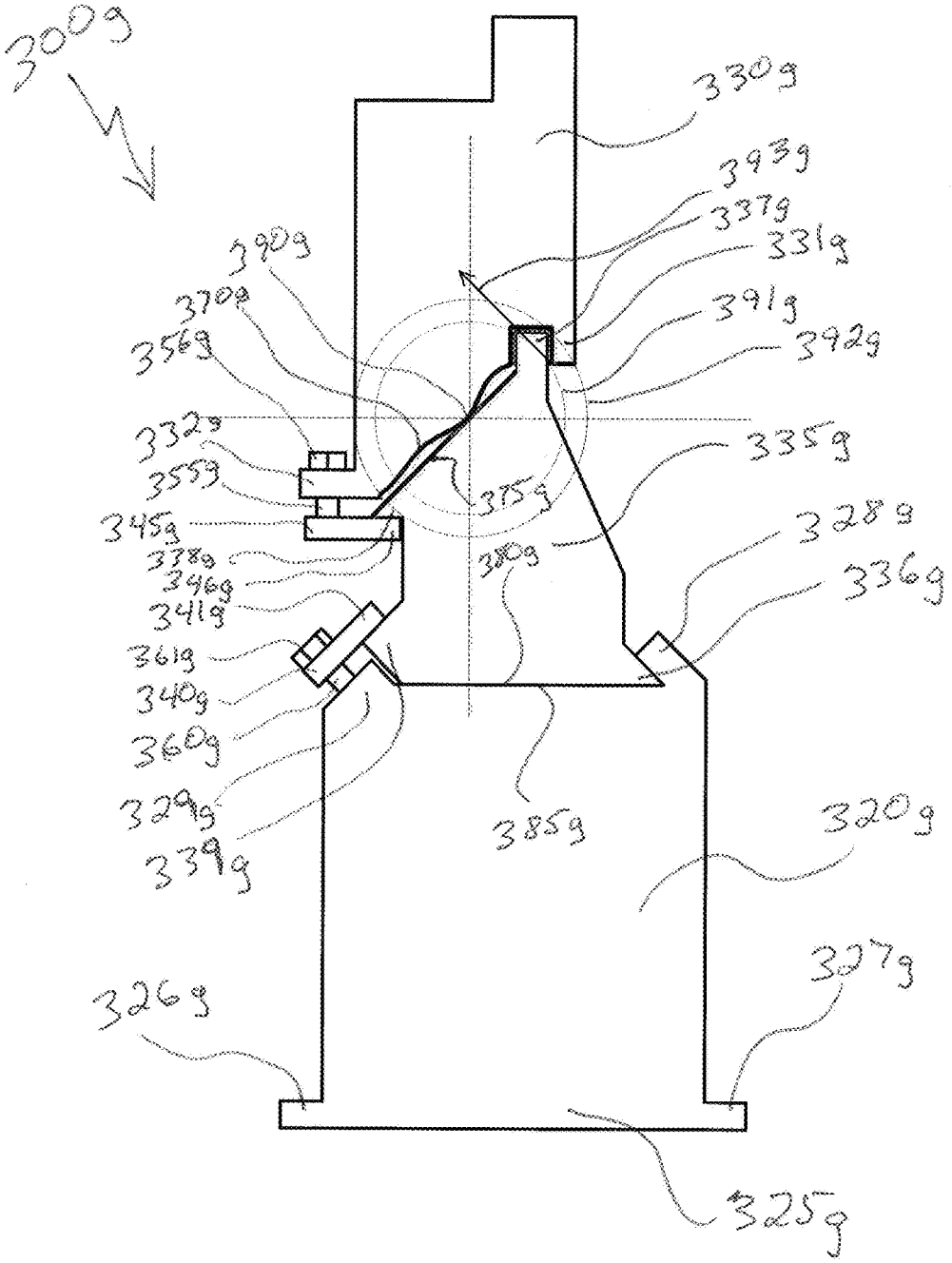
Figure 3H:
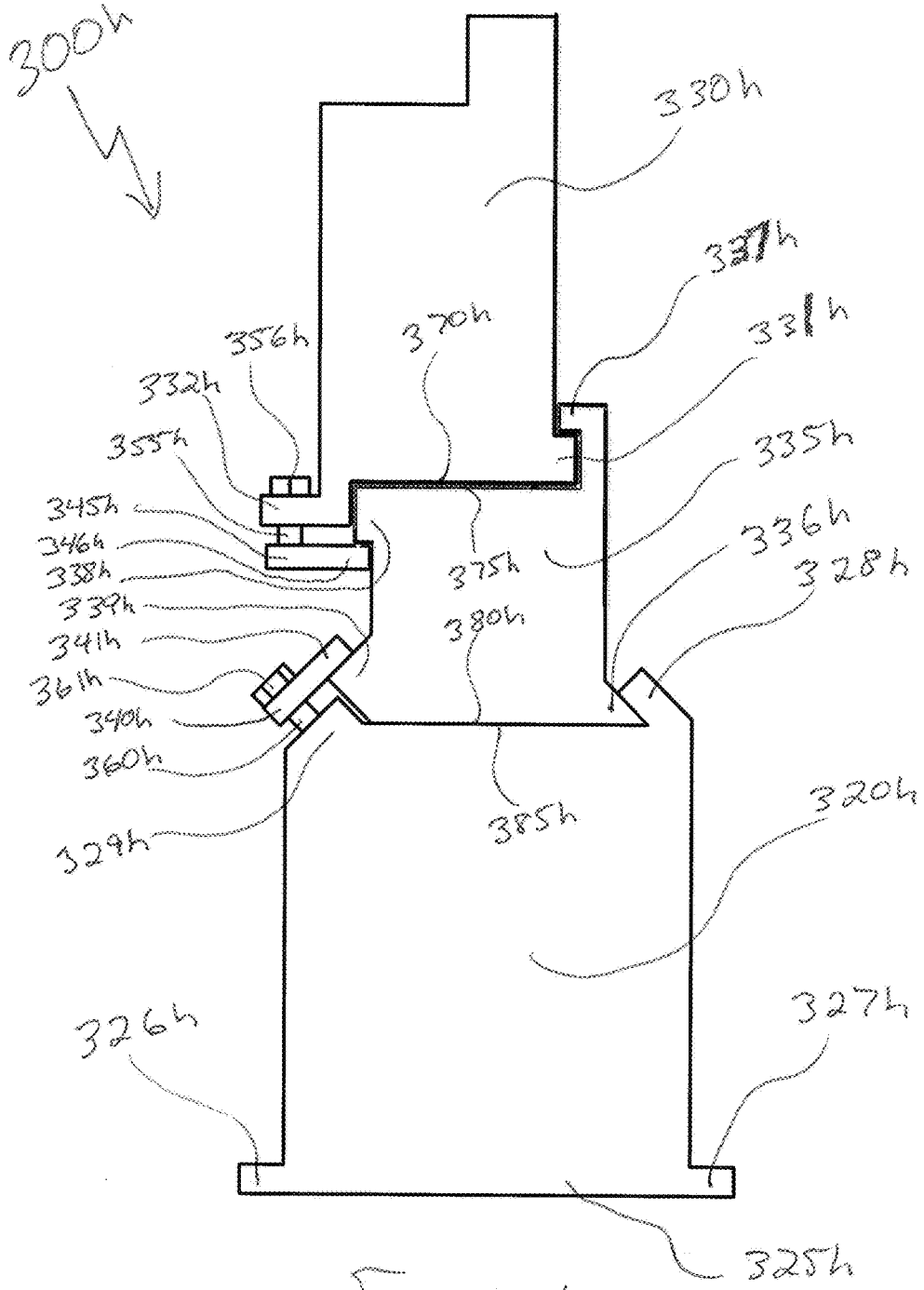
Figure 3J:
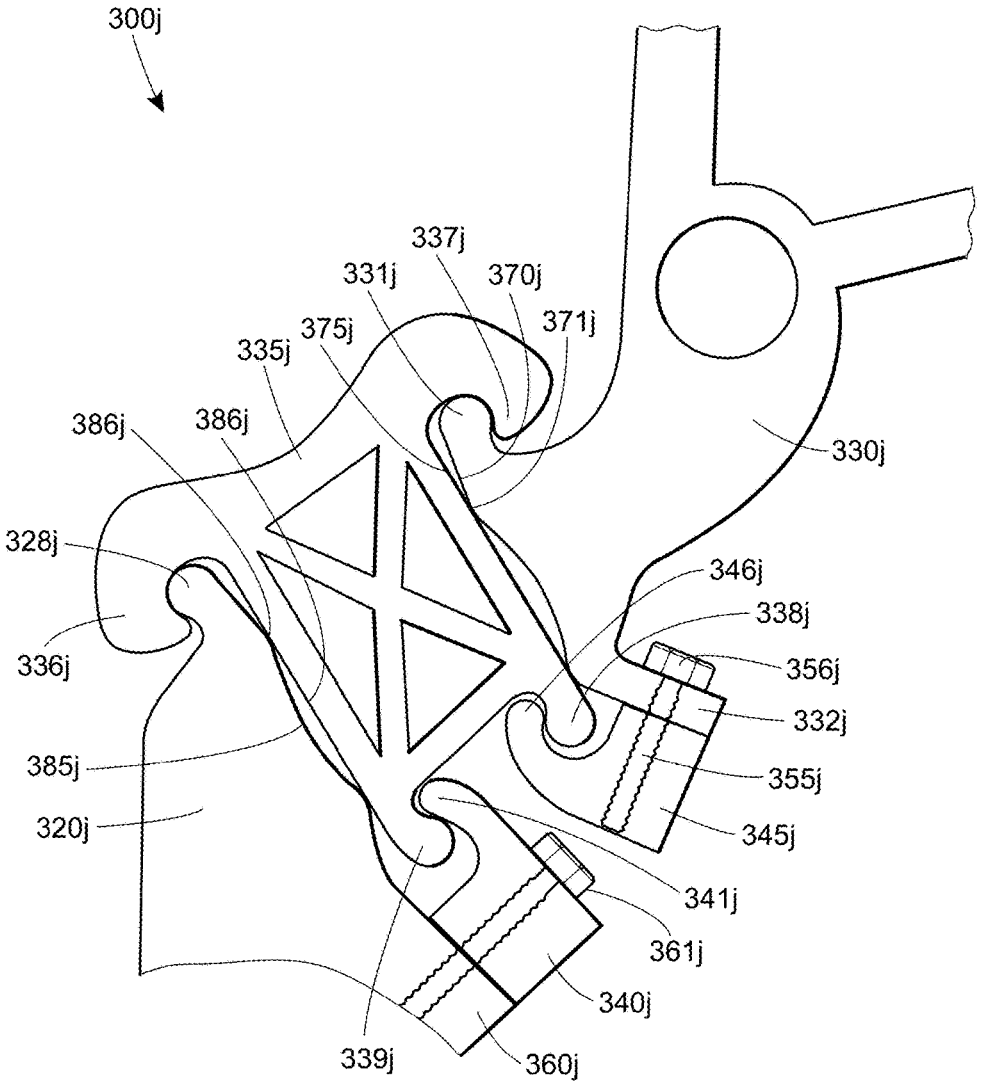
Figure 3K:
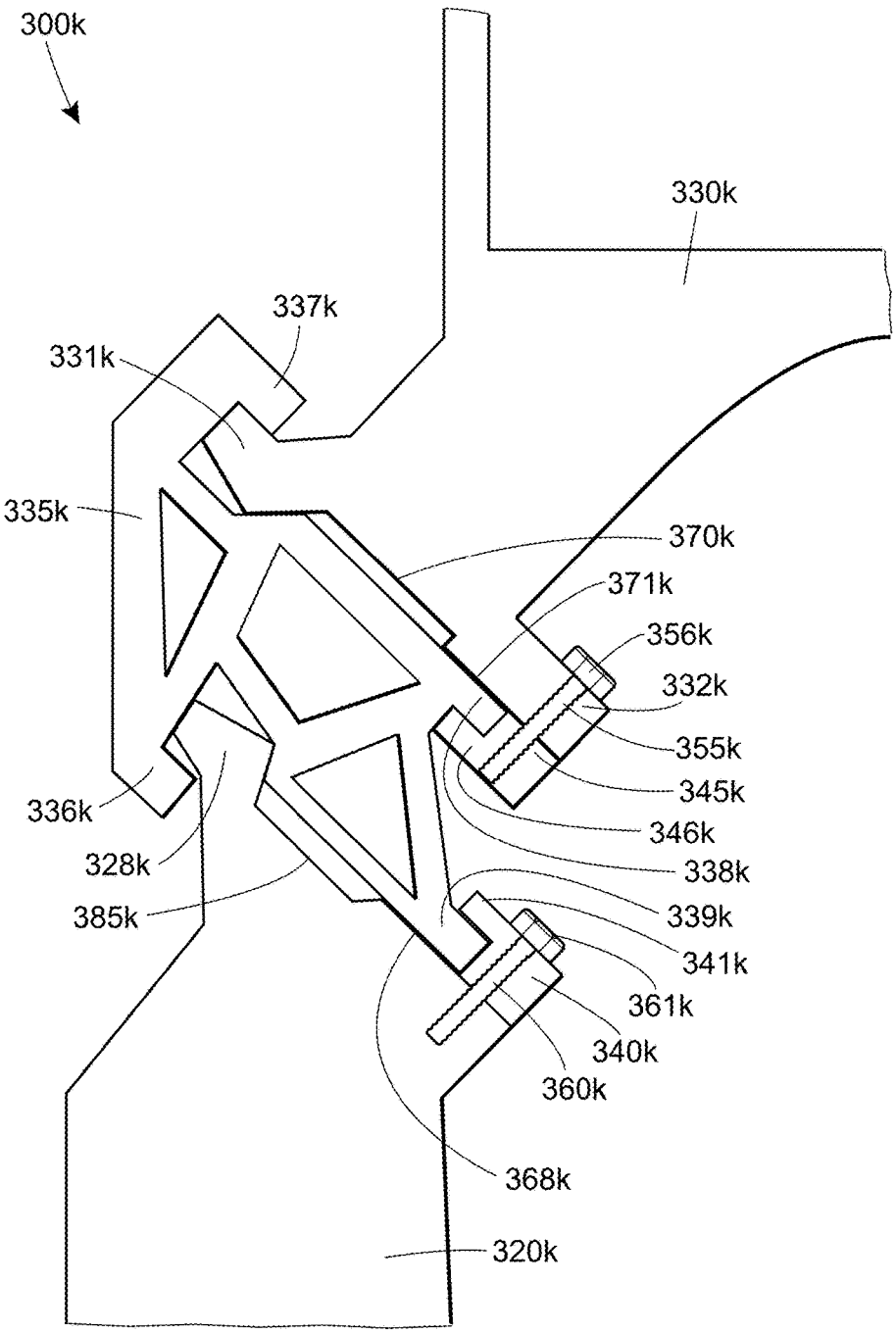
Figure 3L:
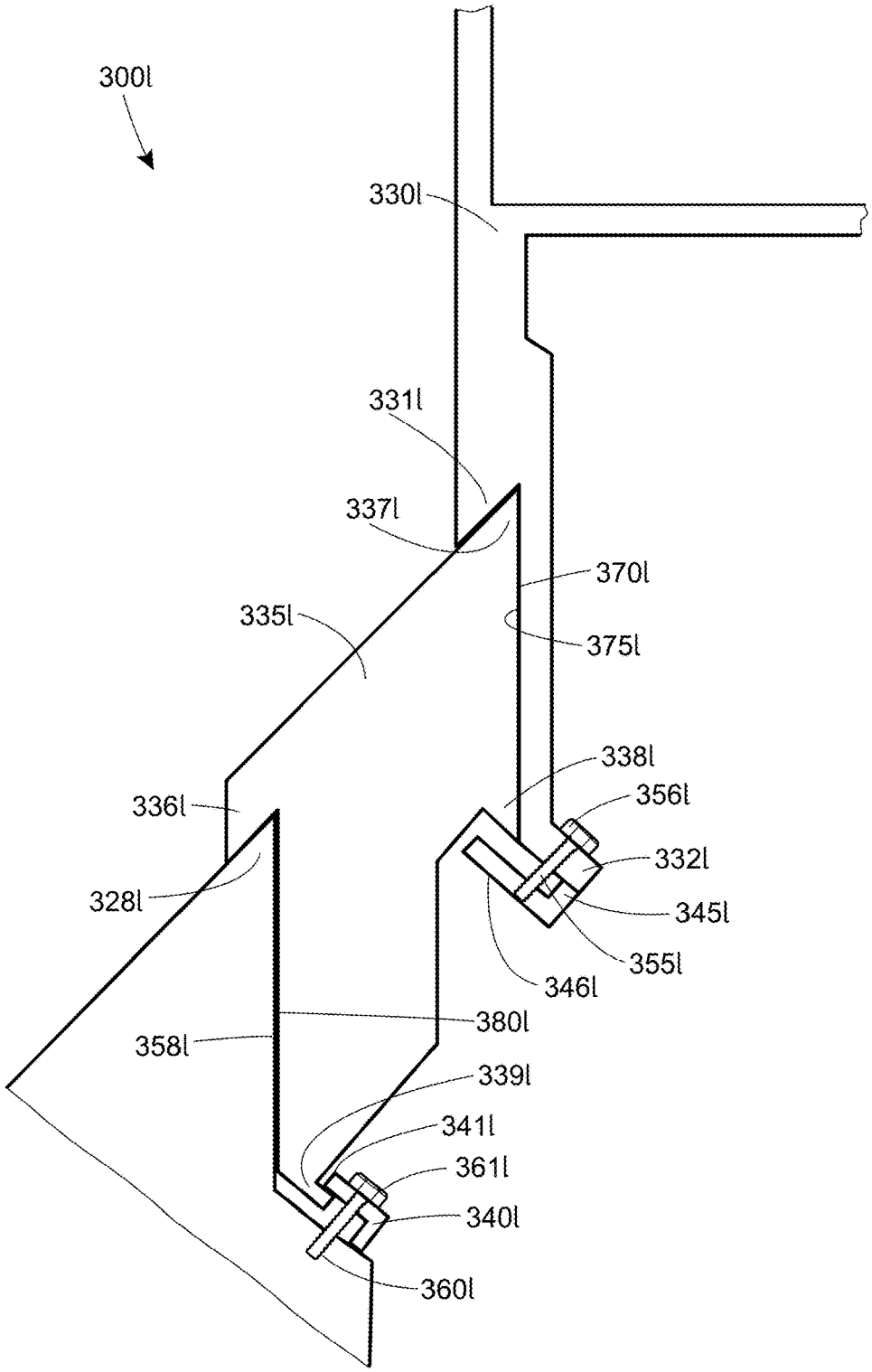
Figure 3M:
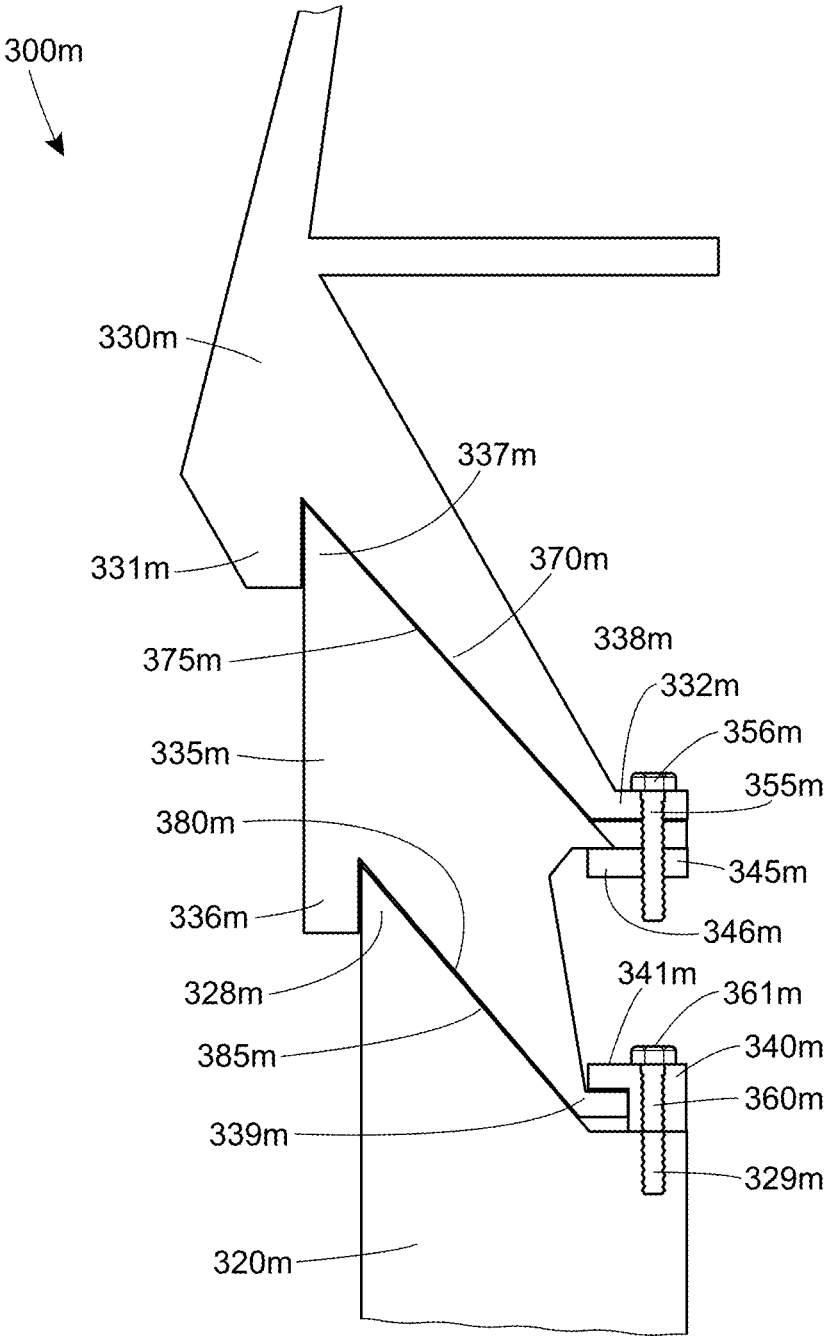
Figure 3N:
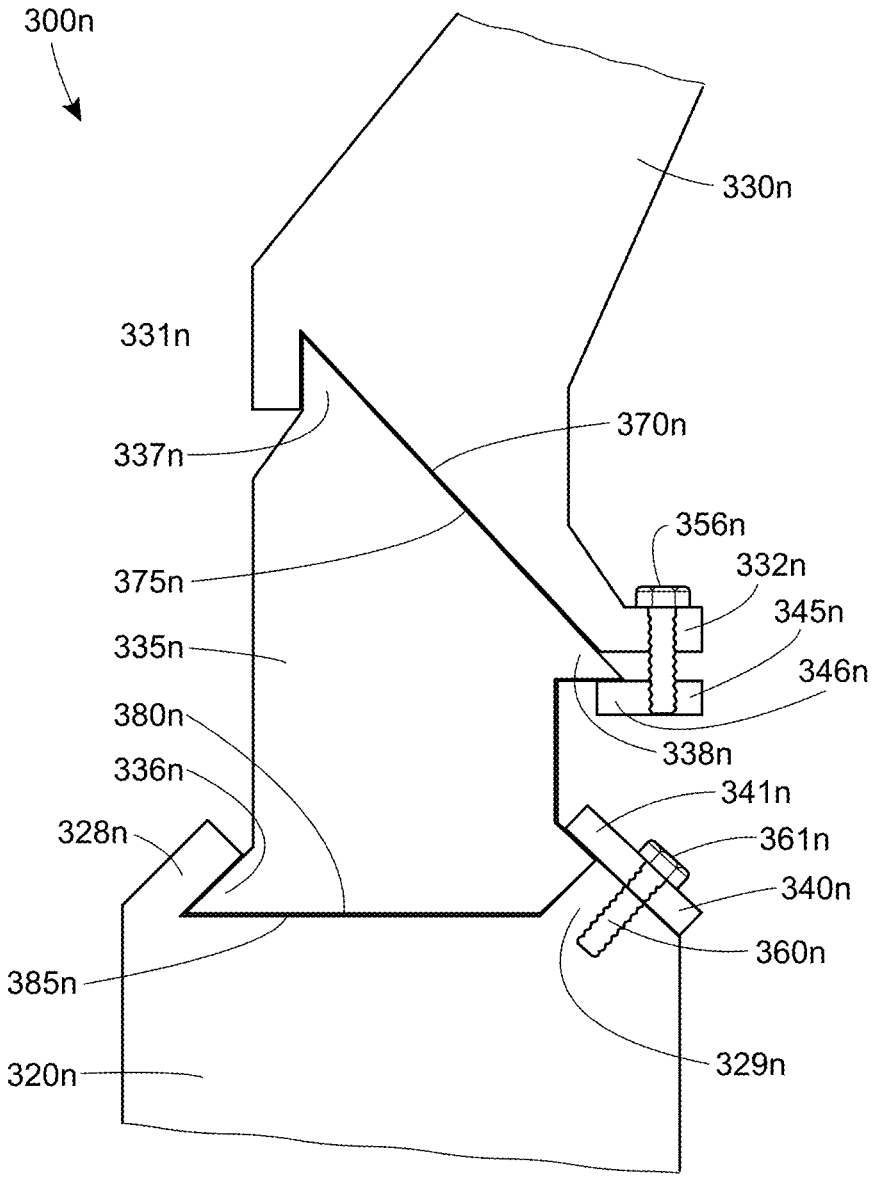
Figure 3P:
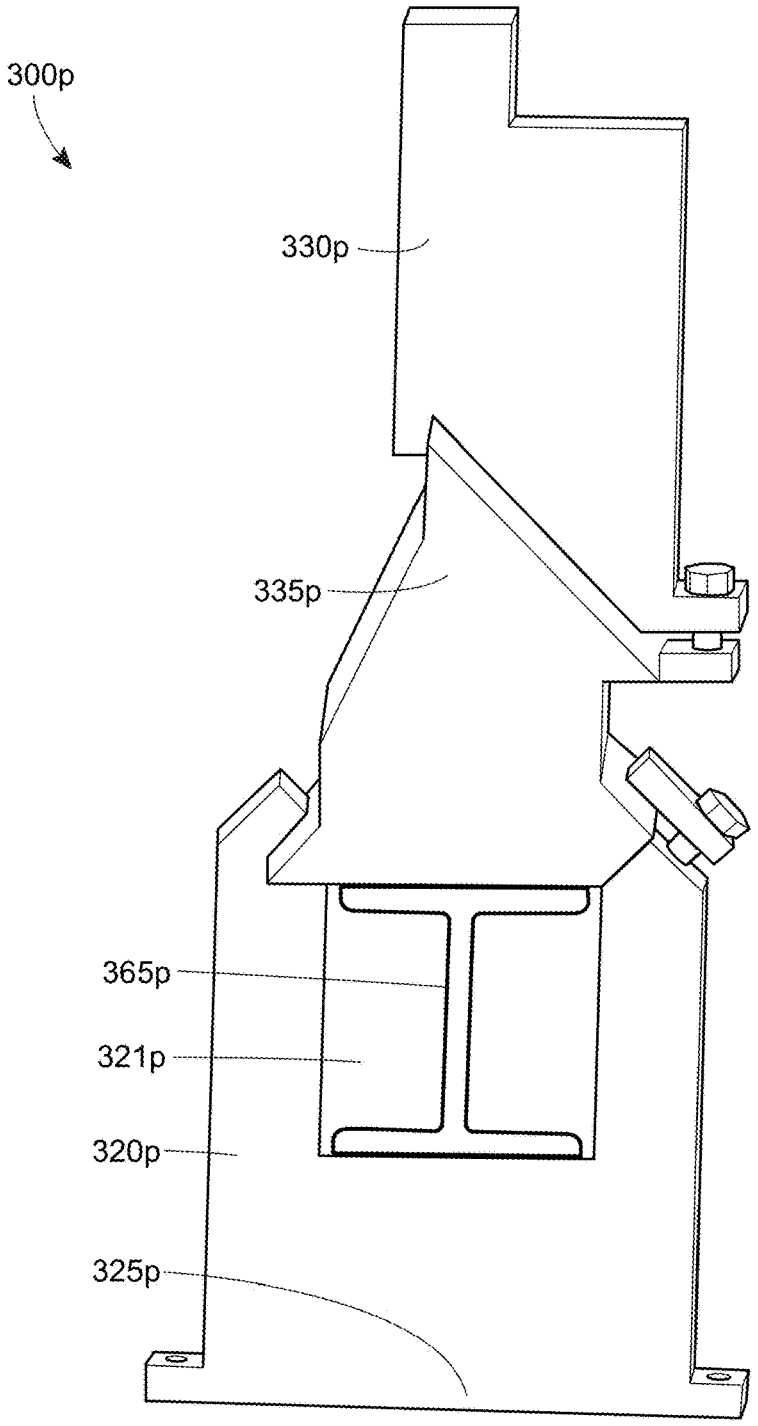
Figure 3Q:
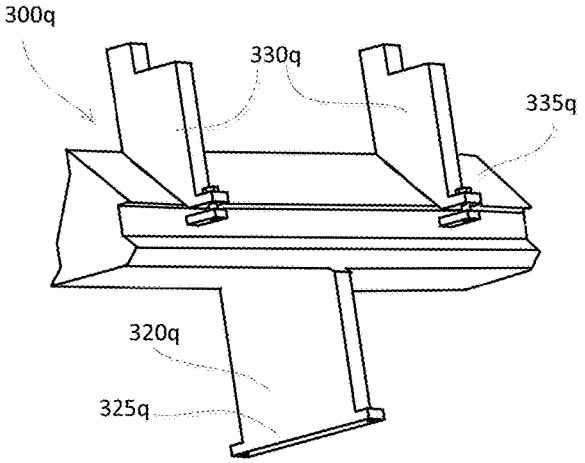

While FIGS. 1A-1C show a beam mounted to a flat floor, the chair assemblies of the present disclosure applies to all applications of beam mounted chairs including: riser mount chair assemblies, telescopic mounted chair assemblies, movable base mounted chair assemblies, pedestal base chair assemblies, as well as, pseudo-beam mounted where the beam is part of the adjacent structure (e.g., the assembly depicted in FIG. 3Q). The geometrical sizes and relationships of components are for illustration and are not intended to be restrictive in any way. For example, a width of mounting features may be increased to accommodate system loads and/or to prevent damage. Optionally, the geometry may be adjusted to allow and/or prevent elastic deformation of members, to enhance patron comfort, and/or to extend system life. This may include added features such as crush ribs, or contact features with properties that limits movement and/or accommodate system expansion due to environmental factors. This may also include features which allow a beam mounted chair to accommodate beam geometry such as beams of differing installation radii, beams of less than perfect co-linearity, etc. Such features may be between a beam and a standard and/or the beam and a chair assembly.

Figure 2A:
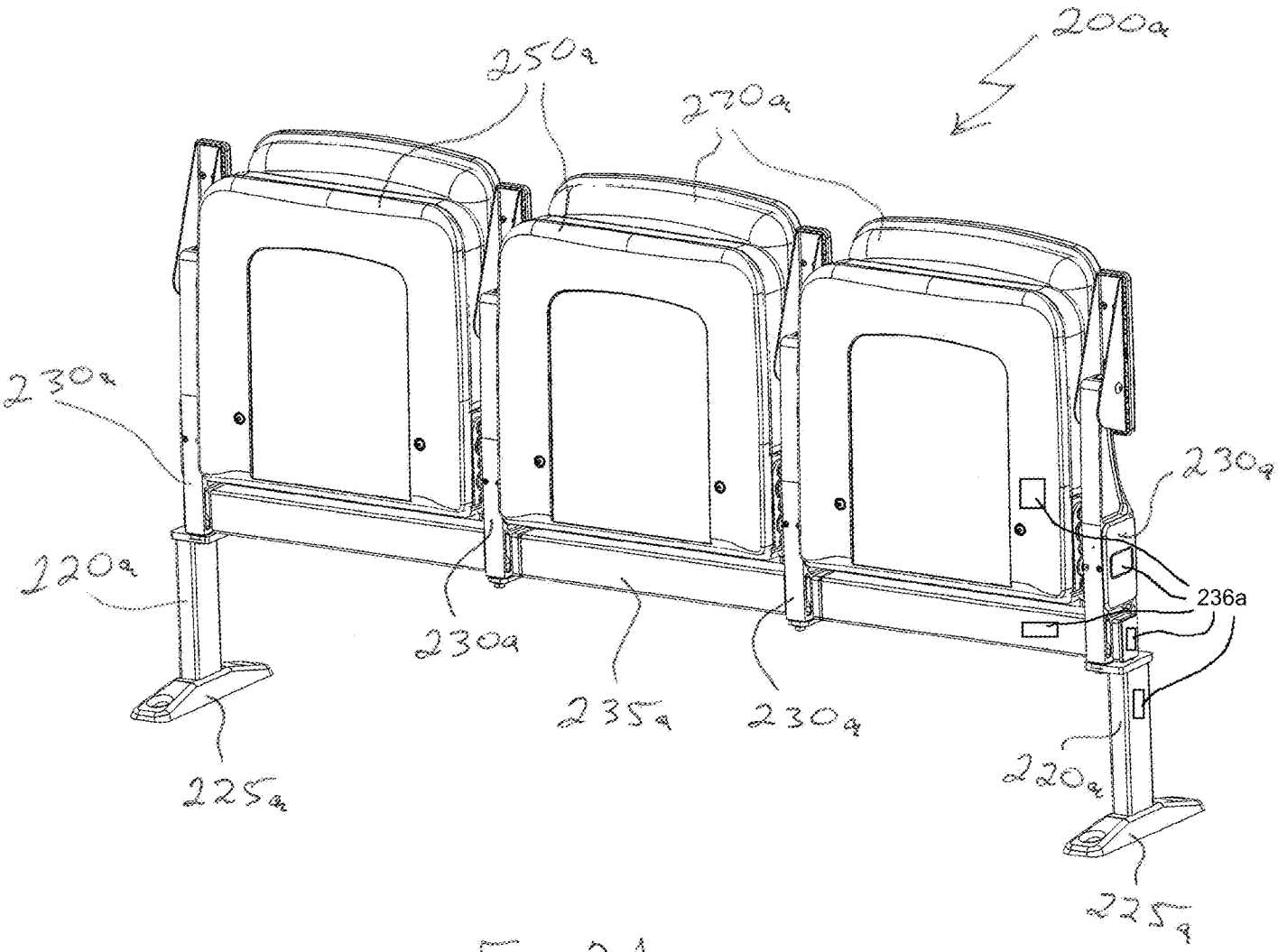
FIGS. 2A-2C depict various views of example beam mounted chair assemblies for use within the installations of FIGS. 1A-1D.

With reference to FIG. 2A, a beam mounted chair assembly 200*a* is depicted including chair seats 250*a* pivotally mounted to chair brackets 230*a* proximate corresponding chair backs 270*a*. The chair seats 250*a* and chair backs may be as described, for example, in commonly assigned patent applications Ser. No. 61/856,013, entitled Telescopic Seating Systems, and Foldable Chairs and Related Components for use within Telescopic Seating Systems, filed Jul. 18, 2013; and Ser. No. 61/868,547, entitled Telescopic Seating Systems, and Foldable Chairs and Related Components for use within Telescopic Seating Systems, filed Aug. 21, 2013, the disclosures of which are all incorporated herein in their entireties by reference. The chair brackets 230*a* may be secured to a beam 235*a*. A beam 235*a* may be supported by a plurality of standards 220*a*. A standard 220*a* may be supported on a mounting foot 225*a*. The chair brackets 230*a*, standards 220*a* and mounting feet 225*a* may be as described, for example, in commonly assigned patent applications Ser. No. 61/856,013, entitled Telescopic Seating Systems, and Foldable Chairs and Related Components for use within Telescopic Seating Systems, filed Jul. 18, 2013; Ser. No. 61/868,547, entitled Telescopic Seating Systems, and Foldable Chairs and Related Components for use within Telescopic Seating Systems, filed Aug. 21, 2013; Ser. No. 61/946,824, entitled Rocker Style Chairs, Modular Components for use within Rocker Style Chairs and Parts for use within the Modular Components, filed Mar. 2, 2014; and Ser. No. 62/006,363, entitled Reconfigurable Seating Systems, Seat Assemblies for use within the Reconfigurable Seating Systems, Components for use within the Seat Assemblies and Parts for use within the Components, filed Jun. 2, 2014, the disclosures of which are all incorporated herein in their entireties by reference.

As illustrated in FIG. 2A, a beam mounted chair assembly 200*a* may include at least one chair location label 236*a*. A chair location label 236*a* may include alpha-numeric indicia that identifies, for example, a row 105*a*-109*a*, a section 101*a*-103*a*, and/or a particular chair 150*a* location. The chair location label 236*a* may be located on a standard 220*a*, a mounting foot 225*a*, a chair bracket 230*a*, a beam 235*a*, and/or a chair seat 250*a*. While not shown in FIG. 2A, a chair location label 236*a* may be located on a chair arm 190*b*, a chair cup holder 191*b*, a chair back 270*a*, or any other location that is visible to an occupant upon approaching an associated chair. A chair location label 236*a* may be, for example, removably fixed in a desired position. Thereby, chairs may be renumbered when chairs are movable, for example, in reconfigurable chair systems as described in U.S. patent application Ser. No. 14/728,401. Alternatively, or additionally, fixed positions chairs may have a chair location label 236*a* glued or riveted in a particular, fixed, position. Folding chairs may have a chair location label 236*a*, for example, written in chalk on a chair seat 250*a*. Alternatively, a removable chair location label 236*a* (e.g., vinyl cling or vinyl decal) may be placed on a bottom of a chair seat 250*a*, and may an alpha-numeric chair location may be written on the chair location label 236*a*.

Static clings are made from a thin plastic film (e.g., vinyl) that may "cling" to different surfaces with, for example, static electricity. Static cling may cling to smooth surfaces, such as plastic and metal. A static cling may be printed with vibrant full-color, solid design and/or may have a glossy finish. Static clings may be free of adhesive, and can easily be removed, repositioned, and reused. A static cling chair location label 236*a* may be printed in any size, and any shape, for example, by die-cutting.

Vinyl decals chair location labels 236*a* may be heavy-duty stickers. The material may be a thin plastic film that sticks to a variety of surfaces, including glass, metal, wood and plastic. A vinyl film may be weatherproof and may include a gloss finish. Vinyl decal chair location labels 236*a* may be printed with an opaque, full-color design on one side and adhesive on the other.

In circumstances where a chair location label 236*a* is to be placed on a magnetic metal chair component (e.g., a mounting foot, a chair support, a beam, a chair bracket, a chair arm, a cup holder, a chair seat, a chair back, etc.), the chair location label 236*a* may be a magnet. Alternatively, in circumstances where a chair location label 236*a* is to be place on a non-magnetic chair component (e.g., an aluminum mounting foot, an aluminum chair support, an aluminum beam, an aluminum chair bracket, a plastic chair arm, a plastic cup holder, a wooden or plastic chair seat, a plastic or wooden chair back, etc.), a magnetic metal plate may be fixed to the chair component and a magnet chair location label 236*a* may be removably position on the magnetic metal plate. Alternatively, or additionally, either a chair location label 236*a* and/or an associated magnetic metal plate may be removably attached with a snap on holder.

Alternatively, or additionally, a chair location label 236*a* may be a reconfigurable display (e.g., a LCD display, a LED display, an eInk display, a plasma display, a CRT display, etc.). When the chair location label 236*a* is configured as a display, the chair location label 236*a* may be connected to power/data outlets 110*a* and related interconnections 111*a*, and may display additional information, such as advertisements, point of sale items (e.g., concessions, tickets, clothing, etc.). Optionally, a chair location label 236*a* may be displayed on a mobile telephone display, and the mobile telephone may be configured as described, for example, in U.S. patent application Ser. No. 62/175,210, which is incorporated in its entirety herein by reference.

Figure 2B:
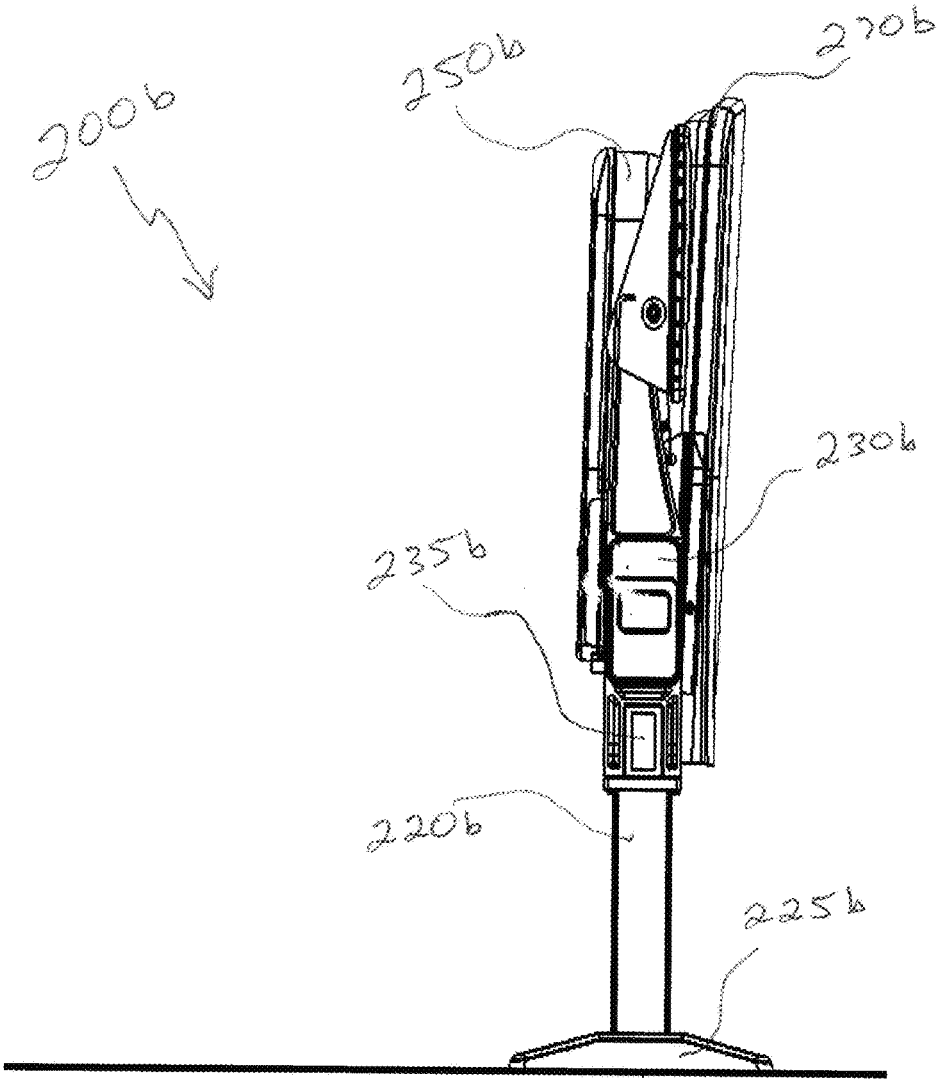

With reference to FIG. 2B, a beam mounted chair assembly 200*b* is depicted. The beam mounted chair assembly 200*b* may be similar to beam mounted chair assembly 200*a* of FIG. 1A. The beam mounted chair assembly 200*b* may include a chair seat 250*b* pivotally attached to a chair bracket 230*b* proximate a chair back 270*b*. The chair seat 250*b* is depicted in a folded up position. The chair bracket 230*b* may be supported by a beam 235*b*. The beam 235*b* may be supported by a standard 220*b*. The standard 220*b* may be supported by a mounting foot 225*b*.

Figure 2C:
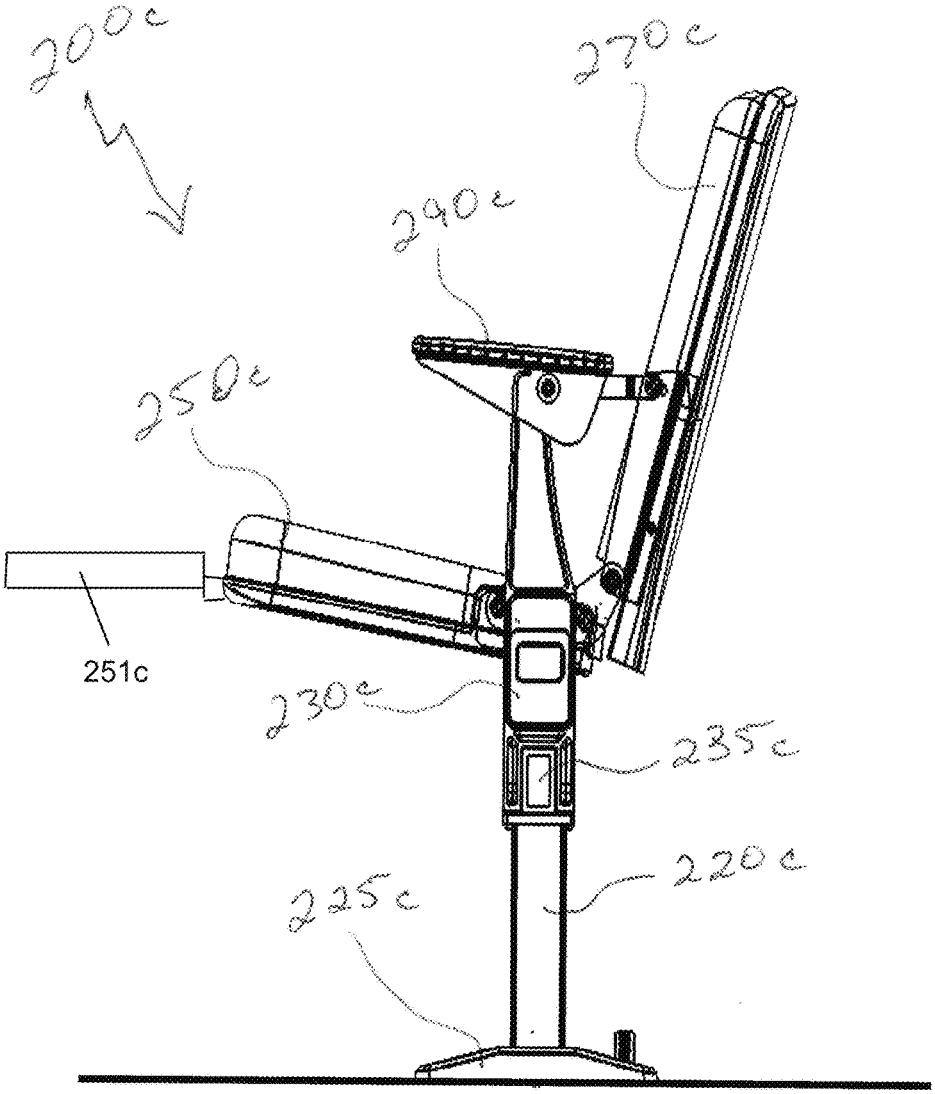

Turning to FIG. 2C, a beam mounted chair assembly 200*c* is depicted. The beam mounted chair assembly 200*c* may be similar to beam mounted chair assembly 200*a* of FIG. 1A. The beam mounted chair assembly 200*c* may include a chair seat 250*c* pivotally attached to a chair bracket 230*c* proximate a chair back 270*c*. The chair seat 250*c* is depicted in a folded down position. The chair bracket 230*c* may be supported by a beam 235*c*. The beam 235*c* may be supported by a standard 220*c*. The standard 220*c* may be supported by a mounting foot 225*c*.

The beam mounted chair assembly 200*c* may also include an ottoman 251*c*. The beam mounted chair assembly 200*c* may include a manual control configured to allow a chair occupant to manually reposition the ottoman 251*c*. Alternatively, the beam mounted chair assembly 200*c* may include a powered control (e.g., an electric powered actuator and push buttons) configured to allow a chair occupant to reposition the ottoman 251*c* as disclosed, for example, in U.S. patent application Ser. No. 15/640,938, which is incorporated in its entirety herein by reference. When a powered control is included, the ottoman 251*c* may automatically retract in response to a remote control (e.g., a venue emergency system, a venue cleaning system, a venue ticketing system). Similarly, the ottoman 251*c* may automatically extend in response to a remote control (e.g., a venue cleaning system). A first ottoman 251*c* may be inhibited from starting to move when a second ottoman 251*c* of another chair is starting to move, thereby, reducing electric power demand. The beam mounted chair assembly 200*c* may include any of the electrical power and/or data systems as disclosed in, for example, commonly assigned U.S. patent application Ser. No. 15/640,938, which is incorporated in its entirety herein by reference.

With reference to FIG. 3A, a top, front, perspective view of a beam mounted chair assembly 300*a* is depicted including a chair bracket 330*a* supported on a beam 335*a*. The beam mounted chair assembly 300*a* may be incorporated with any of the installations 100*a*-100*d* of FIGS. 1A-1D. The beam 335*a* is supported on a standard 320*a*. The chair bracket 330*a* may include a front tab 332*a*, a rear tab 331*a* and a bottom interface surface 370*a*. The beam 335*a* may include a front top tab 338*a*, a front bottom tab 339*a*, a rear top hook 337*a*, a rear bottom hook 336*a*, a top interface surface 375*a* and a bottom interface surface 380*a*. The standard 320*a* may include a mounting foot 325*a* having a front foot 326*a* and a rear foot 327*a*, a rear tab 328*a* and a top interface surface 385*a*. The beam 335*a* may be secured to the standard 320*a* with the rear tab 328*a* received within the bottom rear hook 336*a* and the bottom front tab 339*a* between a tab 341*a* of a clamp 340*a* and the top interface surface 385*a* via a bolt 360*a* having a bolt head 361*a*. The chair bracket 330*a* may be secured to the beam 335*a* with the rear tab 331*a* received within the top rear hook 337*a* and the top front tab 338*a* between a tab 346*a* of a clamp 345*a* and the top interface surface 375*a* via a bolt 355*a* having a bolt head 356*a*. While the interfacing surfaces 370*a*, 375*a*, 380*a*, 385*a* are illustrated within FIG. 3A as being substantially flat, any one of the interfacing surfaces 370*a*, 375*a*, 380*a*, 385*a* may be non-flat as depicted in FIGS. 3G, 3J and 3K.

As reflected in FIG. 3A, features 342*a*, 347*a* may be included to align the clamps to facilitate installation with minimal effort. Similar features may be added to a standard and/or a beam and the beam to the chair. Respective alignment features 342*a*, 347*a* may be part of a clamp, a standard, a beam and/or a chair.

Turning to FIG. 3B, a bottom, front, perspective view of a beam mounted chair assembly 300*b* is depicted including a chair bracket 330*b* supported on a beam 335*b*. The beam mounted chair assembly 300*b* may be similar to the beam mounted chair assembly 300*a* The beam 335*b* is supported on a standard 320*a*. The chair bracket 330*b* may include a front tab 332*b*, a rear tab 331*b* and a bottom interface surface 370*b*. The beam 335*b* may include a front top tab 338*b*, a front bottom tab 339*b*, a rear top hook 337*b*, a rear bottom hook 336*b*, a top interface surface 375*b* and a bottom interface surface 380*b*. The standard 320*b* may include a mounting foot 325*b* having a front foot 326*b* and a rear foot 327*b*, a rear tab 328*b* and a top interface surface 385*b*. The beam 335*b* may be secured to the standard 320*b* with the rear tab 328*b* received within the bottom rear hook 336*b* and the bottom front tab 339*b* between a tab 341*b* of a clamp 340*b* and the top interface surface 385*b* via a bolt 360*b* having a bolt head 361*b*. The chair bracket 330*b* may be secured to the beam 335*b* with the rear tab 331*b* received within the top rear hook 337*b* and the top front tab 338*b* between a tab 346*b* of a clamp 345*b* and the top interface surface 375*b* via a bolt 355*b* having a bolt head 356*b*. While the interfacing surfaces 370*b*, 375*b*, 380*b*, 385*b* are illustrated within FIG. 3B as being substantially flat, any one of the interfacing surfaces 370*b*, 375*b*, 380*b*, 385*b* may be non-flat as depicted in FIGS. 3G, 3J and 3K.

With reference to FIG. 3C, a left-side profile view of a beam mounted chair assembly 300*c* is depicted including a chair bracket 330*c* supported on a beam 335*c*. The beam mounted chair assembly 300*c* may be similar to the beam mounted chair assembly 300*a*. The beam 335*c* is supported on a standard 320*c*. The chair bracket 330*c* may include a front tab 332*c*, a rear tab 331*c* and a bottom interface surface 370*c*. The beam 335*c* may include a front top tab 338*c*, a front bottom tab 339*c*, a rear top hook 337*c*, a rear bottom hook 336*c*, a top interface surface 375*c* and a bottom interface surface 380*c*. The standard 320*c* may include a mounting foot 325*c* having a front foot 326*c* and a rear foot 327*c*, a rear tab 328*c* and a top interface surface 385*c*. The beam 335*c* may be secured to the standard 320*c* with the rear tab 328*c* received within the bottom rear hook 336*c* and the bottom front tab 339*c* between a tab 341*c* of a clamp 340*c* and the top interface surface 385*c* via a bolt 360*c* having a bolt head 361*c*. The chair bracket 330*c* may be secured to the beam 335*c* with the rear tab 331*c* received within the top rear hook 337*c* and the top front tab 338*c* between a tab 346*c* of a clamp 345*c* and the top interface surface 375*c* via a bolt 355*c* having a bolt head 356*c*. While the interfacing surfaces 370*c*, 375*c*, 380*c*, 385*c* are illustrated within FIG. 3C as being substantially flat, any one of the interfacing surfaces 370*c*, 375*c*, 380*c*, 385*c* may be non-flat as depicted in FIGS. 3G, 3J and 3K.

Turning to FIG. 3D, a front, bottom, perspective view of a beam mounted chair assembly 300*d* is depicted including a chair bracket 330*d* supported on a beam 335*d*. The beam mounted chair assembly 300*d* may be incorporated within any of the installations 100*a*-100*d* of FIGS. 1A-1D. The beam 335*d* may be supported on a standard 320*d*. The chair bracket 330*d* may include a front tab 332*d*, a rear hook 331*d* and a bottom interface surface 370*d*. The beam 335*d* may include a front top tab 338*d*, a front bottom tab 339*d*, a rear top tab 337*d*, a rear bottom tab 336*d*, a top interface surface 375*d* and a bottom interface surface 380*d*. The standard 320*d* may include a mounting foot 325*d* having a front foot 326*d* and a rear foot 327*d*, a rear hook 328*d* and a top interface surface 385*d*. The beam 335*d* may be secured to the standard 320*d* with the rear hook 328*d* receiving the bottom rear tab 336*d* and the bottom front tab 339*d* between a tab 341*d* of a clamp 340*d* and the top interface surface 385*d* via a bolt 360*d* having a bolt head 361*d*. The chair bracket 330*d* may be secured to the beam 335*d* with the rear hook 331*d* receiving the top rear tab 337*d* and the top front tab 338*d* between a tab 346*d* of a clamp 345*d* and the top interface surface 375*d* via a bolt 355*d* having a bolt head 356*d*. While the interfacing surfaces 370*d*, 375*d*, 380*d*, 385*d* are illustrated within FIG. 3D as being substantially flat, any one of the interfacing surfaces 370*d*, 375*d*, 380*d*, 385*d* may be non-flat as depicted in FIGS. 3G, 3J and 3K.

With reference to FIG. 3E, a back, top, perspective view of a beam mounted chair assembly 300*e* is depicted including a chair bracket 330*e* supported on a beam 335*e*. The beam mounted chair assembly 300*e* may be similar to the beam mounted chair assembly 300*d*. The beam 335*e* may be supported on a standard 320*e*. The chair bracket 330*e* may include a front tab 332*e*, a rear hook 331*e* and a bottom interface surface 370*e*. The beam 335*e* may include a front top tab 338*e*, a front bottom tab 339*e*, a rear top tab 337*e*, a rear bottom tab 336*e*, a top interface surface 375*e* and a bottom interface surface 380*e*. The standard 320*e* may include a mounting foot 325*e* having a front foot 326*e* and a rear foot 327*e*, a rear hook 328*e* and a top interface surface 385*e*. The beam 335*e* may be secured to the standard 320*e* with the rear hook 328*e* receiving the bottom rear tab 336*e* and the bottom front tab 339*e* between a tab 341*e* of a clamp 340*e* and the top interface surface 385*e* via a bolt 360*e* having a bolt head 361*e*. The chair bracket 330*e* may be secured to the beam 335*e* with the rear hook 331*e* receiving the top rear tab 337*e* and the top front tab 338*e* between a tab 346*e* of a clamp 345*e* and the top interface surface 375*d* via a bolt 355*e* having a bolt head 356*e*. While the interfacing surfaces 370*e*, 375*e*, 380*e*, 385*e* are illustrated within FIG. 3E as being substantially flat, any one of the interfacing surfaces 370*e*, 375*e*, 380*e*, 385*e* may be non-flat as depicted in FIGS. 3G, 3J and 3K.

Turning to FIG. 3F, a left-side profile view of a beam mounted chair assembly 300*f* is depicted including a chair bracket 330*f* supported on a beam 335*f*. The beam mounted chair assembly 300*f* may be similar to the beam mounted chair assembly 300*d*. The beam 335*f* may be supported on a standard 320*f*. The chair bracket 330*f* may include a front tab 332*f*, a rear hook 331*f* and a bottom interface surface 370*f*. The beam 335*f* may include a front top tab 338*f*, a front bottom tab 339*f*, a rear top tab 337*f*, a rear bottom tab 336*f*, a top interface surface 375*f* and a bottom interface surface 380*f*. The standard 320*f* may include a mounting foot 325*f* having a front foot 326*f* and a rear foot 327*f*, a rear hook 328*f* and a top interface surface 385*f*. The beam 335*f* may be secured to the standard 320*f* with the rear hook 328*f* receiving the bottom rear tab 336*f* and the bottom front tab 339*f* between a tab 341*f* of a clamp 340*f* and the top interface surface 385*f* via a bolt 360*f* having a bolt head 361*f*. The chair bracket 330*f* may be secured to the beam 335*f* with the rear hook 331*f* receiving the top rear tab 337*f* and the top front tab 338*f* between a tab 346*f* of a clamp 345*f* and the top interface surface 375*f* via a bolt 355*f* having a bolt head 356*f*. While the interfacing surfaces 370*f*, 375*f*, 380*f*, 385*f* are illustrated within FIG. 3F as being substantially flat, any one of the interfacing surfaces 370*f*, 375*f*, 380*f*, 385*f* may be non-flat as depicted in FIGS. 3G, 3J and 3K. Because the interfacing surfaces 370*f*, 375*f* are substantially flat, a pivot point 390*f* is defined wherein a point 393*f* would rotate about a circle 391*f* if not for the restraint of the rear hook 331*f* by the top rear tab 337*f*. The circle 392*f* may define a top rear hook shear surface.

With reference to FIG. 3G, a left-side profile view of a beam mounted chair assembly 300*g* is depicted including a chair bracket 330*g* supported on a beam 335*g*. The beam mounted chair assembly 300*g* may be similar to the beam mounted chair assembly 300*d*. The beam 335*g* may be supported on a standard 320*g*. The chair bracket 330*g* may include a front tab 332*g*, a rear hook 331*g* and a bottom interface surface 370*g*. The beam 335*g* may include a front top tab 338*g*, a front bottom tab 339*g*, a rear top tab 337*g*, a rear bottom tab 336*g*, a top interface surface 375*g* and a bottom interface surface 380*g*. The standard 320*g* may include a mounting foot 325*g* having a front foot 326*g* and a rear foot 327*g*, a rear hook 328*g* and a top interface surface 385*g*. The beam 335*g* may be secured to the standard 320*g* with the rear hook 328*g* receiving the bottom rear tab 336*g* and the bottom front tab 339*g* between a tab 341*g* of a clamp 340*g* and the top interface surface 385*g* via a bolt 360*g* having a bolt head 361*g*. The chair bracket 330*g* may be secured to the beam 335*g* with the rear hook 331*g* receiving the top rear tab 337*g* and the top front tab 338*g* between a tab 346*g* of a clamp 345*g* and the top interface surface 375*g* via a bolt 355*g* having a bolt head 356*g*. While the interfacing surfaces 375*g*, 380*g*, 385*g* are illustrated within FIG. 3G as being substantially flat, any one of the interfacing surfaces 375*g*, 380*g*, 385*g* may be non-flat as depicted in FIGS. 3J and 3K. Because the interfacing surface 370*f* includes the protrusion at point 390*g* and because the interface surface 375*g* is substantially flat, a pivot point 390*g* is defined wherein a point 393*g* would rotate about a circle 391*g* if not for the restraint of the rear hook 331*g* by the top rear tab 337*g*. The circle 392*g* may define a top rear hook shear surface.

Turning to FIG. 3H, a left-side profile view of a beam mounted chair assembly 300*h* is depicted including a chair bracket 330*h* supported on a beam 335*h*. The beam mounted chair assembly 300*h* may be incorporated within any of the installations 100*a*-100*d* of FIGS. 1A-1D. The beam 335*h* may be supported on a standard 320*h*. The chair bracket 330*h* may include a front tab 332*h*, a rear tab 331*h* and a bottom interface surface 370*h*. The beam 335*h* may include a front top tab 338*h*, a front bottom tab 339*h*, a rear top hook 337*h*, a rear bottom tab 336*h*, a top interface surface 375*h* and a bottom interface surface 380*h*. The standard 320*h* may include a mounting foot 325*h* having a front foot 326*h* and a rear foot 327*h*, a rear hook 328*h* and a top interface surface 385*h*. The beam 335*h* may be secured to the standard 320*h* with the rear hook 328*h* receiving the bottom rear tab 336*h* and the bottom front tab 339*h* between a tab 341*h* of a clamp 340*h* and the top interface surface 385*h* via a bolt 360*h* having a bolt head 361*h*. The chair bracket 330*h* may be secured to the beam 335*h* with the rear tab 331*h* received within the top rear hook 337*h* and the top front tab 338*h* between a tab 346*h* of a clamp 345*h* and the top interface surface 375*h* via a bolt 355*h* having a bolt head 356*h*. While the interfacing surfaces 370*h*, 375*h*, 380*h*, 385*h* are illustrated within FIG. 3H as being substantially flat, any one of the interfacing surfaces 370*h*, 375*h*, 380*h*, 385*h* may be non-flat as depicted in FIGS. 3G, 3J and 3K.

With reference to FIG. 3J, a right-side profile view of a beam mounted chair assembly 300*j* is depicted including a chair bracket 330*j* supported on a beam 335*j*. The beam mounted chair assembly 300*j* may be incorporated within any of the installations 100*a*-100*d* of FIGS. 1A-1D. The beam 335*j* is supported on a standard 320*j*. The chair bracket 330*j* may include a front tab 332*j*, a rear tab 331*j* and a bottom interface surface 370*j*. The beam 335*j* may include a front top tab 338*j*, a front bottom tab 339*j*, a rear top hook 337*j*, a rear bottom hook 336*j*, a top interface surface 375*j* and a bottom interface surface 380*j*. The standard 320*j* may include a rear tab 328*j* and a top interface surface 385*j*. The beam 335*j* may be secured to the standard 320*j* with the rear tab 328*j* received within the bottom rear hook 336*j* and the bottom front tab 339*j* between a tab 341*j* of a clamp 340*j* and the top interface surface 385*j* via a bolt 360*j* having a bolt head 361*j*. The chair bracket 330*j* may be secured to the beam 335*j* with the rear tab 331*j* received within the top rear hook 337*j* and the top front tab 338*j* between a tab 346*j* of a clamp 345*j* and the top interface surface 375*j* via a bolt 355*j* having a bolt head 356*j*. The slightly curved interface surface 370*j* with protrusion 371*j* and 385*j* with protrusion 386*j* may induce a stable interface between the chair bracket 330*j* and the beam 335*j*, and between the beam 335*j* and the standard 320*j*, respectively, when the associated clamps 345*j* and 340*j* are tightened.

Turning to FIG. 3K, a right-side profile view of a beam mounted chair assembly 300*k* is depicted including a chair bracket 330*k* supported on a beam 335*k*. The beam mounted chair assembly 300*k* may be incorporated within any of the installations 100*a*-100*d* of FIGS. 1A-1D. The beam 335*k* is supported on a standard 320*k*. The chair bracket 330*k* may include a front tab 332*k*, a rear tab 331*k* and a bottom interface surface 370*k*. The beam 335*k* may include a front top tab 338*k*, a front bottom tab 339*k*, a rear top hook 337*k*, a rear bottom hook 336*k*, a top interface surface 375*k* and a bottom interface surface 380*k*. The standard 320*k* may include a rear tab 328*k* and a top interface surface 385*k*. The beam 335*k* may be secured to the standard 320*k* with the rear tab 328*k* received within the bottom rear hook 336*k* and the bottom front tab 339*k* between a tab 341*k* of a clamp 340*k* and the top interface surface 385*k* via a bolt 360*k* having a bolt head 361*k*. The chair bracket 330*k* may be secured to the beam 335*k* with the rear tab 331*k* received within the top rear hook 337*k* and the top front tab 338*k* between a tab 346*k* of a clamp 345*k* and the top interface surface 375*k* via a bolt 355*k* having a bolt head 356*k*. The slightly curved interface surface 370*k* with protrusion 371*k* and 385*k* with protrusion 386*k* may induce a stable interface between the chair bracket 330*k* and the beam 335*k*, and between the beam 335*k* and the standard 320*k*, respectively, when the associated clamps 345*k* and 340*k* are tightened.

With reference to FIG. 3L, a right-side profile view of a beam mounted chair assembly 300*l* is depicted including a chair bracket 330*l* supported on a beam 335*l*. The beam mounted chair assembly 300*l* may be incorporated within any of the installations 100*a*-100*d* of FIGS. 1A-1D. The beam 335*l* may be supported on a standard 320*l*. The chair bracket 330*l* may include a front tab 332*l*, a rear tab 331*l* and a bottom interface surface 370*l*. The beam 335*l* may include a front top tab 338*l*, a front bottom tab 339*l*, a rear top hook 337*l*, a rear bottom tab 336*l*, a top interface surface 375*l* and a bottom interface surface 380*l*. The standard 320*l* may include a rear hook 328*l* and a top interface surface 385*l*. The beam 335*l* may be secured to the standard 320*l* with the rear hook 328*l* receiving the bottom rear tab 336*l* and the bottom front tab 339*l* between a tab 341*l* of a clamp 340*l* and the top interface surface 385*l* via a bolt 360*l* having a bolt head 361*l*. The chair bracket 330*l* may be secured to the beam 335*l* with the rear tab 331*l* received within the top rear hook 337*l* and the top front tab 338*l* between a tab 346*l* of a clamp 345*l* and the top interface surface 375*l* via a bolt 355*l* having a bolt head 356*l*.

Turning to FIG. 3M, a right-side profile view of a beam mounted chair assembly 300*m* is depicted including a chair bracket 330*m* supported on a beam 335*m*. The beam mounted chair assembly 300*m* may be incorporated within any of the installations 100*a*-100*d* of FIGS. 1A-1D. The beam 335*m* may be supported on a standard 320*m*. The chair bracket 330*m* may include a front tab 332*m*, a rear tab 331*m* and a bottom interface surface 370*m*. The beam 335*m* may include a front top tab 338*m*, a front bottom tab 339*m*, a rear top hook 337*m*, a rear bottom tab 336*m*, a top interface surface 375*m* and a bottom interface surface 380*m*. The standard 320*m* may include a rear hook 328*m* and a top interface surface 385*m*. The beam 335*m* may be secured to the standard 320*m* with the rear hook 328*m* receiving the bottom rear tab 336*m* and the bottom front tab 339*m* between a tab 341*m* of a clamp 340*m* and the top interface surface 385*m* via a bolt 360*m* having a bolt head 361*m*. The chair bracket 330*m* may be secured to the beam 335*m* with the rear tab 331*m* received within the top rear hook 337*m* and the top front tab 338*m* between a tab 346*m* of a clamp 345*m* and the top interface surface 375*m* via a bolt 355*m* having a bolt head 356*m*.

With reference to FIG. 3N, a right-side profile view of a beam 335*n* is in compression instead of employing a hook (e.g., hooks 336*j*, 337*j*, 336*k*, 337*k*) of an extruded beam (e.g., extruded beam 335*j*, 335*k*). The beam mounted chair assembly 300*n* is depicted including a chair bracket 330*n* supported on a beam 335*n*. The beam mounted chair assembly 300*n* may be incorporated within any of the installations 100*a*-100*d* of FIGS. 1A-1D. The beam 335*n* may be supported on a standard 320*n*. The chair bracket 330*n* may include a front tab 332*n*, a rear tab 331*n* and a bottom interface surface 370*n*. The beam 335*n* may include a front top tab 338*n*, a front bottom tab 339*n*, a rear top hook 337*n*, a rear bottom tab 336*n*, a top interface surface 375*n* and a bottom interface surface 380*n*. The standard 320*n* may include a rear hook 328*n* and a top interface surface 385*n*. The beam 335*n* may be secured to the standard 320*n* with the rear hook 328*n* receiving the bottom rear tab 336*n* and the bottom front tab 339*n* between a tab 341*n* of a clamp 340*n* and the top interface surface 385*n* via a bolt 360*n* having a bolt head 361*n*. The chair bracket 330*n* may be secured to the beam 335*n* with the rear tab 331*n* received within the top rear hook 337*n* and the top front tab 338*n* between a tab 346*n* of a clamp 345*n* and the top interface surface 375*n* via a bolt 355*n* having a bolt head 356*n*.

Turning to FIG. 3P, a right-hand profile view of a beam mounted chair assembly 300*p* is depicted including a reinforcement beam 365*p*. A reinforcement beam 365*p* may be integrated within a beam 335*p* to form a composite beam structure. A reinforcement beam 365*p* may extend parallel to a main beam 335*p* to strengthen an associated beam mounted chair assembly 300*p*. An added pocket 321*p* may be provided within an associated standard 320*p* and/or mounting feet to hold a reinforcement beam 365*p*. Aside from the reinforcement beam 365*p* and the added pocket 321*p*, the beam mounted chair assembly 300*p* may be similar to any of the beam mounted chair assemblies 300*a*-300*h* and 300*j*-300*n*. A reinforcement beam 365*p* may be added to stabilize the standards 320*p*. A reinforcement beam 365*p* and/or a support beam may be an I-beam as depicted in FIG. 3P. Alternatively, a reinforcement beam 365*p* and/or a support beam by be any shape. A beam 335*p* may be clamped to a support beam 365*p* to handle torsion loads. Corners of associated parts of a beam mounted chair assembly 300*p* may be sharp. Alternatively, corners of associated parts of a beam mounted chair assembly 300*p* may have radii added for manufacturing, stress reduction, safety, etc. A beam mounted chair assembly 300*p* may include chairs brackets 330*p* that are held in place prior to tightening fasteners of associated clamps by using beam and/or chair features (e.g., hooks and tabs as described with regard to FIGS. 3A-3H and 3J-3N) that may cooperate with a moment provided by an associated chair's center of mass. Additional member(s) may be added between the standard and the beam to strength the system while minimizing cost. These members will cooperate with the standard and the beam to enhance the system performance. Said cooperation may be enhanced by features such as pockets or protrusions in any or all adjacent members which engage adjacent members. Adjacent members may be fastened to enhance system performance. Fastening may take the form clamps, welds, bolts, adhesives or other means of linking adjacent members to enhance system performance. Fastening does not require properties to be isotropic and one skilled in the art can envision antistrophic methods which will enhance performance while lowering system cost.

With reference to FIG. 3Q, a bottom, right, perspective view of an example beam mounted chair assembly 300*q* is depicted. A single standard 320*q* with an integral beam 335*q* having a single mounting foot 325*q* may be used to support chair brackets 330*q*. Alternatively, a profile of a beam 335*q* may be attached to or be made part of a standard 320*q* face thus eliminating the "apparent beam." A single standard assembly such as depicted in FIG. 3Q may be referred to as a pedestal base chair assembly and or pseudo-beam mounted where the beam is part of an adjacent structure.

Figure 3R:
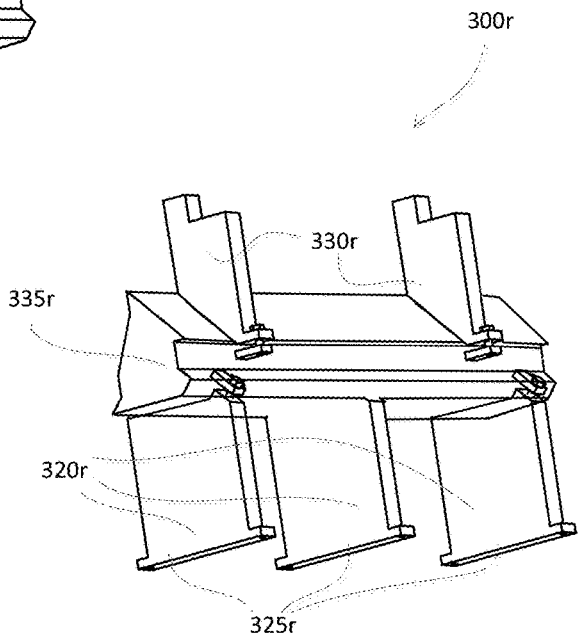

Turning to FIG. 3R, a bottom, front, perspective view of an example beam mounted chair assembly 300*r* is depicted. Similar to the assembly 300*q*, the assembly 300*r* may include a standard 320*r* integral with a beam 335*r*. The assembly 300*r* may further include additional standards 320*r*. Each standard 320*r* may include an associated mounting foot 325*r*. The assembly 300*r* may also include chair brackets 330*r*.

Figure 3S:
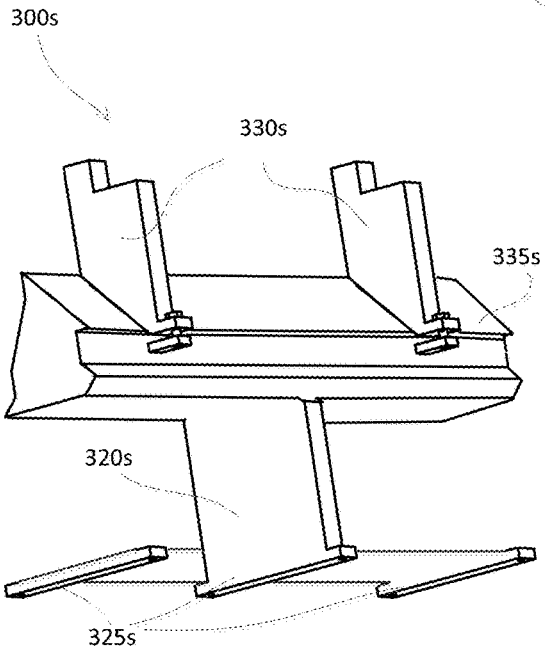

With reference to FIG. 3S, a bottom, front, perspective view of an example beam mounted chair assembly 300*s* is depicted. Similar to the assembly 300*q*, the assembly 300*s* may include a standard 320*s* integral with a beam 335*s*. The standard 320*s* may include a plurality of mounting feet 325*s*. The assembly 300*s* may also include chair brackets 325*s*.

Figure 3T:
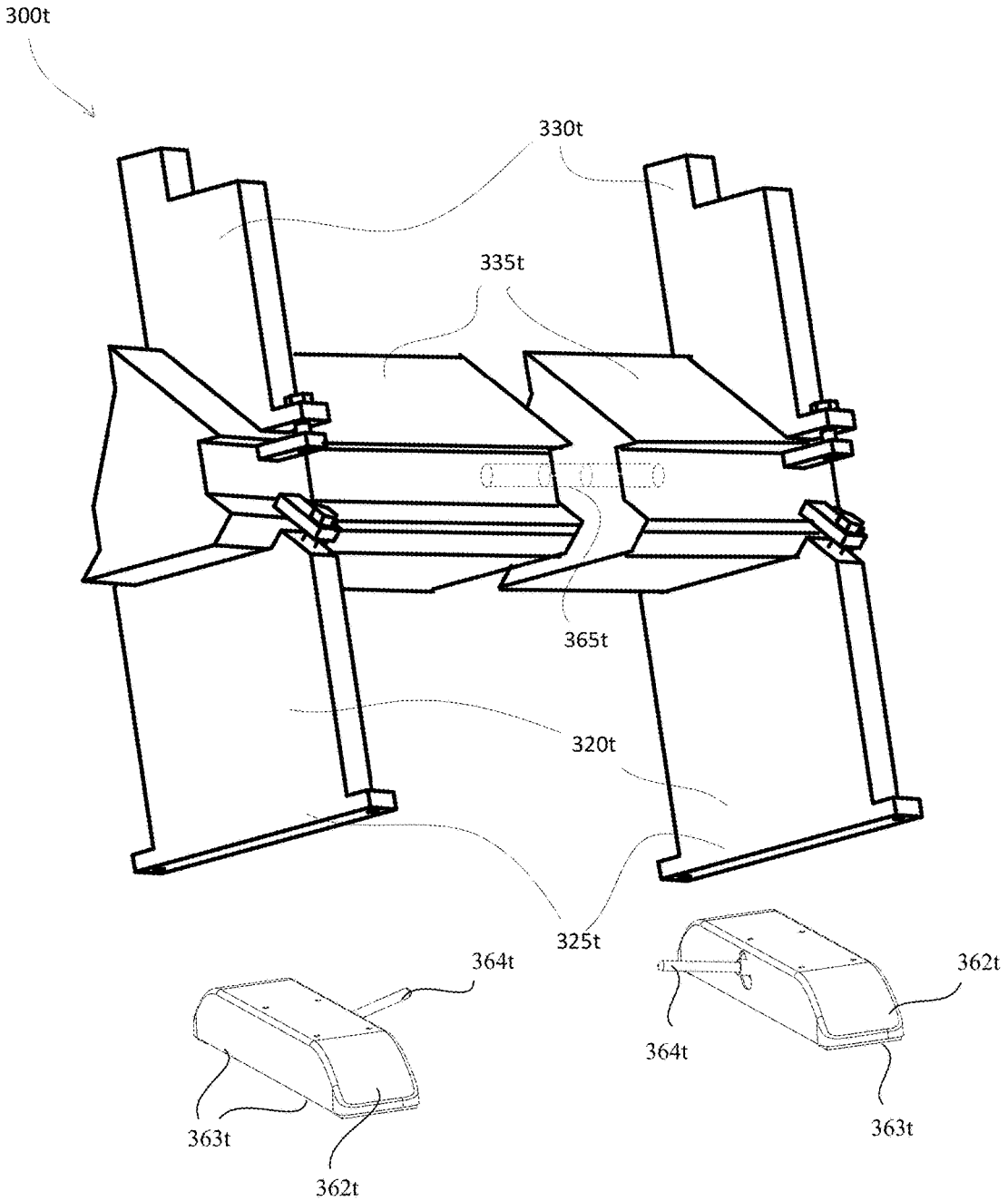
Figure 9A:
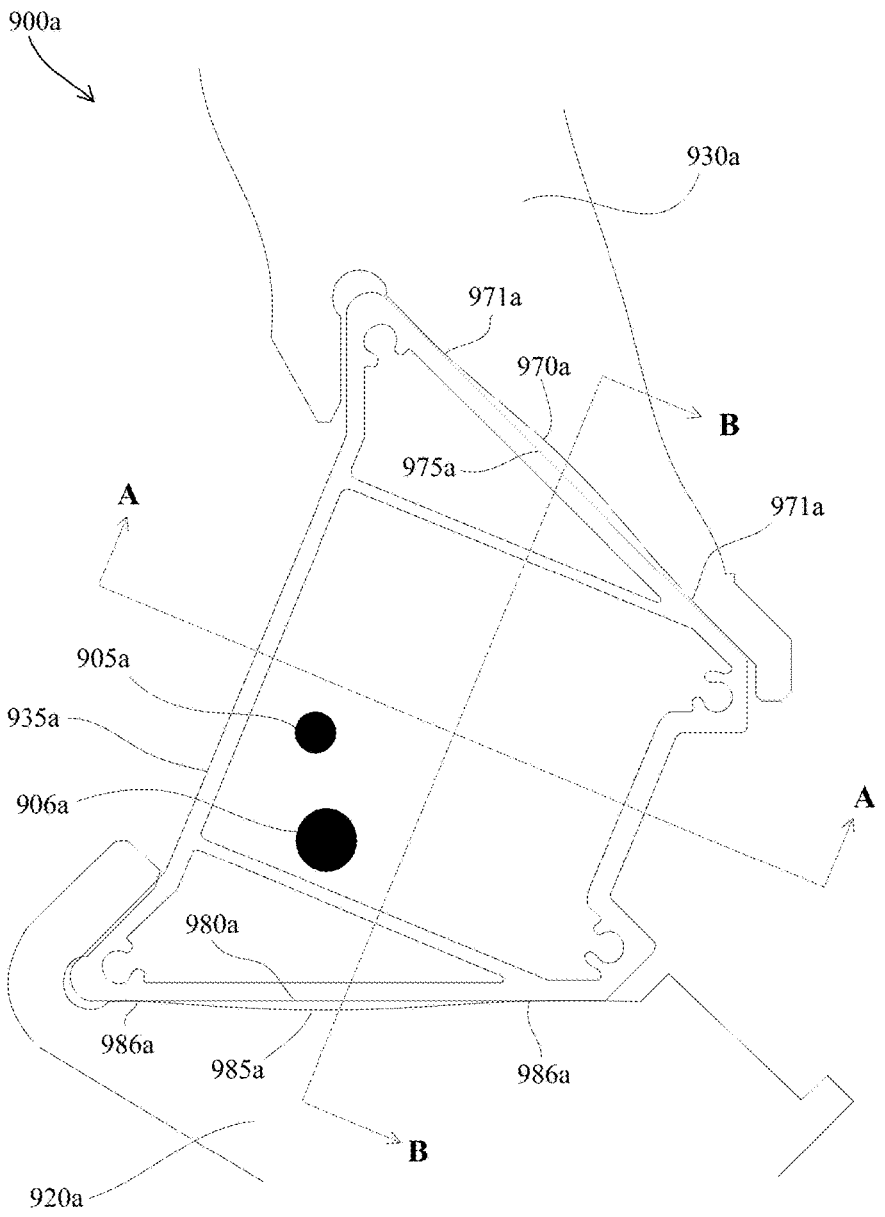
FIGS. 9A-G depict various views of an example chair seat assembly incorporating electrical power and/or data wiring and associated components.
Figure 9C:
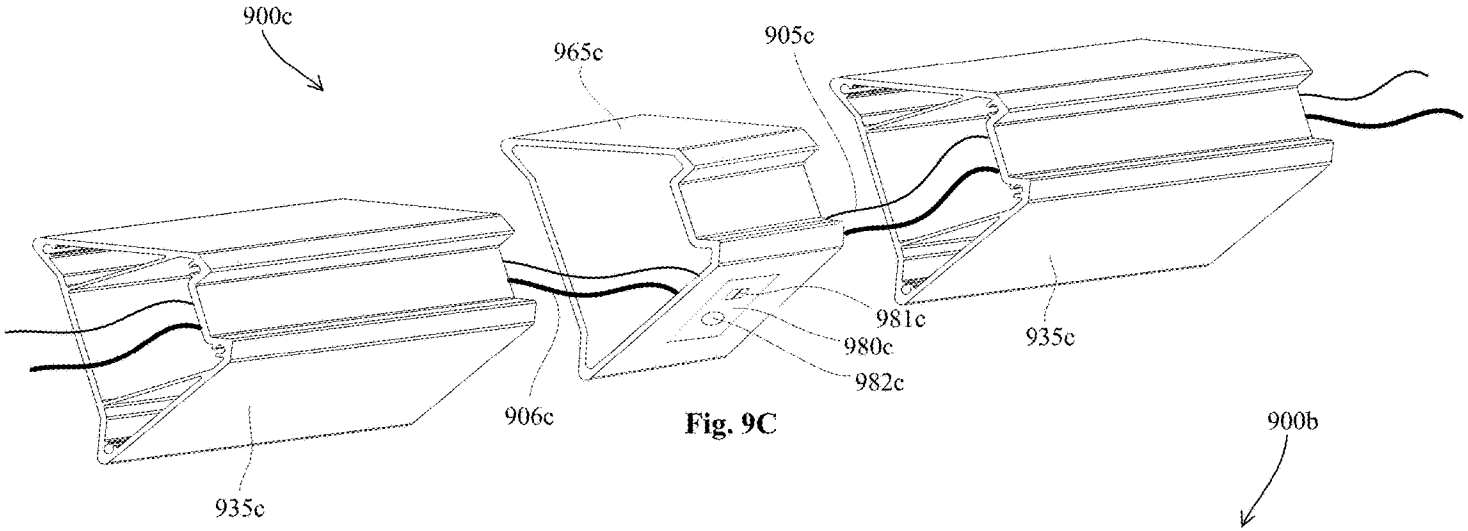
Figure 9B:
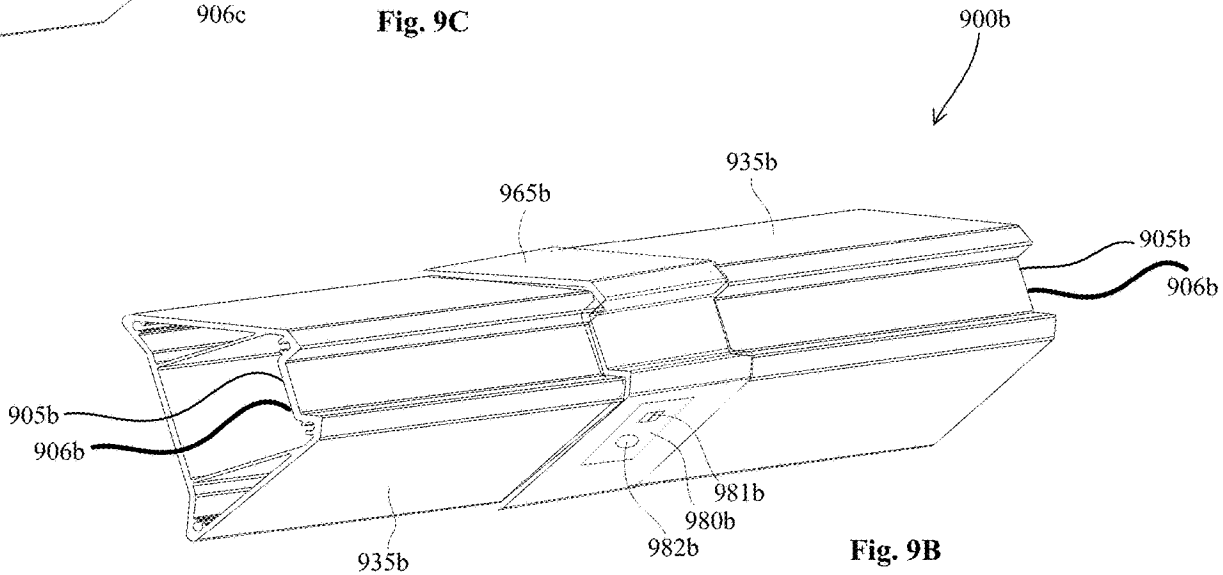
Figure 9D:
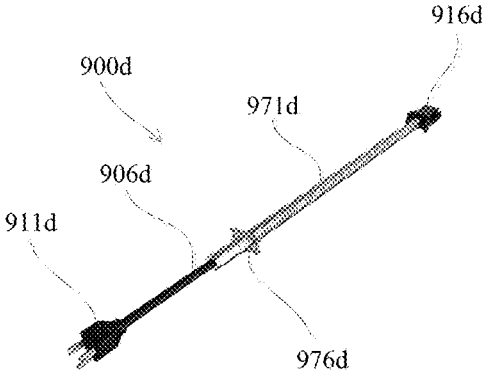
Figure 9E:
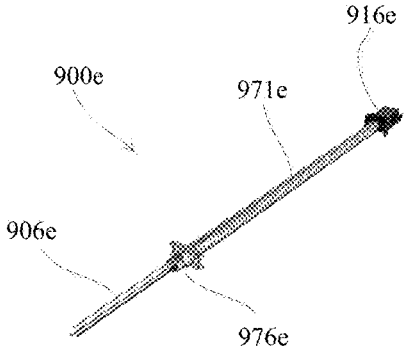
Figure 9F:
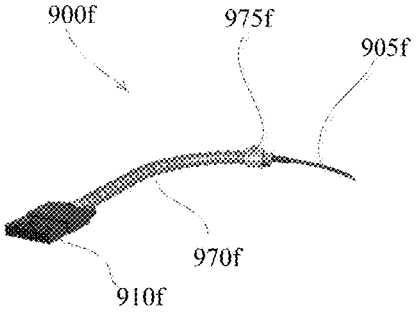
Figure 9G:
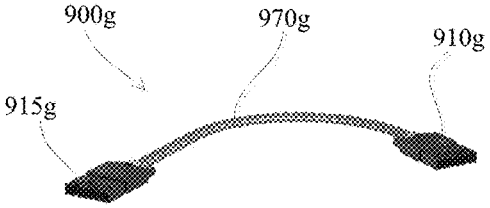

Turning to FIG. 3T, a bottom, front, perspective view of an example beam mounted chair assembly 300*t* is depicted. The assembly 300*t* may include a plurality of beams 335*t* joined together via a beam coupler 365*t*. The assembly 300*t* may further include standards 320*t* having a respective mounting foot 325*t* and chair brackets 330*t*. A beam coupler 365*t* may be used to join separate beams 335*t* into one continuous length. A beam coupler 365*t* may be a piece (e.g., a pipe, an I-beam, a box beam, a plate, etc.) that fits inside of each beam. Two separate beams 335*t* may be joined together using a standard 320*t* and/or a chair bracket 330*t* (i.e., a standard 320*t* and/or a chair bracket 330*t* may overlap a joint between two separate beams 335*t*.). Alternatively, or additionally, a beam coupler may be as illustrated in FIGS. 9B and 9C and described below with reference to beam coupler 965*b, c*.

As further illustrated in FIG. 3T, a beam mounted chair assembly 300*t* may include chair roller assemblies 362*t* in lieu of fixed mounting feet. The chair roller assemblies 362*t* may include, for example, retractable wheels 363*t* operable between an extended orientation and a retracted orientation via lowering/raising mechanism 364*t*. The chair roller assemblies 362*t* may be configured to, for example, enable a venue operator to reposition an associated beam mounted chair assembly 300*t*. The lowering/raising mechanism 364*t* may be lockable 365*t* in a respective extended orientation and a retracted orientation once oriented into the given orientation. Further details of the chair roller assemblies 362*t* are described and illustrated herein with reference to FIGS. 10A and 10B.

Figure 3U:
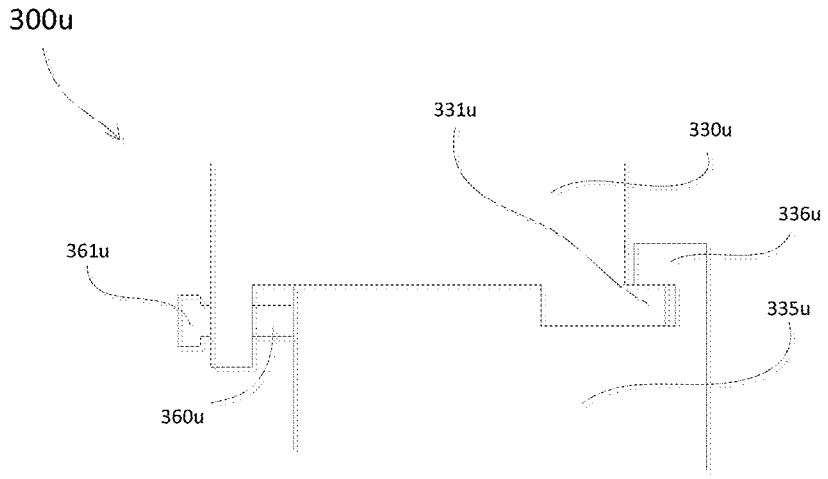

With reference to FIG. 3U, a profile view of a beam mounted chair assembly 300*u* is depicted including a chair bracket 330*u* secured to a beam 335*u* having a hook shaped piece 331*u* of the chair bracket received within a beam receptacle 336*u* and fixed in place via a bolt 360*u* having a head 361*u*.

Figure 3V:
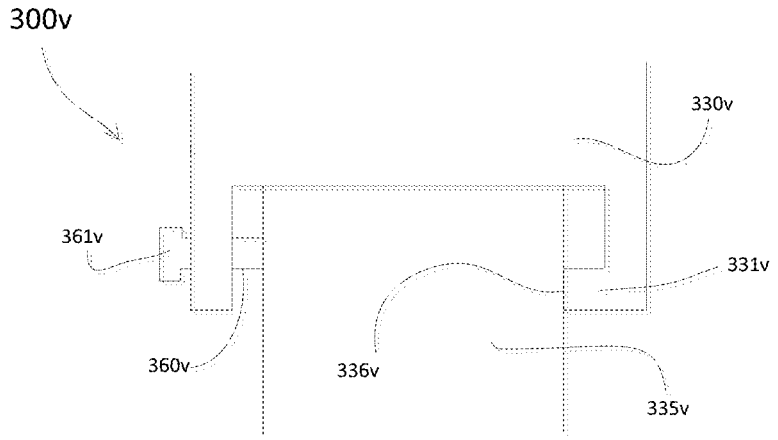

Turning to FIG. 3V, a profile view of a beam mounted chair assembly 300*v* is depicted including a chair bracket 330*v* secured to a beam 335*v* having a hook shaped piece 331*v* of the chair bracket on one side 336*v* of the beam 335*v* and fixed in place via a bolt 360*v* having a head 361*v* on another side of the beam 335*v*. The hook shaped piece 331*v* may include a pointed protrusion to secure to the beam surface 336*v* or may include a roughened surface, or the like, to increase friction between the hook shaped piece 331*v* and the beam side 336*v*.

Figure 3W:
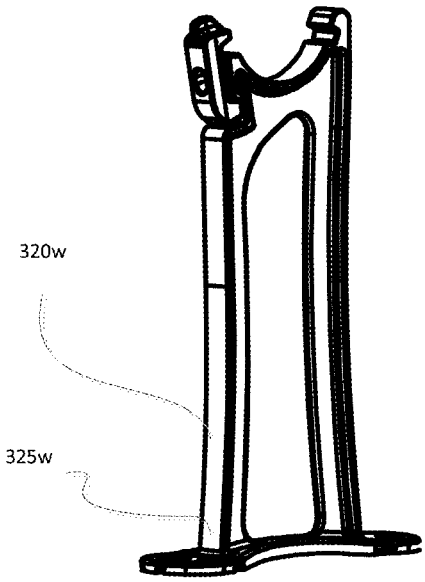

With reference to FIG. 3W, a standard 320*w* is depicted having a mounting foot 325*w*. As shown in FIG. 3W, the standard 320*w* may have a "web" configuration. The web configuration minimizes material while maximizing strength.

Figure 3X:
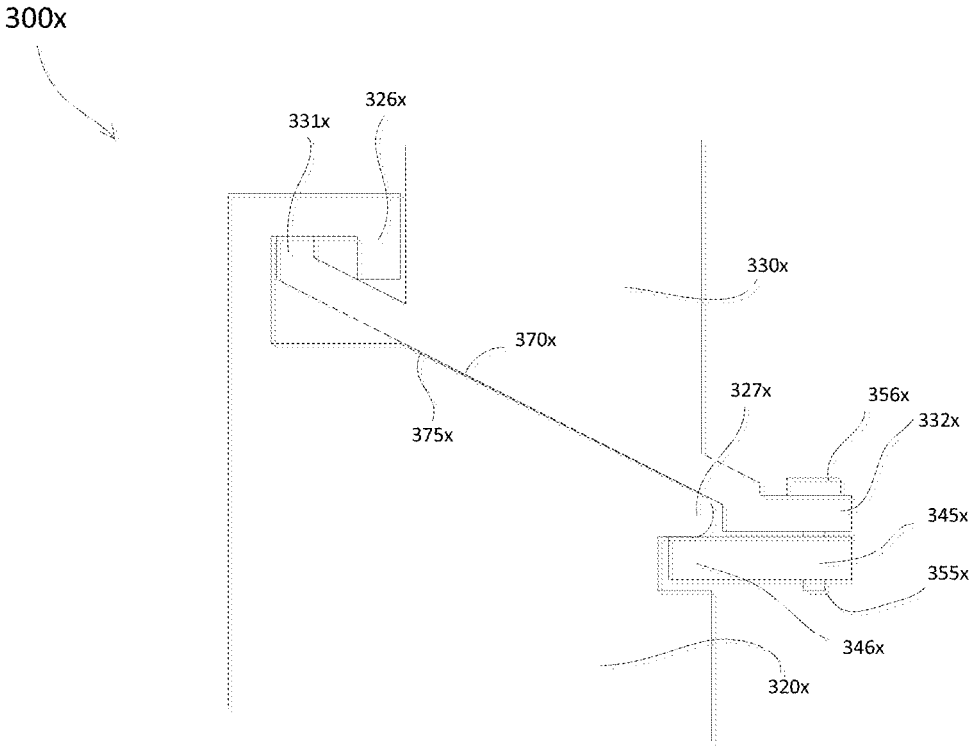

Turning to FIG. 3X, a right-side profile view of a beam mounted chair assembly 300*x* is depicted including a chair bracket 330*x* supported on a beam 335*x*. The beam mounted chair assembly 300*x* may be incorporated within any of the installations 100*a*-100*d* of FIGS. 1A-1D. The beam 335*x* may be supported on a standard (not shown in FIG. 3X). The chair bracket 330*x* may include a front tab 332*x*, a rear tab 331*x* and a bottom interface surface 370*x*. The beam 335*x* may include a rear top hook 336*x*, a front top tab 337*x* and a top interface surface 375*x*. The chair bracket 330*x* may be secured to the beam 335*x* with the rear tab 331*x* received within the top rear hook 336*x* and the top front tab 337*x* between a tab 346*x* of a clamp 345*x* and the top interface surface 375*x* via a bolt 360*x* having a bolt head 361*x*. A difference in angle between the rear tab 331*x* and the interfacing surface 375*x* may induce a stable interface between the chair bracket 330*x* and the beam 335*x* when the associated clamps 345*x* is tightened due to the face that the rear tab 331*x* is cantilevered with respect to the rear top hook 336*x*.

Turning to FIGS. 3Y1-3Z2, a left-side profile view of a beam mounted chair assembly 300*y*1-300*z*2 is depicted including a chair bracket 330*y*1-330*z*2 supported on a beam 335*y*1-335*z*2. The beam mounted chair assembly 300*y*1-300*z*2 may be similar to the beam mounted chair assembly 300*d*. The beam 335*y*1-335*z*2 may be supported on a standard 320*y*1-320*z*2. The chair bracket 330*y*1-330*z*2 may include a front tab, a rear hook and a bottom interface surface similar to, for example, any one of the chair brackets 330*a*-330*h*, 330*j*-330*n* or 330*p*-330*x*. The beam 335*y*1-335*z*2 may include a front top tab, a front bottom tab, a rear top tab, a rear bottom tab, a top interface surface and a bottom interface surface similar to, for example, any one of the beams 335*a*-335*h*, 335*j*-335*n* or 335*p*-335*x*. The standard 320*y*1-320*z*2 may include a mounting foot 325*y*1-325*z*2 having a front foot and a rear foot, a rear hook and a top interface surface similar to, for example, any one of the standards 320*a*-320*h*, 320*j*-320*n* or 320*p*-320*x*. The beam 335*y*1-335*z*2 may be secured to the standard 320*y*1-320*z*2 similar to, for example, any one of the chair assemblies 300*a*-300*h*, 300*j*-300*n* or 300*p*-300*x* via a bolt 360*y*1-360*z*2 having a bolt head 361*y*1-361*z*2. The chair bracket 330*y*1-330*z*2 may be secured to the beam 335*y*1-335*z*2 similar to, for example, any one of the chair assemblies 300*a*-300*h*, 300*j*-300*n* or 300*p*-300*x* via a bolt 355*y*1-355*z*2 having a bolt head 356*y*1-35*z*2. While the interfacing surfaces are illustrated within FIGS. 3Y1-3Z2 as being substantially flat, any one of the interfacing surfaces may be non-flat as depicted in FIGS. 3G, 3J and 3K. As depicted in FIGS. 3Y1-3Z2, any one of the assemblies 300*y*1-300*z*2 may include additional features, such as for example, tab portions 341*y*2, 341*y*3, 342*y*3, 346*y*3, 341*y*4, 342*y*4, 346*y*4, 347*y*4, 342*z*2, 347*z*2 configured to encourage the respective standard to fully engage the respective beam when the respective bolts are tightened or encourage the respective chair bracket to fully engage the respective beam when the respective bolts are tightened.

Figure 4A:
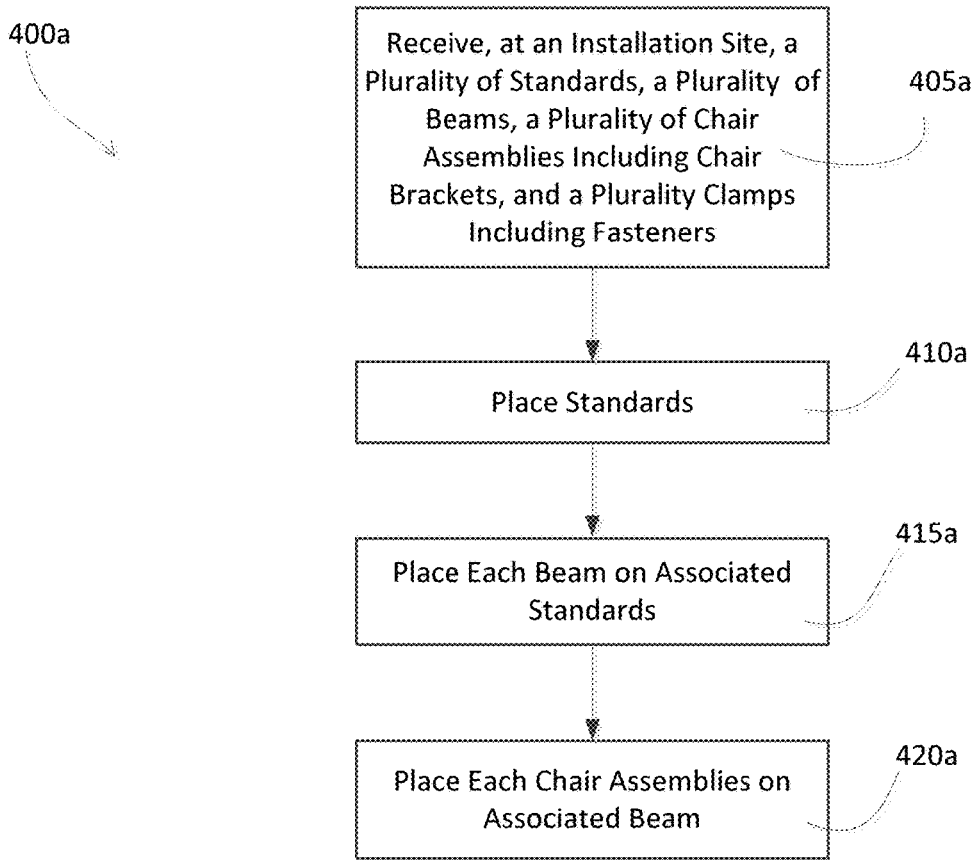
FIGS. 4A and 4B depict flow diagrams for example beam mounted chair assembly installation methods.

Turning to FIG. 4A, a flow diagram is depicted of an example beam mounted chair assembly installation method 400*a*. The method 400*a* may include receiving, at an installation site, a plurality of standards, a plurality of beams, a plurality of chair assemblies with chair brackets and a plurality of clamps with fasteners (block 405*a*). A plurality of reinforcement beams may also be received (block 405*a*). The method 400*a* may also include placing a plurality of standards (block 410*a*). The method 400*a* may also include placing reinforcement beams (block 410*a*). The method 400*a* may further include placing a plurality of beams on associated standards (block 415*a*). The method 400*a* may yet further include placing a plurality of chair assemblies on associated beams (block 420*a*). A beam mounted chair assembly may include chairs brackets that are held in place prior to tightening fasteners of associated clamps by using beam and/or chair features (e.g., hooks and tabs as described with regard to FIGS. 3A-3H and 3J-3N) that may cooperate with a moment provided by an associated chair's center of mass. It should be understood that the order of the steps of the method 400*a* may be altered. For example, beams may be shipped to the installation site with standards previously installed. In moveable base systems, it may be optimal for the chairs to remain attached to the beam and the beam/chair assembly attached to standards which may or may not be attached to floor link plates as disclosed, for example, in commonly assigned U.S. Patent Application Ser. No. 62/006,363, entitled Reconfigurable Seating Systems, Seat Assemblies for use within the Reconfigurable Seating Systems, Components for use within the Seat Assemblies and Parts for use within the Components, filed Jun. 2, 2014, the disclosure of which is incorporated herein in its entirety by reference.

Figure 4B:
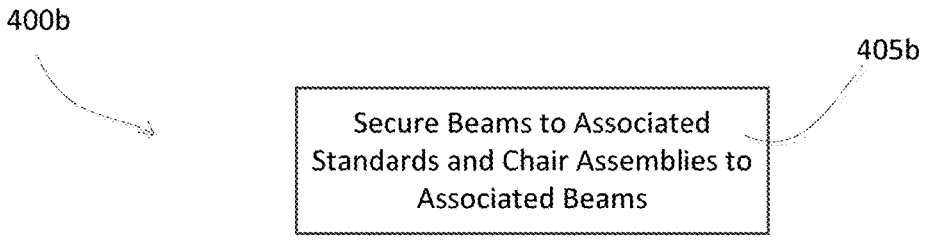

With reference to FIG. 4B, a flow diagram for an example method of securing a plurality of beams to a plurality of standards and securing a plurality of chair assemblies to a beam 400*b* is depicted. The method 400*b* may include tightening a plurality of fasteners of associated clamps.

Figure 5A:
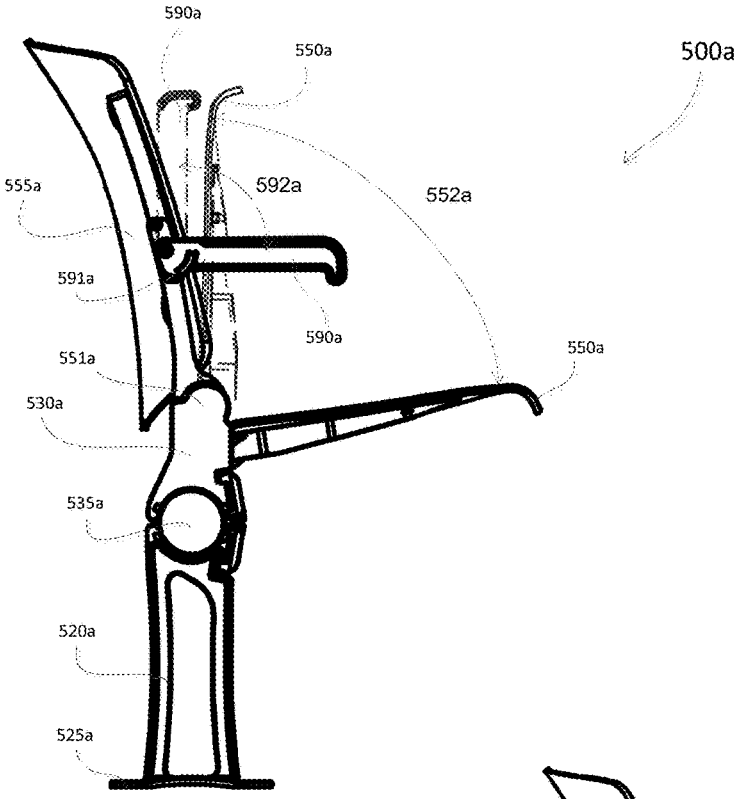
FIGS. 5A-5H depict various views of example beam mounted chair assemblies having unupholstered chair seats and chair backs.
Figure 5B:
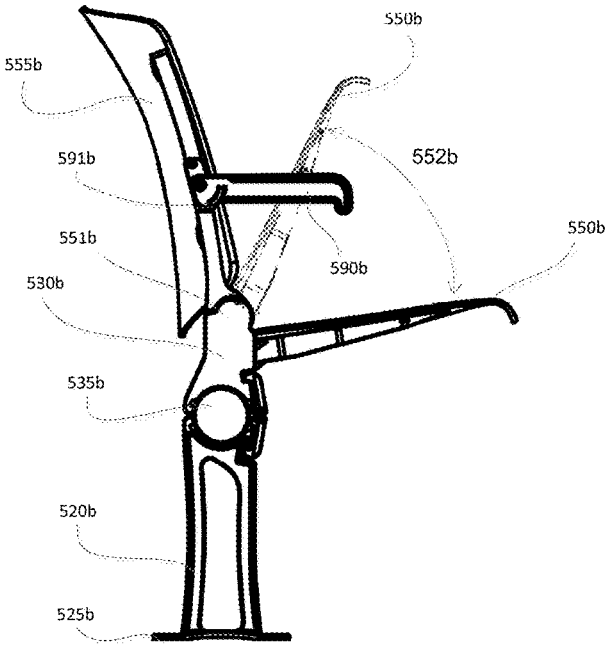
Figure 5C:
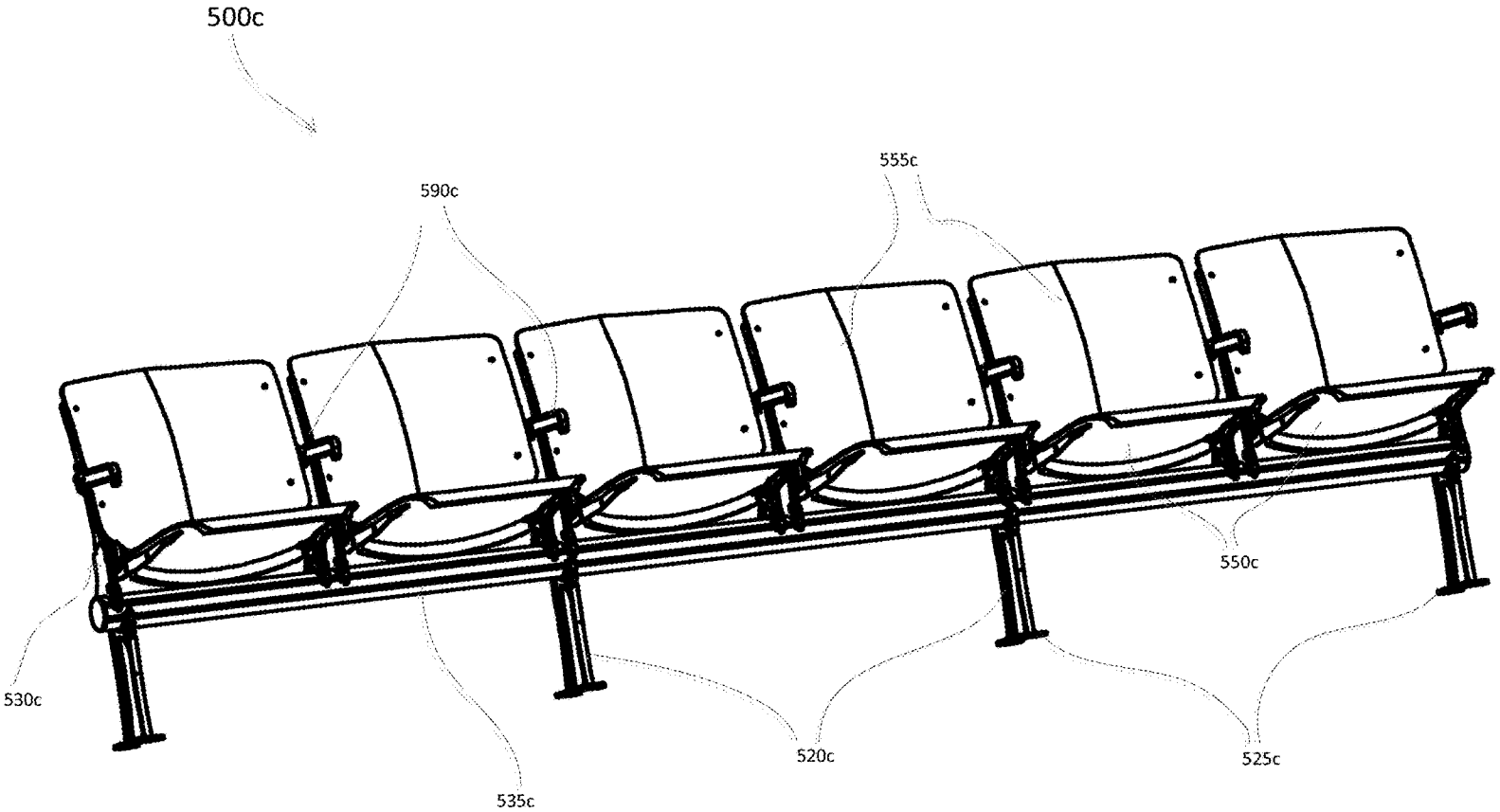
Figure 5D:
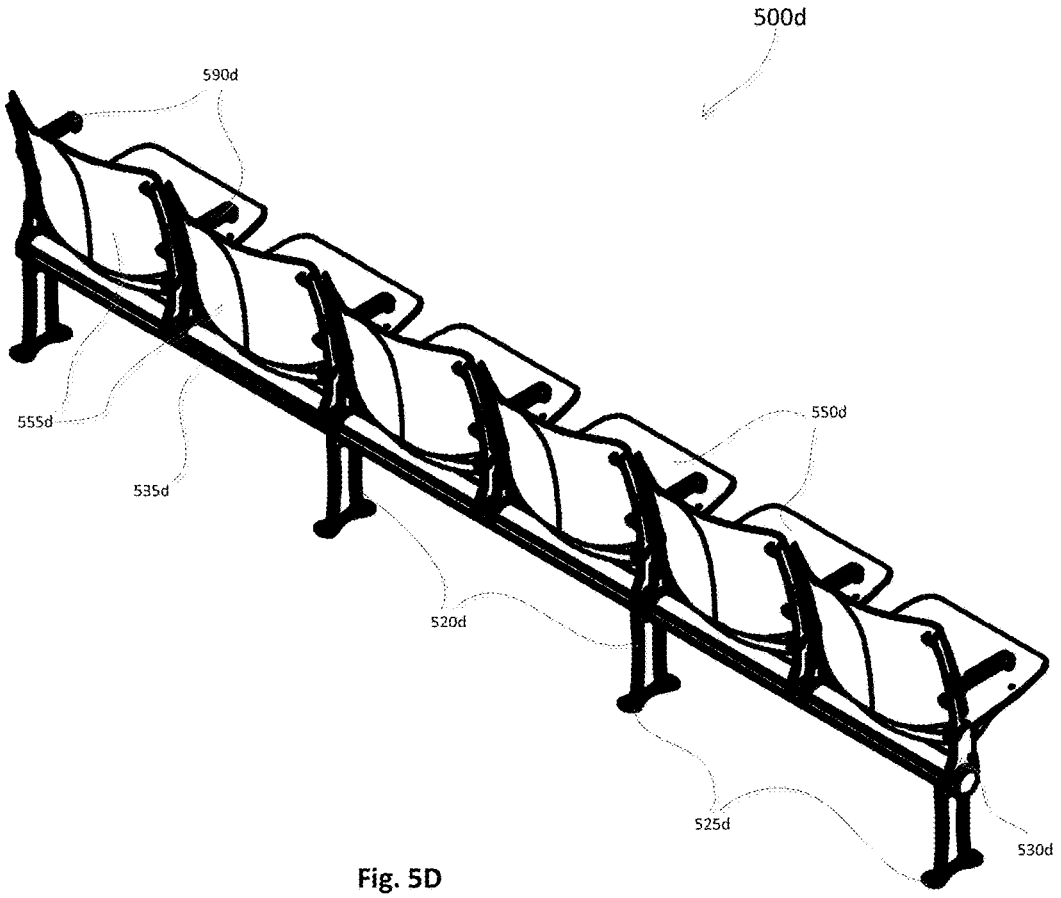
Figure 5E:
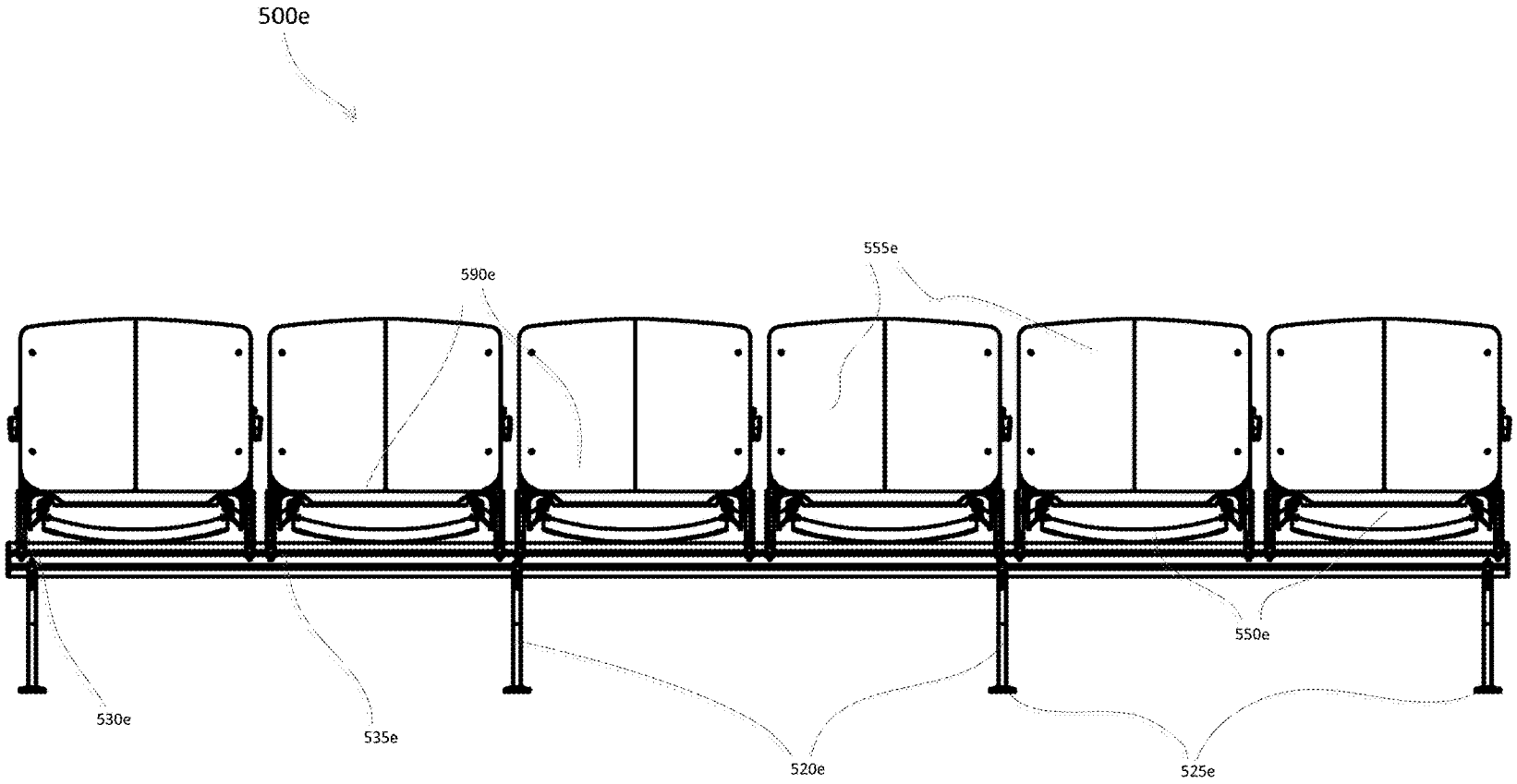
Figure 5F:
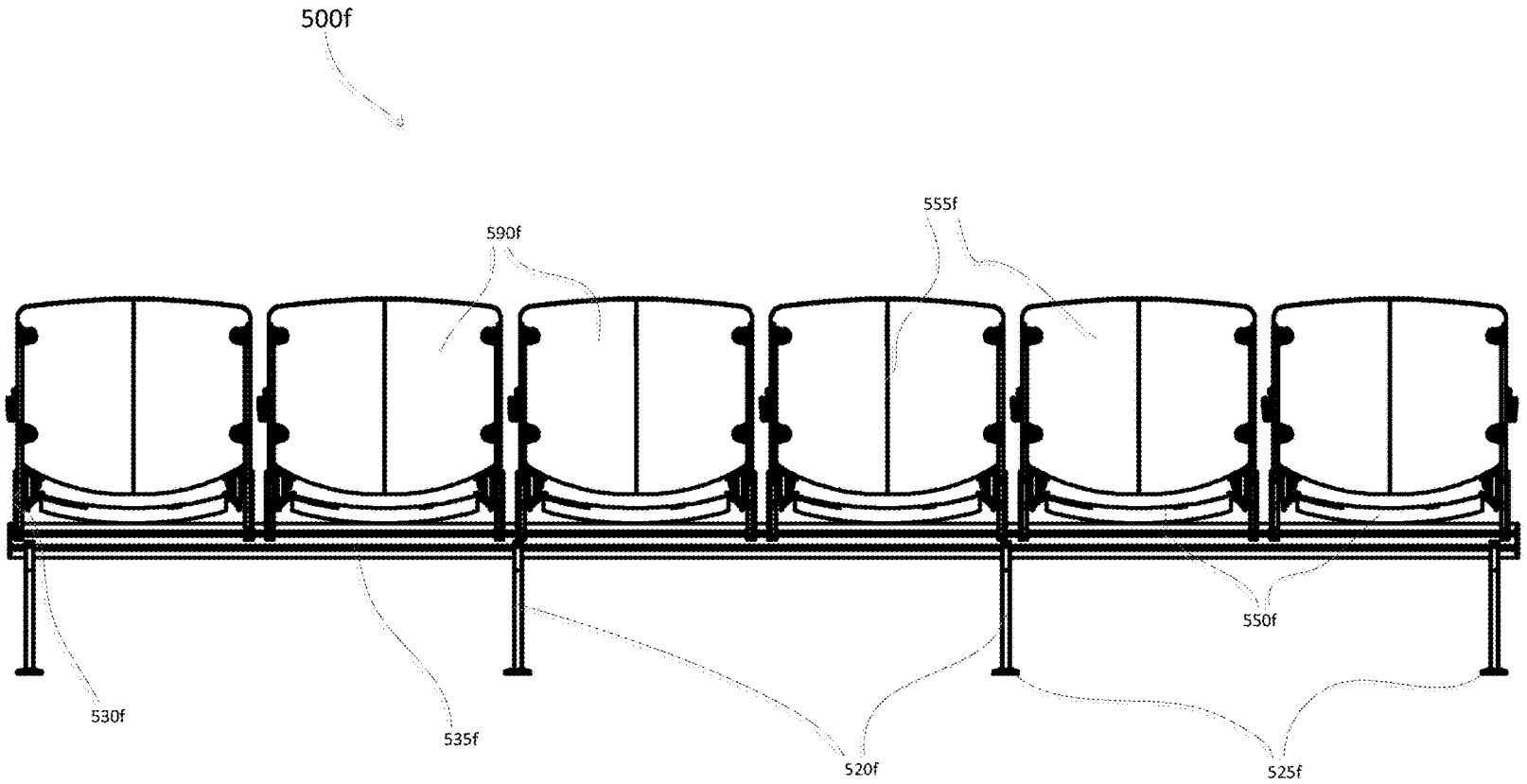
Figure 5G:
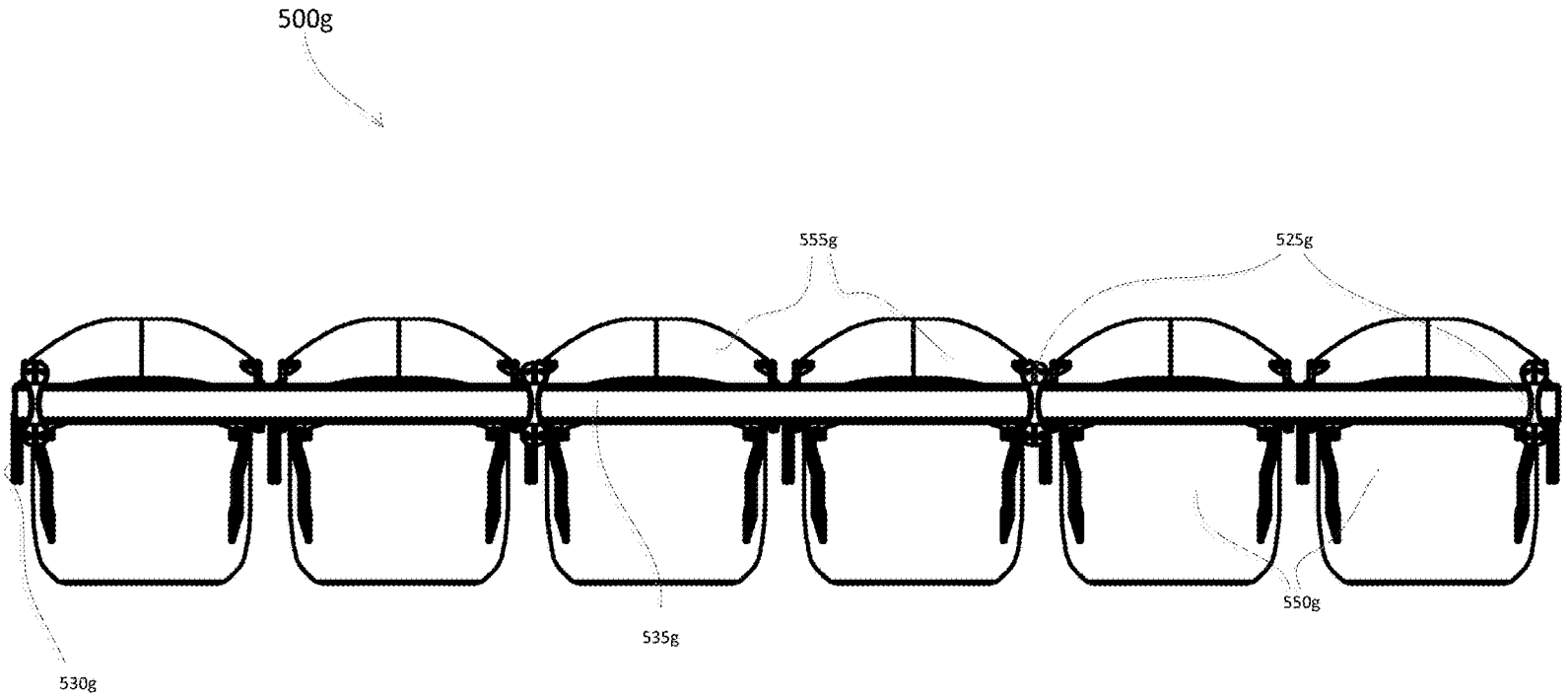
Figure 5H:
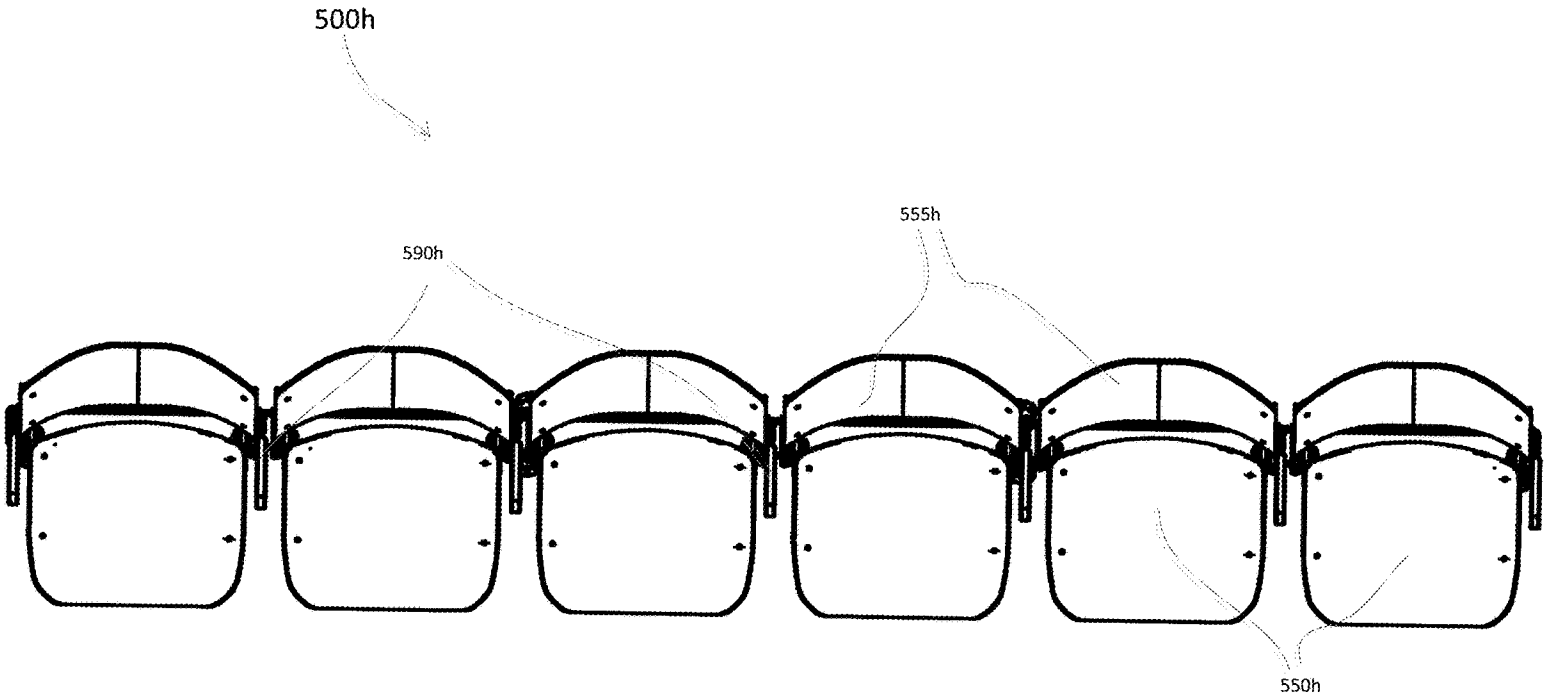

Turning to FIGS. 5A-5G, various views of example beam mounted chair assemblies 500*a*-500*g* having unupholstered chair seats 550*a*-550*g* and chair backs 555*a*-555*g* are depicted. A beam mounted chair assembly 500*a*-500*g* may include at least two standards 520*a*-520*g* having mounting feet 525*a*-525*g*, at least one beam 535*a*-535*g*, chair brackets 530*a*-530*g* and armrests 590*a*-590*g*. FIG. 5A depicts a left-side profile view of a beam mounted chair assembly 500*a* with a chair seat 550*a* and an armrest 590*a* pivotally attached to a chair bracket 530*a*. As can be seen in FIGS. 5A and 5B, the chair seat 550*a*, 550*b* may be configured to automatically pivot between an in use position (chair seat 550*a*, 550*b* shown in solid lines in FIGS. 5A and 5B, respectively) and a three-quarter up position (chair seat 550*b* shown in dashed lines in FIG. 5B) and manually push to full fold (chair seat 550*a* shown in dashed lines in FIG. 5A). Such an arrangement has the desirable advantage that when spectators leave, the seats are automatically returned to the standby position and thus do not reduce the width of the aisle between adjacent rows of seats and along which the spectators move. Optionally, the chair seat 550*a*, 550*b* may be configured to automatically pivot to a user selectable position anywhere between the in use position and a full fold position. The full fold position further increases isle width and minimizes packaging size during shipping. An armrest 590*a*, 590*b* may be configured to be manually pivotable between an in use position (armrest 590*a*, 590*b* shown in solid lines in FIGS. 5A and 5B, respectively) and a standby position (armrest 590*b* shown in dashed lines in FIG. 5A). With the chair seat 550*a* and armrest 590*a* in a full fold position against a chair back 555*a*, associated shipping space in minimized while facilitating pre-assembly of the associated chair prior to shipping.

Figure 6A:
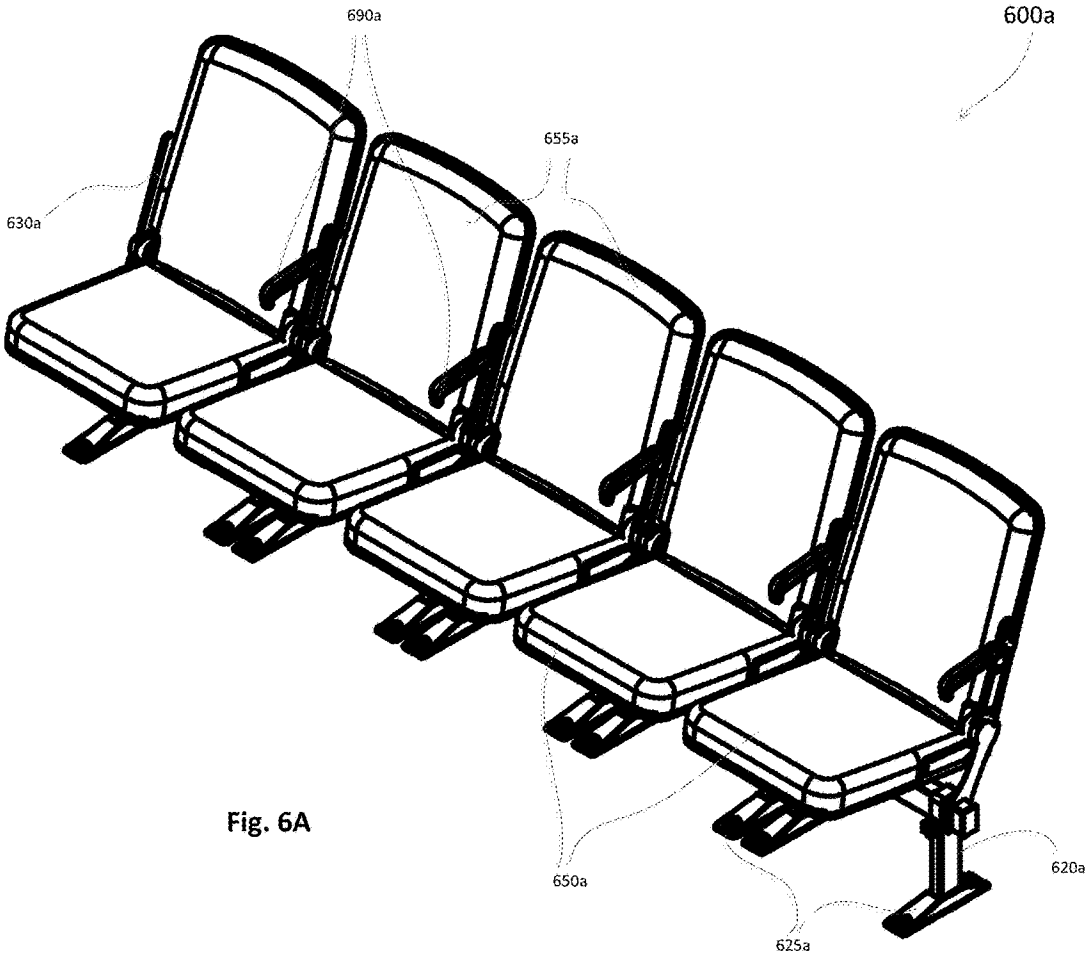
FIGS. 6A-6H and 6J-6L depict various views of example beam mounted chair assemblies having upholstered chair seats and chair backs
Figure 6B:
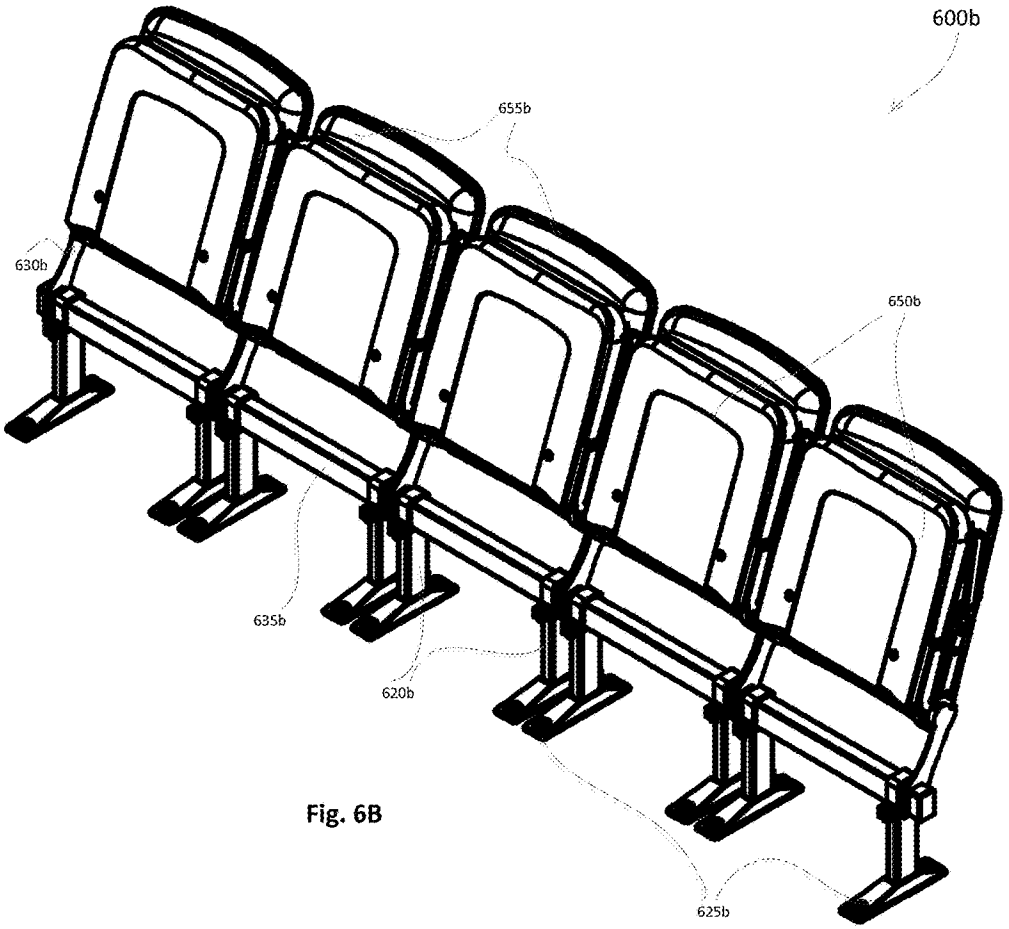
Figure 6C:
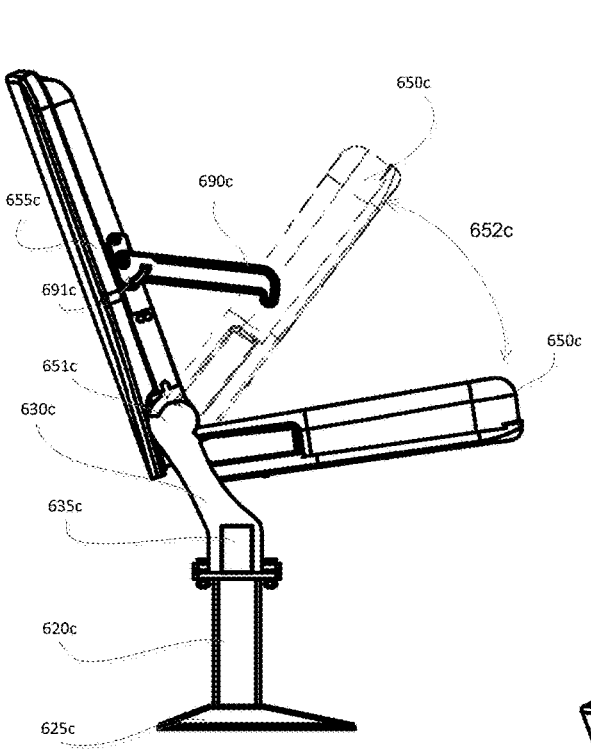
Figure 6D:
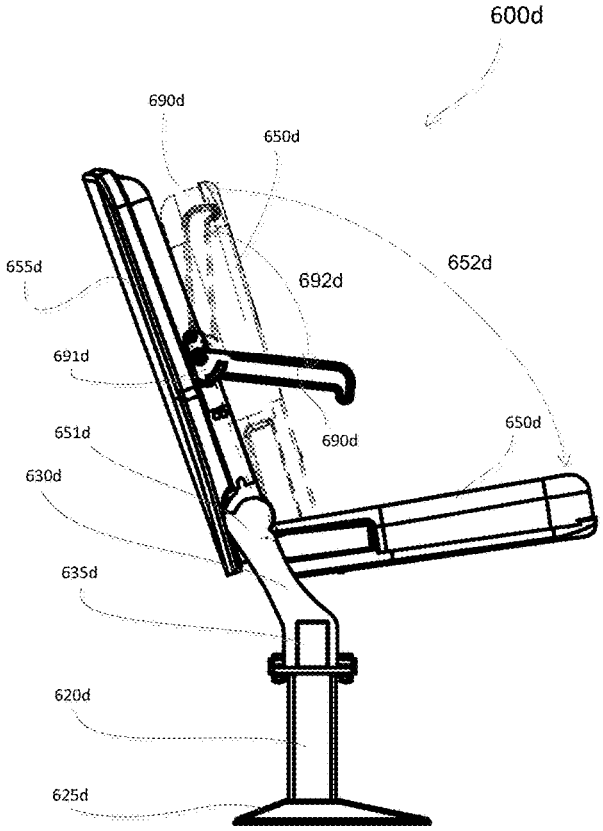
Figure 6E:
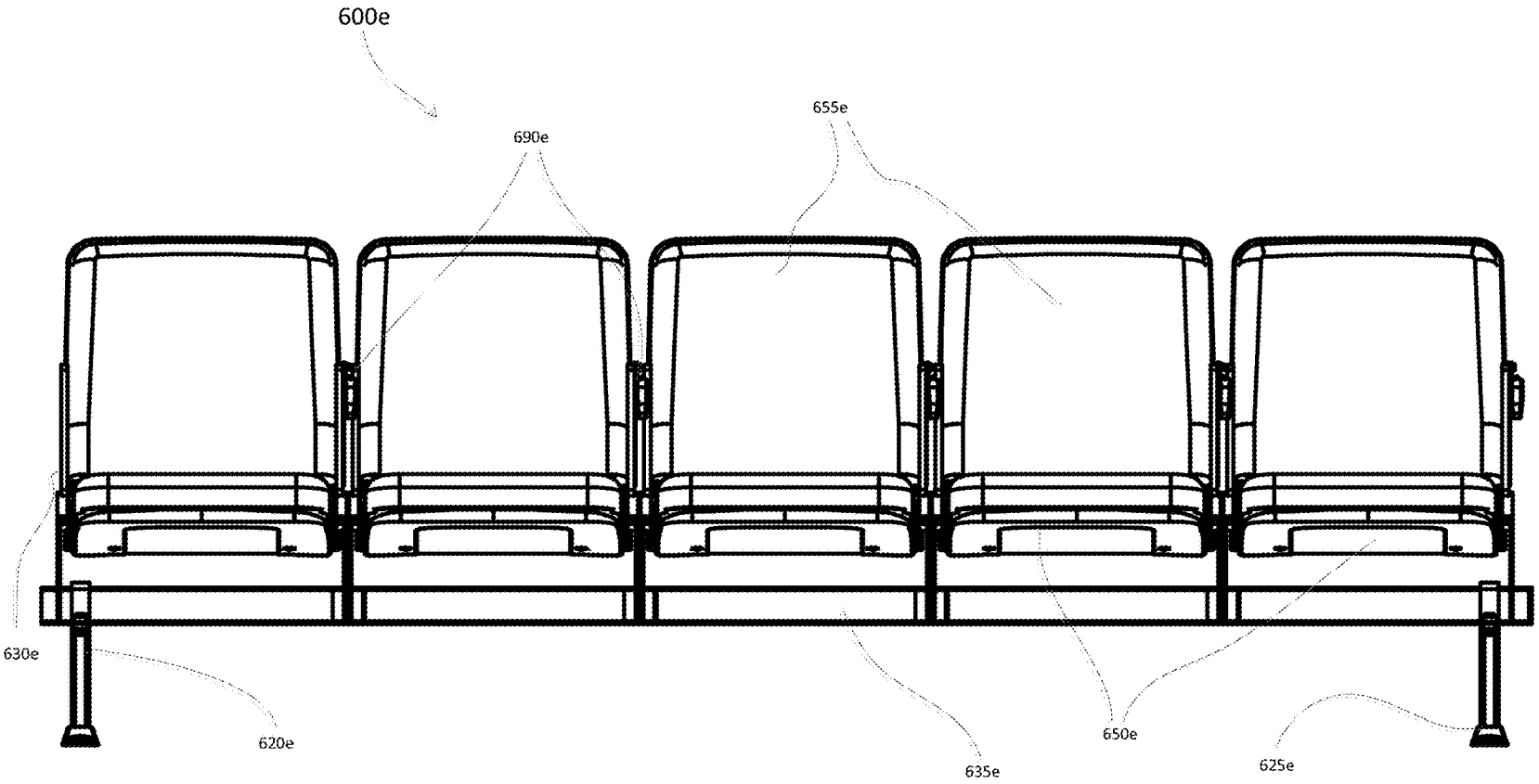
Figure 6F:
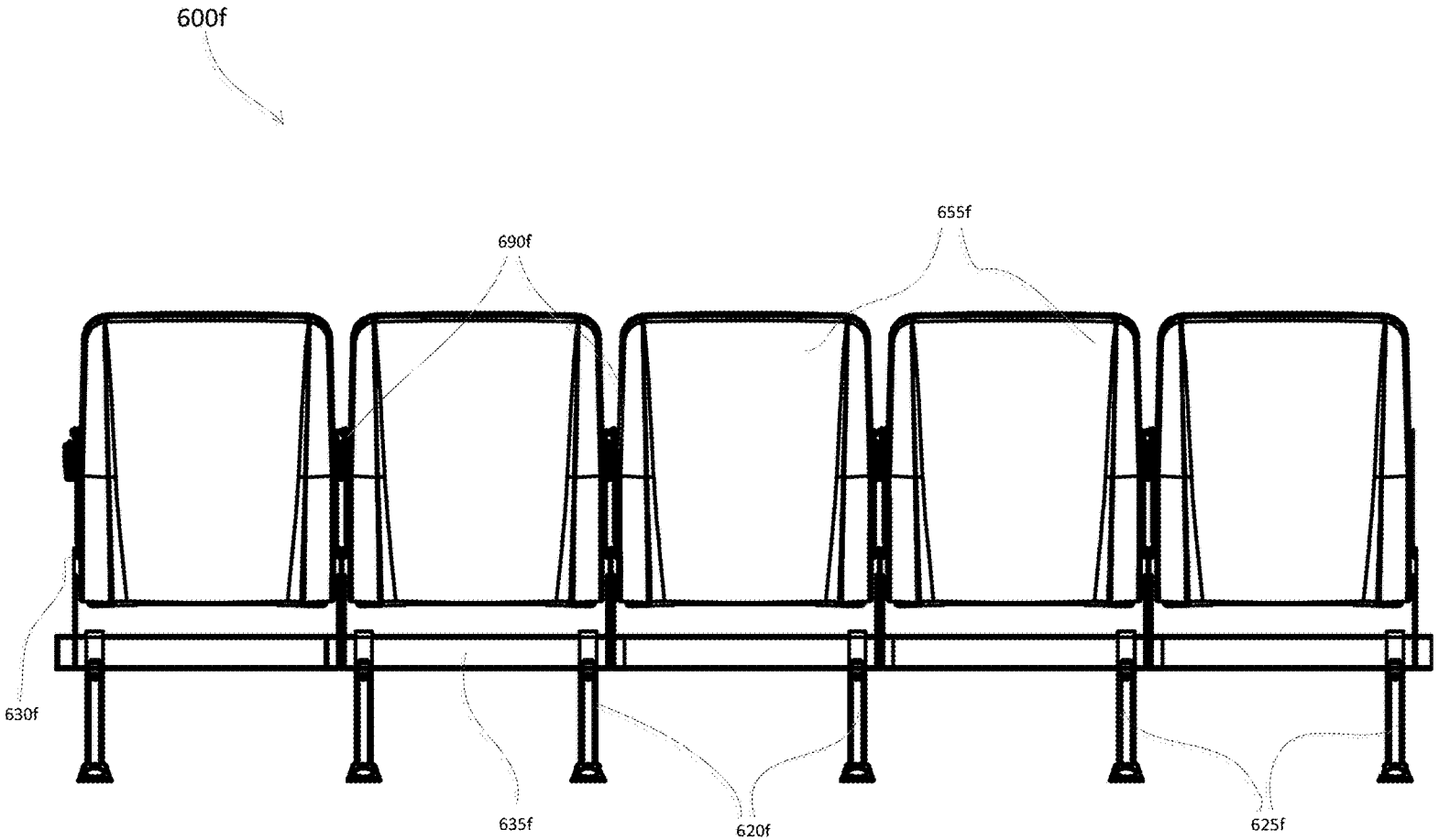
Figure 6G:
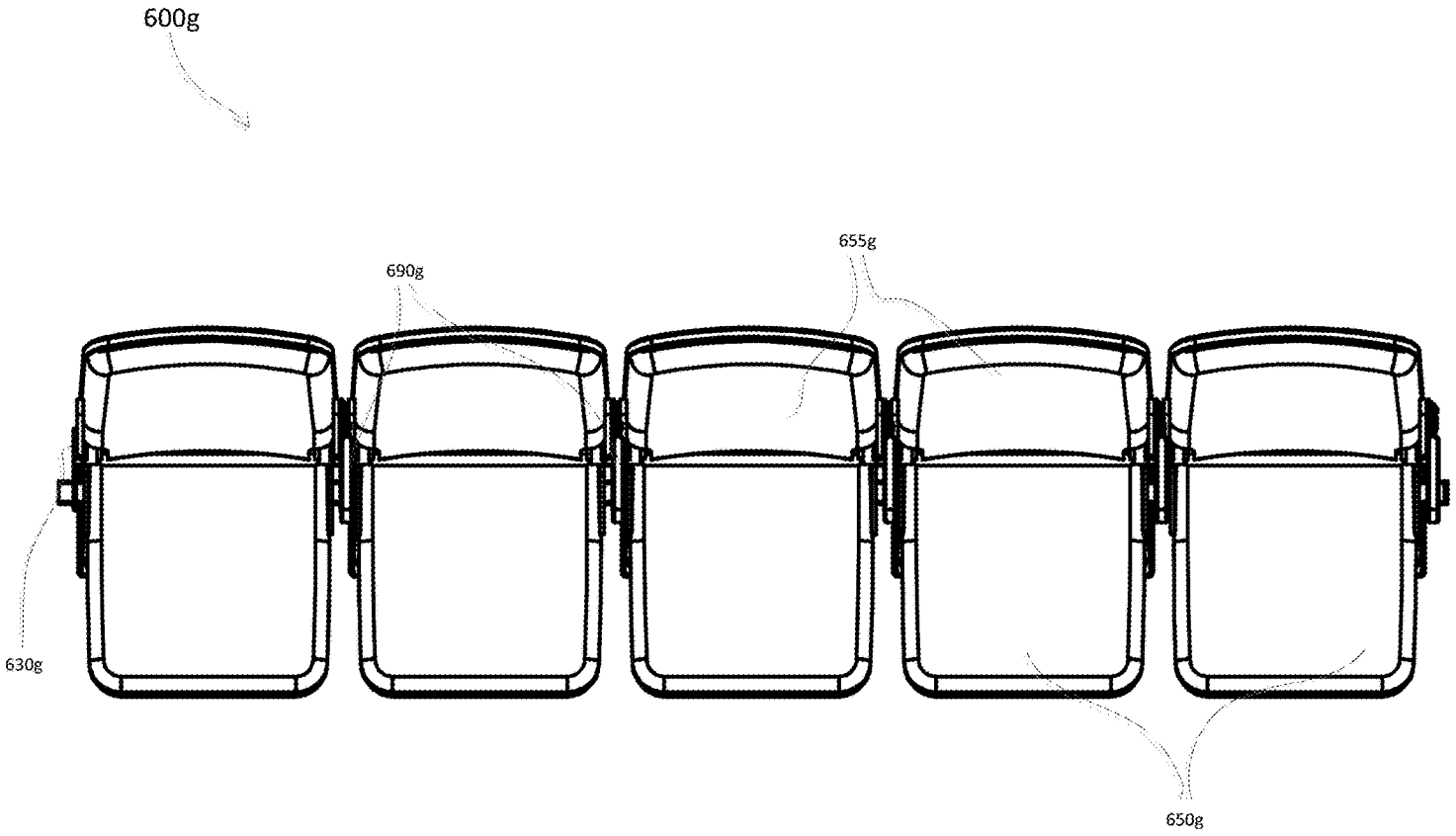
Figure 6H:
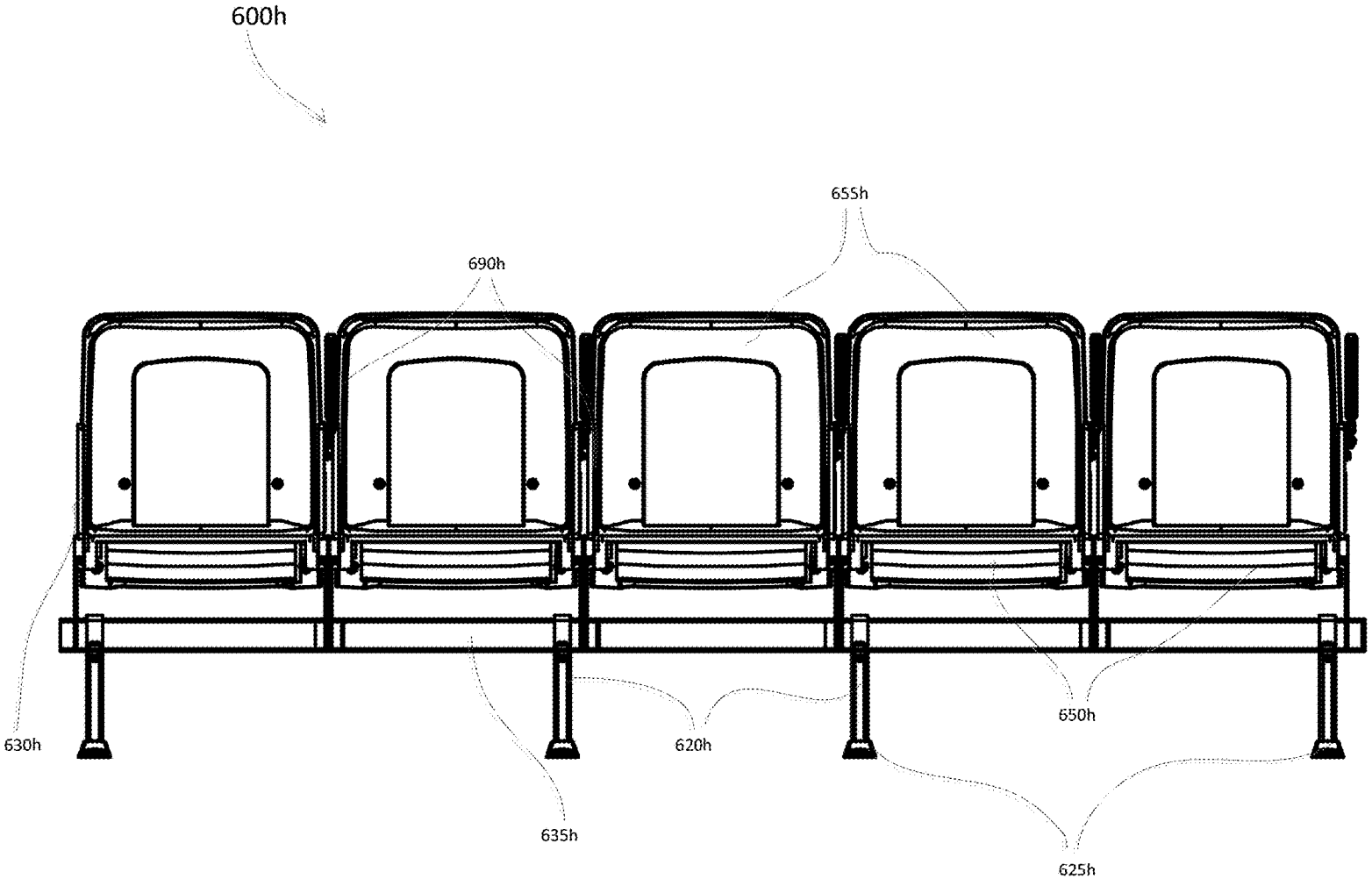
Figure 6J:
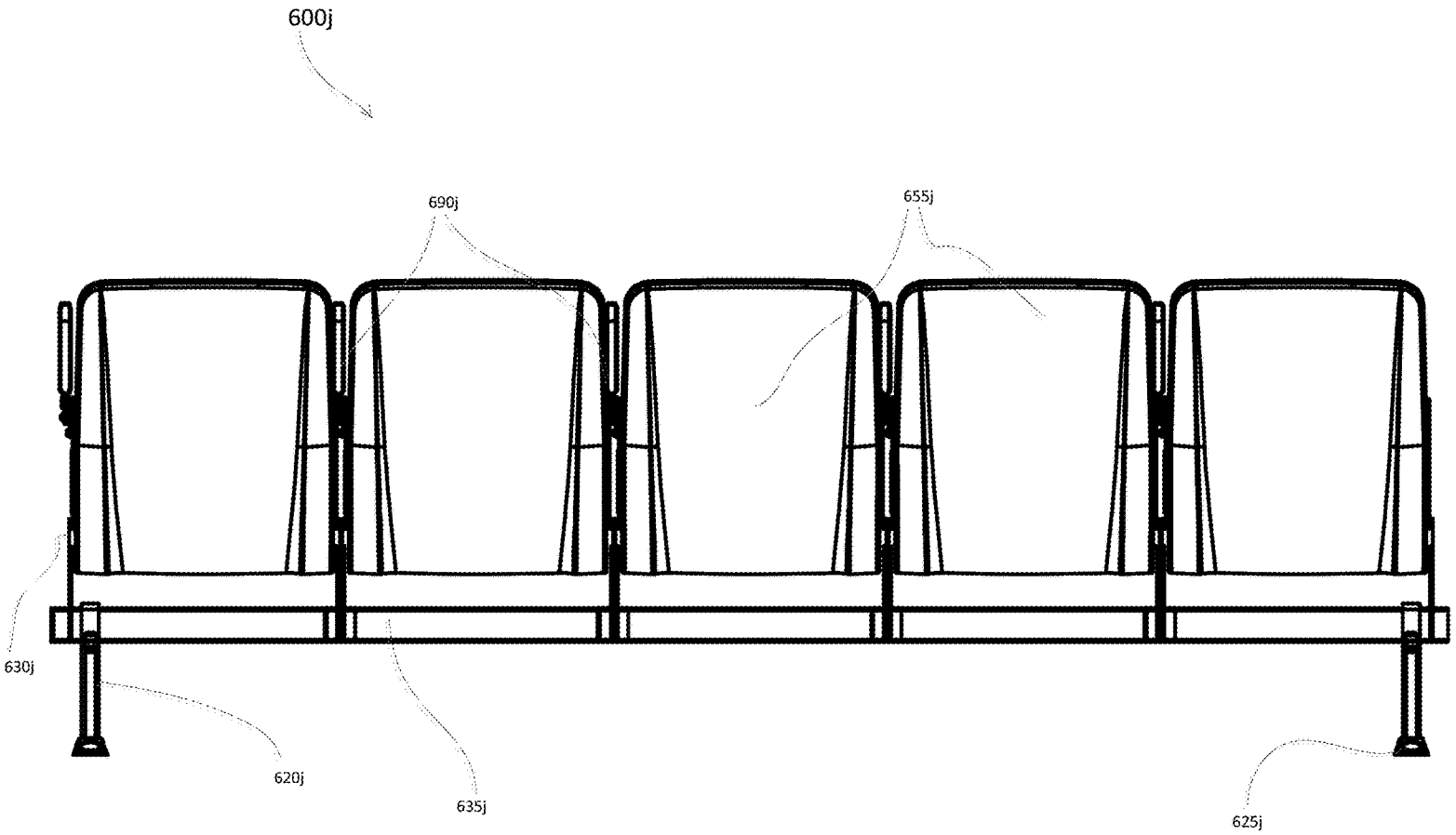
Figure 6K:
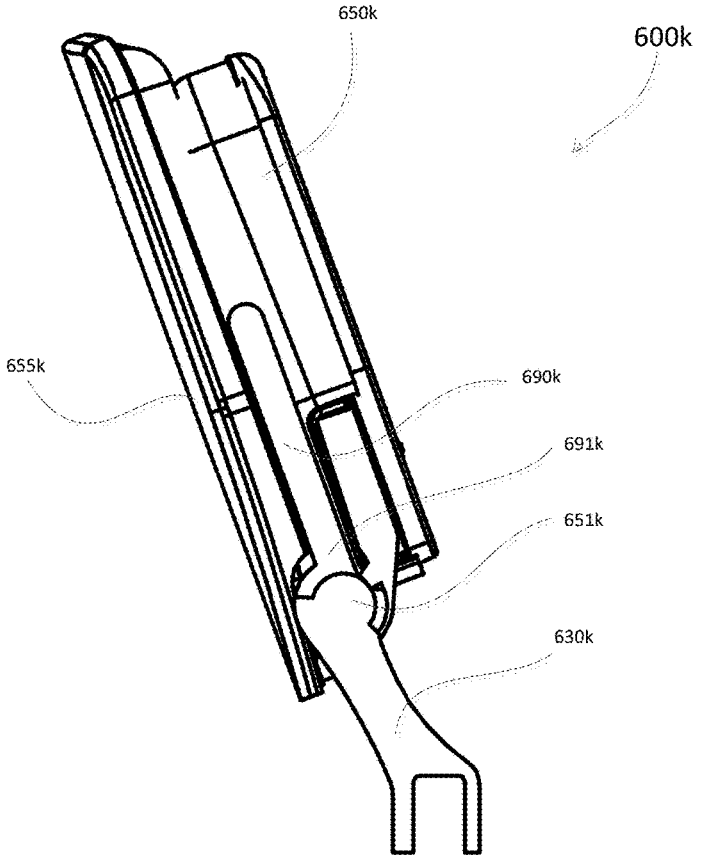
Figure 6L:
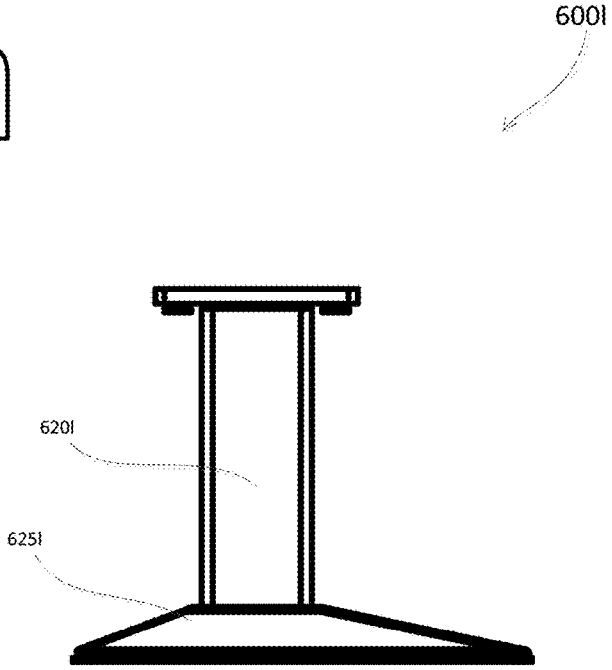

With reference to FIGS. 6A-6H and 6J-L, various views of example beam mounted chair assemblies 600*a*-600*h* and 600*j*-600*l* having upholstered chair seats 650*a*-650*h* and 650*j*-650*l* and chair backs 655*a*-655*h* and 655*j*-655*l* are depicted. A beam mounted chair assembly 600*a*-600*h* and 600*j*-600*l* may include at least two standards 620*a*-620*h* and 620*j*-620*l* having mounting feet 625*a*-625*h* and 625*j*-625*l*, at least one beam 635*a*-635*h* and 635*j*-635*l*, chair brackets 630*a*-630*h* and 630*j*-630*l* and armrests 690*a*-690*h* and 690*j*-690*l*. FIGS. 6C and 6D depict a left-side profile view of a beam mounted chair assembly 600*c*, 600*d* with a chair seat 650*c*, 650*d* and an armrest 690*c*, 690*d* pivotally attached to a chair bracket 630*c*, 630*d*. As can be seen in FIGS. 6C and 6D, the chair seat 650*c*, 650*d* may be configured to automatically pivot between an in use position (chair seat 650*c*, 650*d* shown in solid lines in FIGS. 6C and 6D, respectively) and a three-quarter up position (chair seat 650*c* shown in dashed lines in FIG. 6C) and manually push to full fold (chair seat 650*d* shown in dashed lines in FIG. 6D). Such an arrangement has the desirable advantage that when spectators leave, the seats are automatically returned to the standby position and thus do not reduce the width of the aisle between adjacent rows of seats and along which the spectators move. Optionally, the chair seat 650*c*, 650*d* may be configured to automatically pivot to a user selectable position anywhere between the in use position and a full fold position. The full fold position further increases isle width and minimizes packaging size during shipping. An armrest 690*c*, 690*d* may be configured to be manually pivotable between an in use position (armrest 690*c*, 690*d* shown in solid lines in FIGS. 6C and 6D, respectively) and a standby position (armrest 690*d* shown in dashed lines in FIG. 6D). With the chair seat 650*d* and armrest 690*d* in a full fold position against a chair back 655*d*, associated shipping space in minimized while facilitating pre-assembly of the associated chair prior to shipping.

Figure 7A:
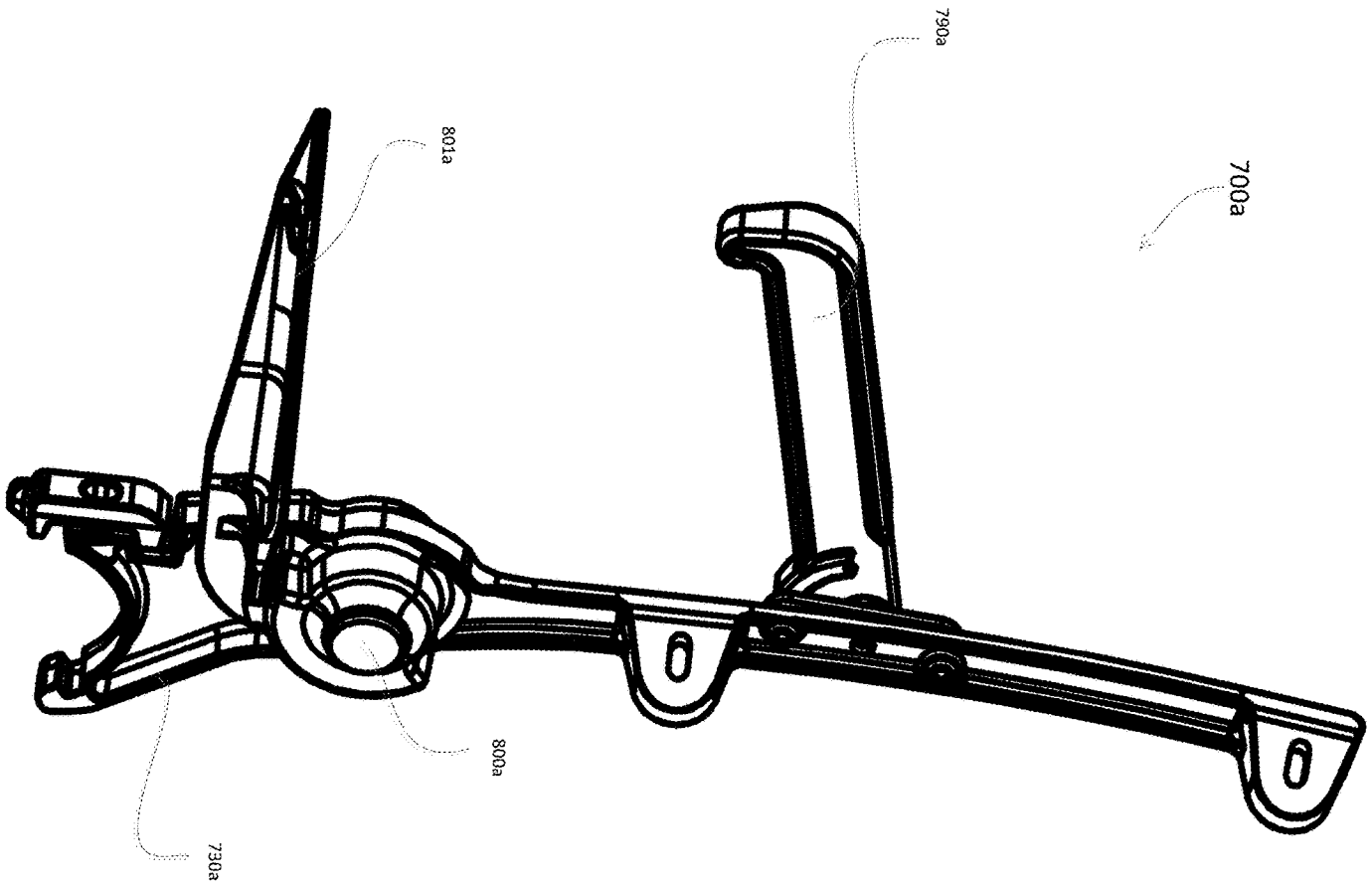
FIGS. 7A-7F depict various views of chair brackets having a pivotally attached armrest and a pivotally attached chair seat bracket.

Turning to FIGS. 7A-7F, various views of chair brackets 730*a*-730*f* having a pivotally attached armrest 790*a*-790*f* and a pivotally attached chair seat bracket 752*b* are depicted. In particular, FIG. 7A depicts a chair bracket assembly 700*a* is depicted including a chair bracket 730*a* having a chair seat bracket 801*a* pivotally attached via a chair seat pivot 800*a*. The chair seat pivot 800*a* may be configured to provide an automatic chair seat pivot from an "in use" position to a three-quarter folded up position and a manual push to full fold features. As depicted in FIG. 7A, a chair seat pivot 800*a* may be located above a top chair seat surface (e.g., top surface 817*a* of FIG. 8), thereby, a corresponding chair assembly may be folded into a smaller area compared to a chair assembly incorporating a chair seat as depicted in FIG. 8. The assembly 700*a* may include an armrest 790*a* pivotally secured to the chair bracket 730*a*. Alternatively, an armrest 790*a* may be pivotally secured to a beam, a standard, a chair back structure, or a chair seat structure independent of a chair bracket 730*a*. An armrest may be fixed or may be pivotable between a use position and a stored/shipping position. An armrest may be configured to pivot with an associated chair seat, a chair back or may be independent of each. Optionally, an armrest may be excluded.

Figure 7B:
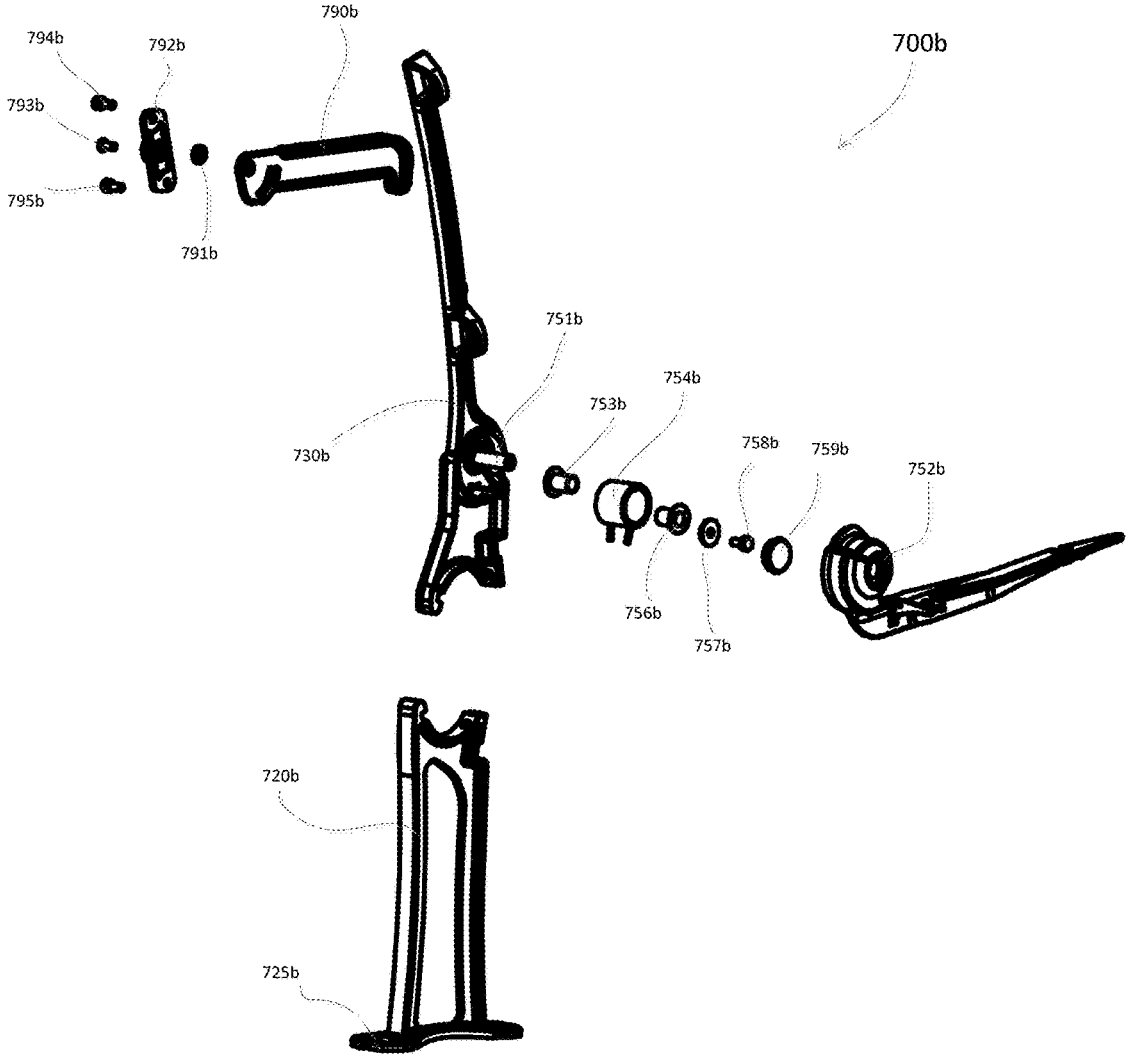
Figure 8:
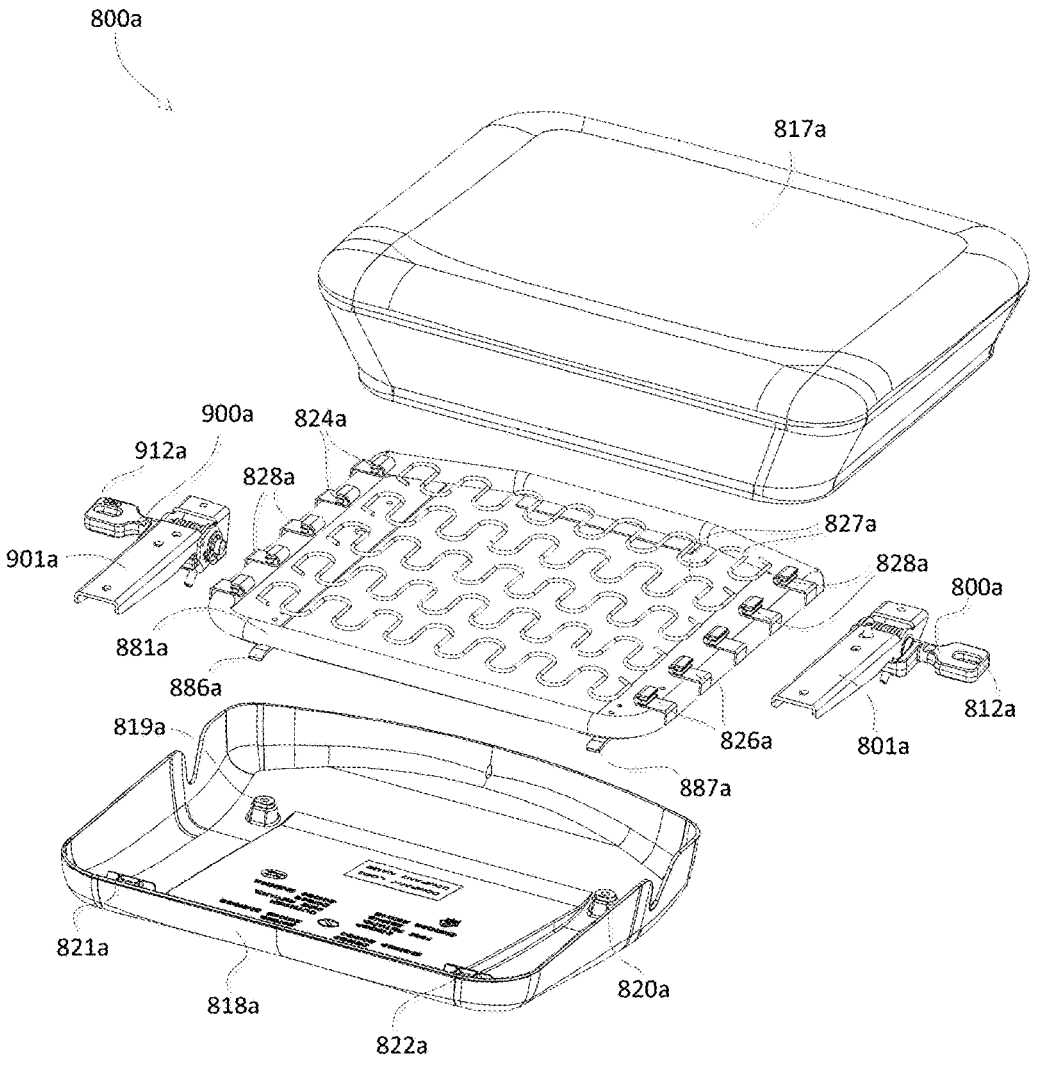
FIG. 8 depicts a top, front, exploded perspective view of an example chair seat assembly having pivot mechanisms incorporated.

Turning to FIG. 7B, a beam mounted chair assembly 700*b* is depicted including a standard 720*b* having a mounting foot 720*b* and a chair bracket 730*b* including a pivotally attached chair seat bracket 752*b* and armrest 790*b*. A chair seat bracket 752*b* may be pivotally attached to a chair bracket 730*b* via chair bracket pivot post 751*b*, first cam 753*b*, a biasing spring 754*b*, a second cam 756*b*, a washer 757*b*, a first fastener 758*b* and a second fastener 759*b*. The biasing spring 754*b* may be configured within the chair seat pivot 750*b* such that the biasing spring may be in a neutral state when an associated chair seat is in a standby position (e.g., three-quarter position as shown in FIGS. 5B and 6C, a nine-tenths position, a five-eighth position, full fold position, etc.) and may be in a charged state when a patron sets on the chair seat. The chair seat pivot 750*b* may be configured to automatically pivot between an in use position (chair seat 650*c*, 650*d* shown in solid lines in FIGS. 6C and 6D, respectively) and a three-quarter up position (chair seat 650*c* shown in dashed lines in FIG. 6C) and manually push to full fold (chair seat 650*d* shown in dashed lines in FIG. 6D).

Figure 7C:
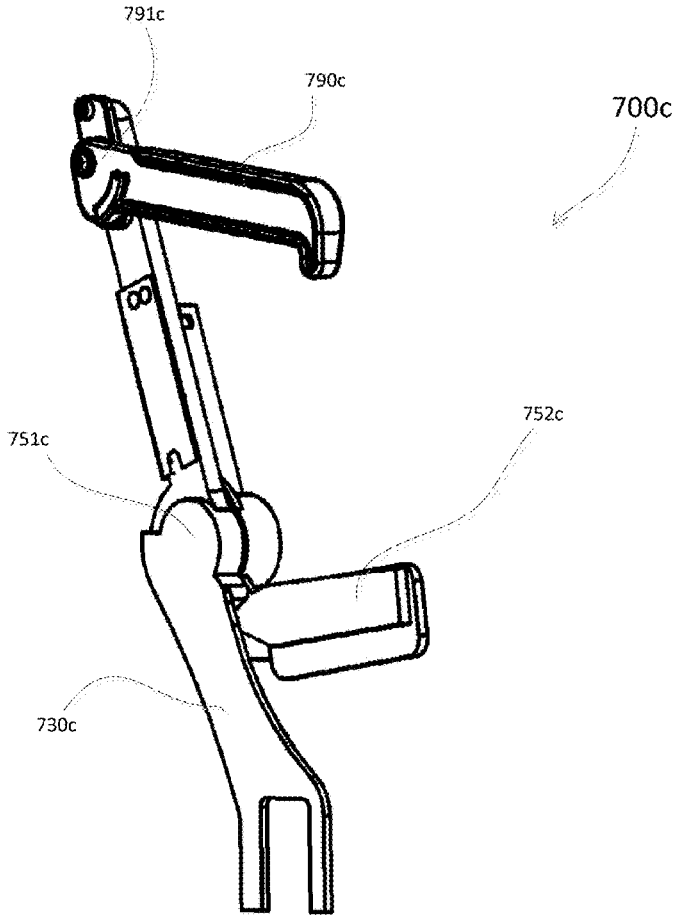
Figure 7D:
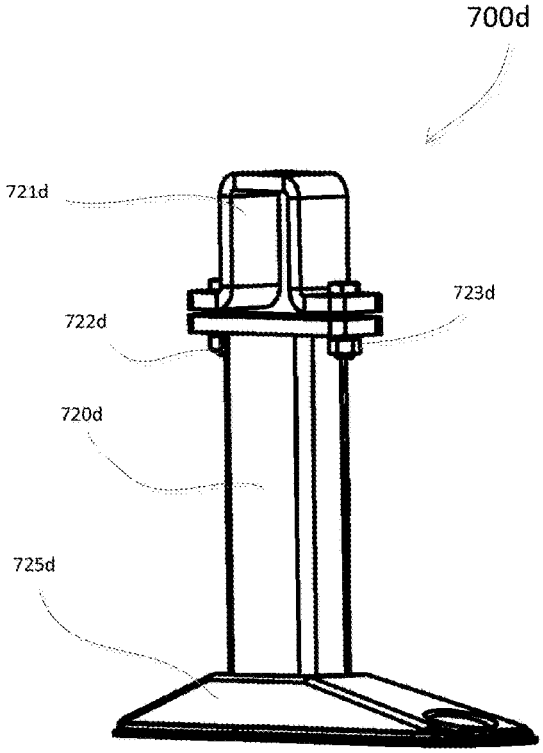

With reference to FIG. 7C, a beam mounted chair assembly 700*c* is depicted including a chair seat bracket 752*c* pivotally attached to a chair bracket 730*c* via a chair seat pivot mechanism 751*c* and an armrest 790*c* pivotally attached via an armrest pivot mechanism 791*c*. FIG. 7D depicts a standard 720*d* including a mounting foot 725*d* and a beam bracket 721*d* fastened to the standard 720*d* via bolts 722*d*, 723*d*.

Figure 7E:
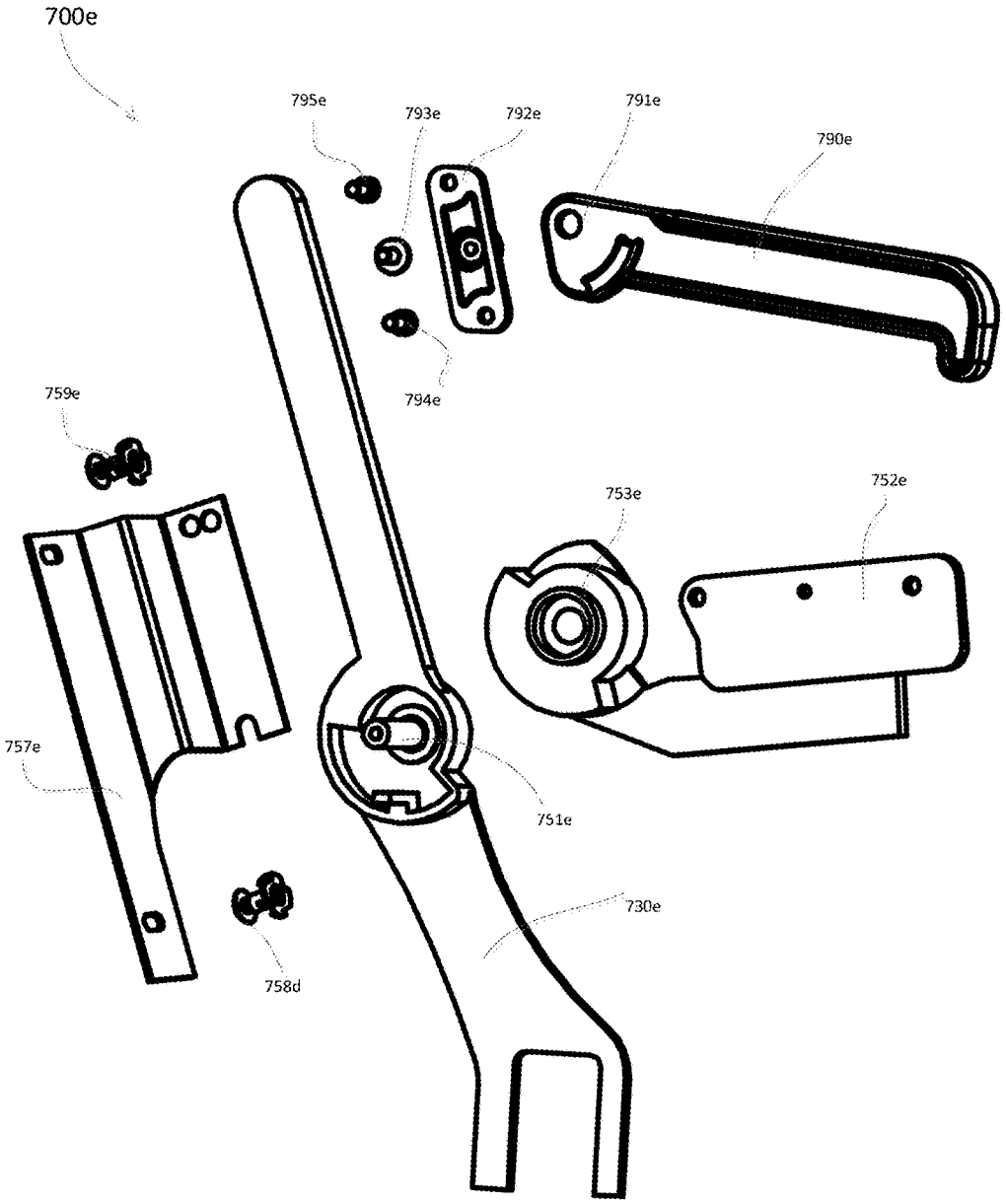
Figure 7F:
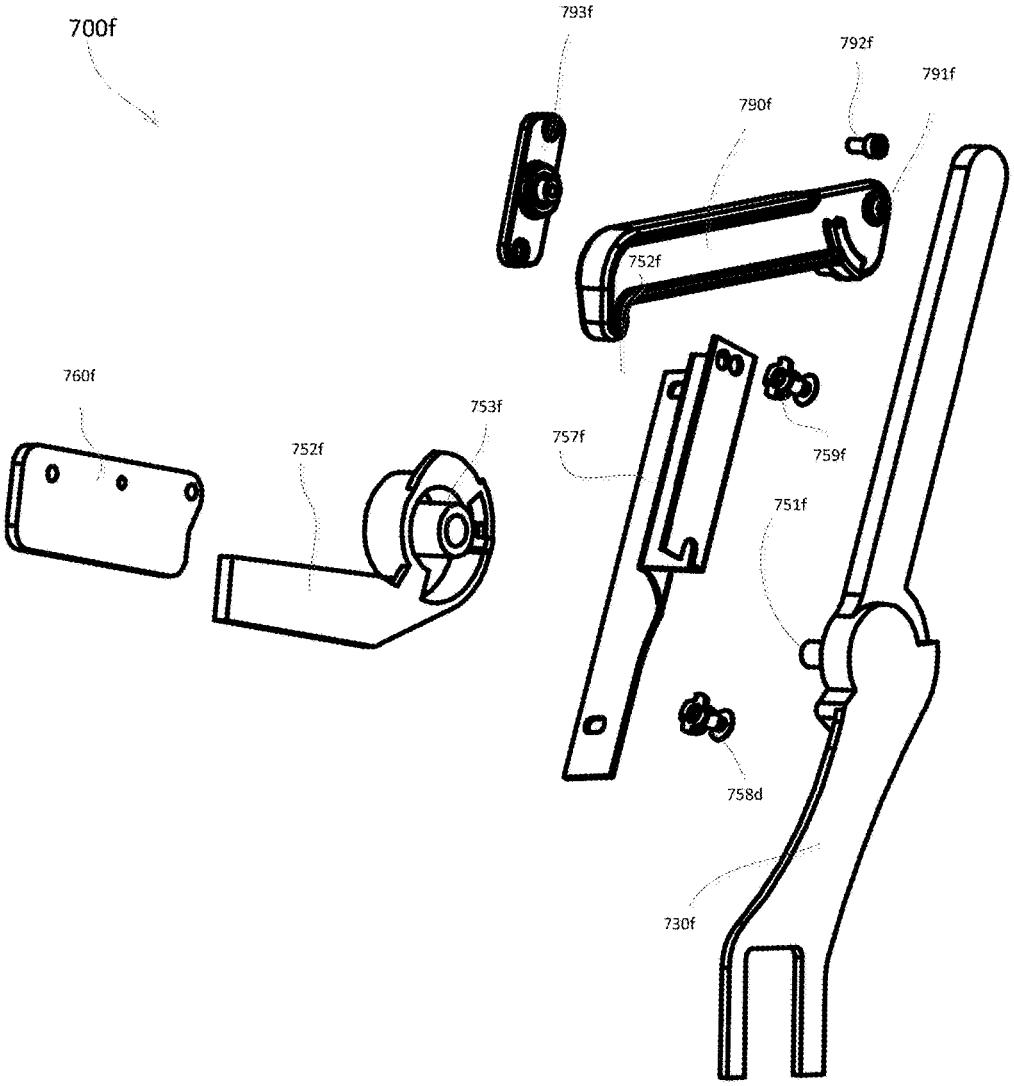

Turning to FIGS. 7E and 7F, beam mounted chair assemblies 700*e*, 700*f* are depicted including a chair seat bracket 752*e*, 752*f* pivotally attached to a chair bracket 730*e*, 730*f* via a chair seat pivot mechanism 751*e*, 751*f*, an armrest 790*e*, 790*f* pivotally attached via an armrest pivot mechanism 791*e*, 791*f*, a chair back bracket 757*e*, 757*f* and chair back fasteners 758*e*, 758*f*, 759*e*, 759*f*. An armrest pivot mechanism 791*e*, 791*f* may include an armrest mounting bracket 792*e*, 792*f* attached to the chair bracket 730*e*, 730*f* via fasteners 794*e*, 794*f*, 795*e*, 795*f* and an armrest pivot post 793*e*, 793*f*.

Turning to FIG. 8, a top, front, exploded perspective view of an example chair seat assembly 800*a* is depicted having a right-hand chair seat pivot assembly 900*a* and a left-hand chair seat pivot assembly 800*a*. As depicted in FIG. 8, the right-hand chair seat pivot assembly 900*a* and the left-hand chair seat pivot assembly 800*a* may be incorporated within the chair seat assembly below a top surface 817*a*. The chair assembly 800*a* may be, for example, as described in commonly assigned application Ser. No. 61/856,013, entitled Telescopic Seating Systems, and Foldable Chairs and Related Components for use within Telescopic Seating Systems, filed Jul. 18, 2013, the entire disclosure of which is incorporated in its entirety by reference herein. As disclosed in this patent application, pivot assemblies 800*a*, 900*a* may, for example, be spring loaded to provide an automatic chair seat pivot from an "in use" position to a three-quarter folded up position. The pivot assemblies 800*a*, 900*a* may be configured to provide a push-to-full-fold feature similar to, for example, the assemblies 500*a* of FIG. 5A and 600*d* of FIG. 6D.

With reference to FIGS. 9A-G, a chair seat assembly 900*a*-*c* may include a beam 935*a*-*c* supported on at least one standard 920*a*. The chair seat assembly 900*a*-*g* may include at least one chair bracket 930*a* supported on the beam

935*a-c*. The chair seat assembly 900*a-c* may include electrical data wiring 905*a-c, f, g* and/or electrical power wiring 906*a-e*. While the electrical data wiring 905*a-c, f, g* and the electrical power wiring 906*a-e* is shown in FIGS. 9A-C as being routed within the beam 935*a-c*, the electrical data wiring 905*a-c, f, g* and/or the electrical power wiring 906*a-e* may be incorporated anywhere within the chair seat assembly 900*a-c*.

The chair bracket 930*a* may include a surface 970*a* having at least one fulcrum 971*a*. The beam 935*a-c* may include a first substantially planar surface 975*a* configured to support the surface 970*a*. The at least one fulcrum 971*a* may be configured such that, when the chair bracket 930*a* is secured to the beam 935*a-c*, the surface 970*a* is biased toward the first substantially planar surface 975*a*. Alternatively, at least one fulcrum may be incorporated into the surface 975*a* and the surface 970*a* may be substantially planar.

The standard 920*a* may include a surface 985*a* having at least one fulcrum 986*a*. The beam 935*a-c* may include a second substantially planar surface 980*a* configured to be supported by the surface 985*a*. The at least one fulcrum 986*a* may be configured such that, when the beam 935*a-c* is secured to the standard 920*a*, the surface 985*a* is biased toward the second substantially planar surface 980*a*. Alternatively, at least one fulcrum may be incorporated into the surface 980*a* and the surface 985*a* may be substantially planar.

The beam 935*a-c* may be substantially symmetrical on either side of line A-A. The beam 935*a-c* may be substantially asymmetrical on either side of line B-B.

The chair seat assembly 900*a-c* may include a beam coupler 965*b,c* configured to couple a first beam 935*b,c* to a second beam 935*b,c*. An end of the first beam 935*b,c* and an end of the second beam 935*b,c* may be inserted into the beam couple 965*b,c*. Alternatively, the beam coupler 935*b,c* may be inserted within the end of the first beam 935*b,c* and the end of the second beam 935*b,c*.

The beam coupler 965*b,c* may include at least one electrical outlet 980*b,c*. The electrical outlet 980*b,c* may include at least one electrical data outlet 981*b,c* and at least one electrical power outlet 982*b,c*. An electrical data outlet 981*b,c* and/or an electrical power outlet 982*b,c* may include a wired communications network access point (e.g., computer, telephone, etc.), a wireless communications network access point (e.g., computer, telephone, etc.), a communications network booster (e.g., computer, telephone, etc.), an electrical connection (e.g., power, computer, telephone, etc.), an electrical junction point (e.g., power, computer, telephone, etc.), a communications network connection (e.g., computer, telephone, etc.), a communications network junction (e.g., computer, telephone, etc.), a computer connection point (e.g., hard wired, wireless, etc.), a telephone connection point (e.g., hard wired, wireless, etc.), etc. The electrical data outlet 981*b,c* may be either a hardwired connection or a wireless connection. While the electrical outlet 980*b,c* is illustrated as being on a bottom facing surface of the beam coupler 965*b,c*, an electrical outlet 980*b,c* may be incorporated into any surface of a beam coupler 965*b,c*. Alternatively, or additionally, an electrical outlet 980*b,c* may be incorporated into any surface of a beam 935*a-c*, any surface of a standard 920*a*, or any surface of a chair bracket 930*a*.

The electrical data wiring 905*a-c* may be similar to, for example, the electrical data wiring 900*f,g*. The electrical data wiring 900*f* may include wire pig tails 905*f* on a first end and a plug 910*f* on a second end. The electrical data wiring 900*f* may include an armor 970*f* and a restraining clamp 975*f*. Alternatively, the electrical data wiring 900*g* may include a male plug 905*g* on a first end and a female plug 910*g* on a second end. The electrical data wiring 900*g* may include an armor 970*g*.

The electrical power wiring 906*a-c* may be similar to, for example, the electrical power wiring 900*d,e*. The electrical power wiring 900*e* may include wire pig tails 906*e* on a first end and a plug 916*e* on a second end. The electrical power wiring 900*e* may include an armor 971*e* and a restraining clamp 976*e*. Alternatively, the electrical power wiring 900*d* may include a male plug 911*d* on a first end and a female receptacle 916*d* on a second end. The electrical power wiring 900*d* may include an armor 971*d* and a restraining clamp 976*d*.

An electrical outlet 980*b,c* may include at least one male plug, at least one female receptacle, and/or at least one terminal configured to engage with a respective one of the plugs 911*d*, 910*f*, 915*g*, receptacles 916*d*, 910*g*, or pig tale 906*e*, 905*f*, respectively. Thereby, the electrical data wiring 905*a-c, f, g* and/or the electrical power wiring 906*a-e* may be installed without a need for any tools (i.e., the electrical data wiring 905*a-c, f, g* and/or the electrical power wiring 906*a-e* may be plugged together).

Figure 10A:
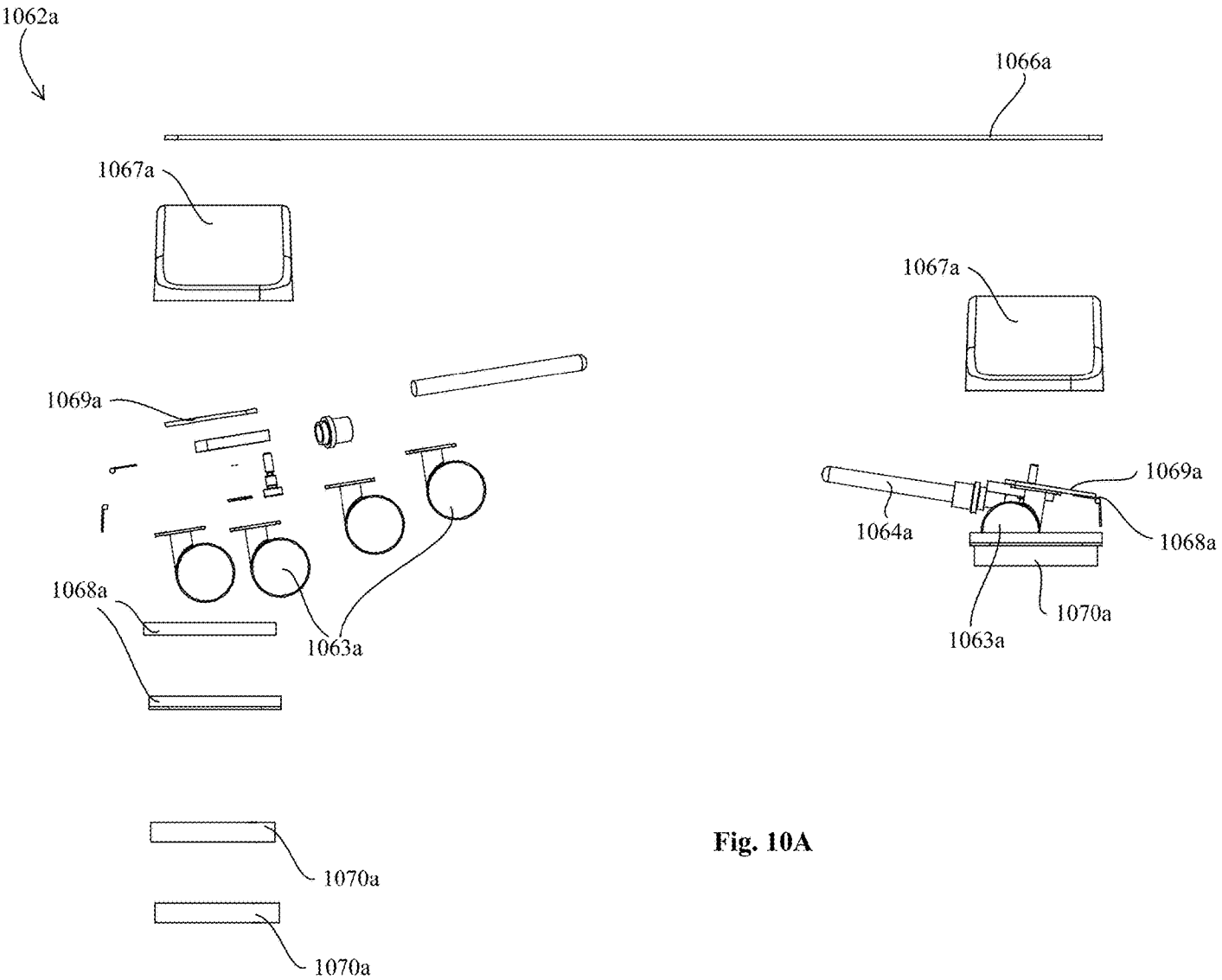
FIGS. 10A and 10B depict various of example retractable wheel assemblies for use within beam mounted chair assemblies.
Figure 10B:
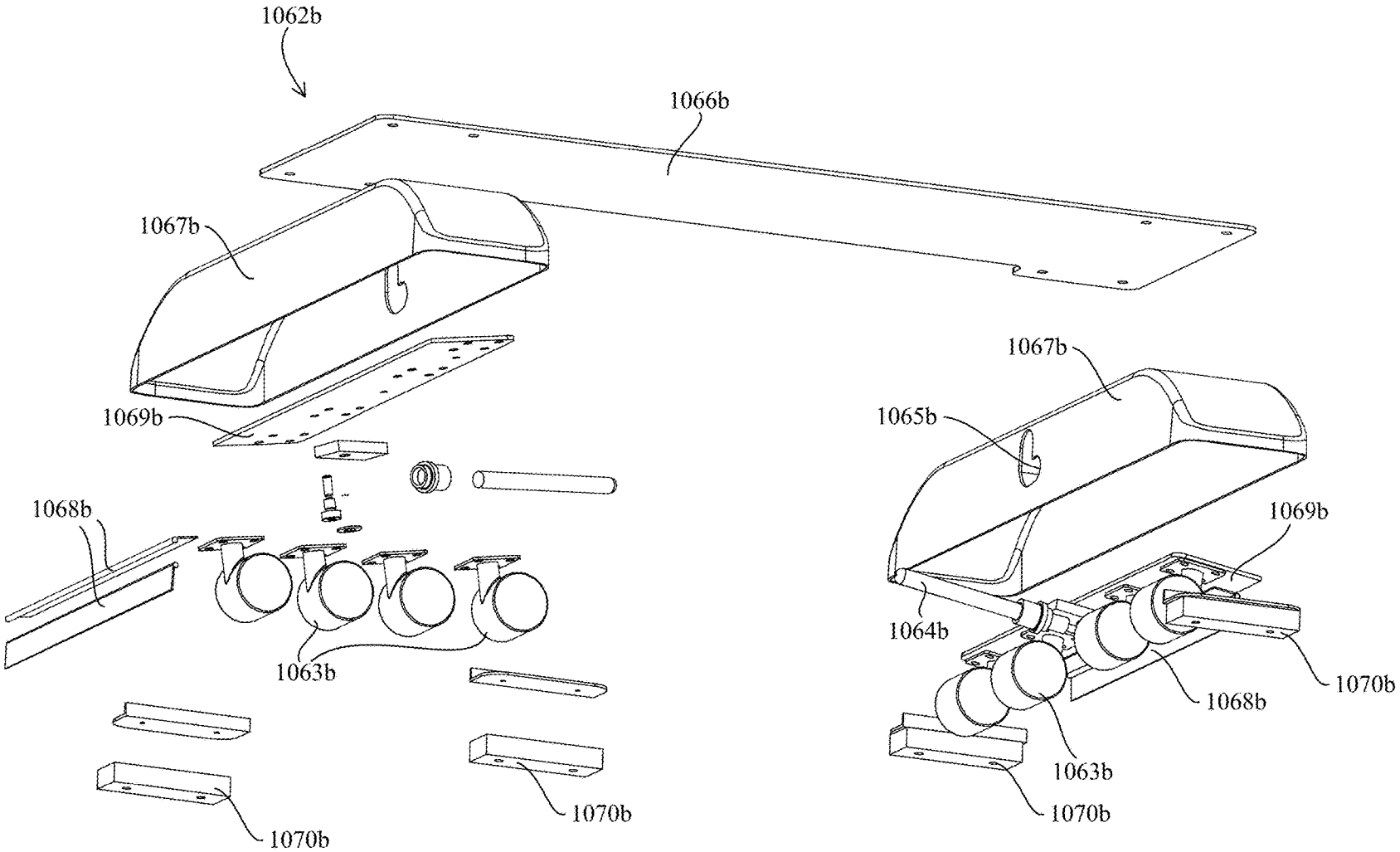

Turning to FIGS. 10A and 10B, a beam mounted chair assembly 1000*a,b* may be similar to, for example, any one of the beam mounted chair assemblies disclosed herein aside from the beam mounted chair assembly 1000*a,b* may include chair roller assemblies 1062*a,b* in lieu of fixed mounting feet. The reference numbers of FIGS. 10A and 10B may reference similarly numbered components as those illustrated in FIG. 3T (without the t concatenated to the given number) aside from the chair roller assemblies 1062*a, b*. The chair roller assemblies 1062*a,b* may include, for example, retractable wheels 1063*a,b* operable between an extended orientation and a retracted orientation via lowering/raising mechanism 1064*a,b*. The chair roller assemblies 1062*a,b* may be configured to, for example, enable a venue operator to reposition an associated beam mounted chair assembly 300*t*, 1000*a,b*. The lowering/raising mechanism 1064*a,b* may be lockable 1065*b* in a respective extended orientation and a retracted orientation once oriented into the given orientation.

A chair roller assembly 1062*a,b* may include a connecting plate 1066*a,b*, a plurality of base plates 1070*a,b*, and a wheel mount bracket 1069*a,b* hingedly attached to a wheel housing 1067*a,b* via a hinge 1068*a,b*. An operator may, for example, press down on a lowering/raising mechanism 1064*a,b* and the associated wheels 1063*a,b* will hinge downward such that the associated plurality of base plates 1070*a,b* are lifted off an associated floor surface. Once the operator presses down on the lowering/raising mechanism 1064*a,b* to lift the plurality of base plates 1070*a,b* off an associated floor surface, the operator may rotate the lowering/raising mechanism 1064*a,b* into the lock 1065*a,b*. The operator may reverse the process to raise the wheels 1063*a,b*.

While not explicitly illustrated in the accompanying figures, a beam mounted chair assembly may include a manual mechanism. The manual mechanism may be, for example, as described in commonly assigned U.S. patent application Ser. No. 15/710,768, the disclosure of which is incorporated in its entirety herein by reference (e.g., manual mechanism 4340 of FIG. 43). The manual mechanism may include a chair recline locking feature, an ottoman reorientation mechanism, and/or a chair lowering/raising feature. The manual mechanism may be configured with, for example, a thumb-button to release/lock the manual mechanism, and/or may include a ratchet-type mechanism (e.g., a saw-tooth gear/lock) for multi-position orientation.

The chair recline locking feature may include a mechanical lock (e.g., a c-clip, a pin, etc.) configured to lock an associated rocker style chair assembly in a desired orientation once the associated rocker style chair assembly is, for example, manually rocked into the desired orientation. Alternatively, or additionally, the locking feature may be configured to enable a user to, for example, recline a chair back (e.g., chair back frame) into a desired orientation and then lock the chair back into the desire orientation. The ottoman reorientation mechanism may enable a chair ottoman to be manually oriented into a desired orientation and/or locked into the desired orientation.

The chair lowering/raising feature may enable an associated rocker style chair assembly and/or an associated chair seat frame to be oriented into a desired height orientation. For example, the standards may be, for example, telescopic structures with spring loaded extensions. Thereby, an associated rocker style chair assembly and/or an associated chair seat frame may be lowered by, for example, releasing the chair lowering/raising feature and applying a downward force on the associated rocker style chair assembly and/or an associated chair seat frame and, when the associated rocker style chair assembly and/or an associated chair seat frame is at the desired height, locking the chair lowering/raising feature. The rocker style chair assembly and/or an associated chair seat frame may be raised by, for example, releasing the chair lowering/raising feature and removing any downward force on the associated rocker style chair assembly and/or an associated chair seat frame and, when the associated rocker style chair assembly and/or an associated chair seat frame is raised to the desired height (via, for example, spring loaded upward force), locking the chair lowering/raising feature.

Figure 11A:
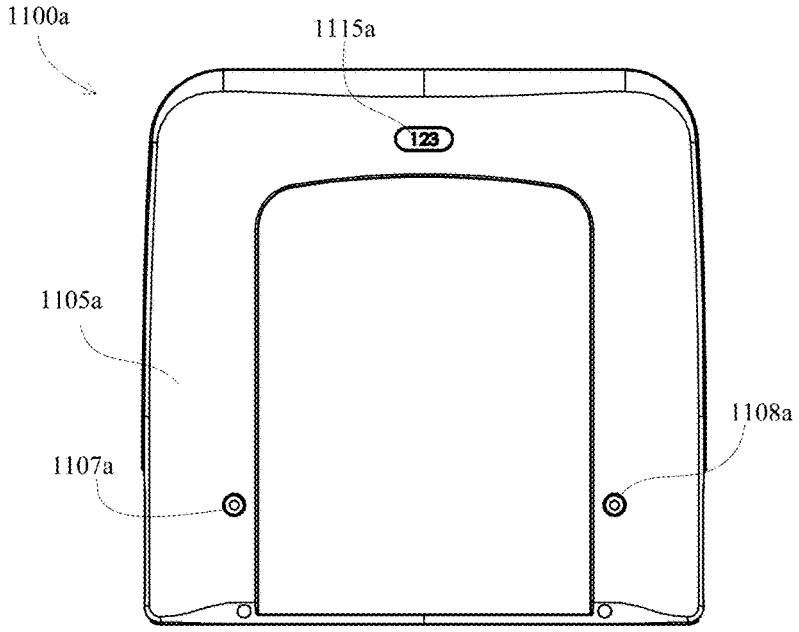
Figure 11B:
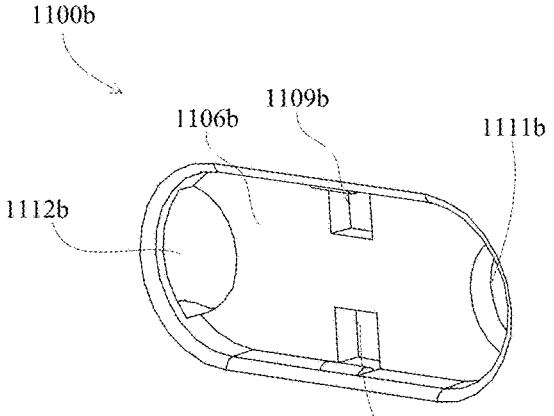
Figure 11C:
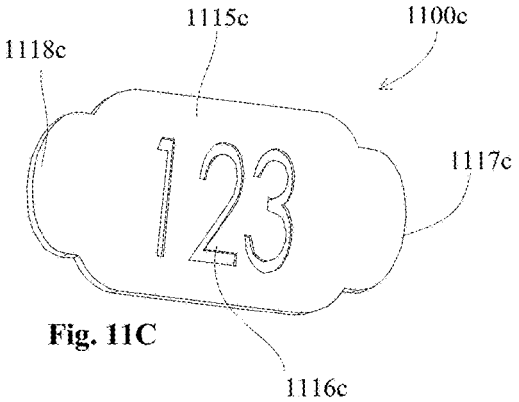

With reference to FIGS. 11A-F, a display assembly 1100*a-f* may include an information plate (or tag) 1115*a, c, e, g* removably secured within a receptacle 1106*b, d* of an associated chair assembly (e.g., a chair bottom 1105*a*) such that, for example, when an associated chair seat is in an unoccupied orientation (i.e., tilted up), the information plate is visible (e.g., oriented as illustrated in FIG. 11A). The chair bottom 1105*a* may be secured to an associated chair via fasteners 1107*a, d*, 1108*a, d*. Any given fastener 1107*a, d*, 1108*a, d* may be hidden from view behind an information plate 1107*a, d*, 1108*a, d*.

An information plate 1115*a, c, e, g* may be placed in a receptacle 1106*b, d* by, for example flexing the information plate 1115*a, c, e, g* and inserting the tabs 1117*c, g*, 1118*c, g* into a respective hole 1111*b, f*, 1112*b, f* and then releasing the information plate 1115*a, c, e, g* such that the information plate 1115*a, c, e, g* snaps behind retention features 1109*b*, 1110*b*. Thereby, no tools are required to install an information plate 1115*a, c, e, g*. An information plate 1115*a, c, e, g* may be removed by, for example, inserting a pin (or the like) into either, or both of the reside removal holes 1113*f*, 1114*f*. Alternatively, or additionally, an information plate 1115*a, c, e, g* may be removed from a receptacle 1106*b, d* by prying the information plate 1115*a, c, e, g* from a front side.

An information plate 1115*a, c, e, g* may include, for example, a chair number 1116*c* and/or a row number. Alternatively, or additionally, the information plate 1115*a, c, e, g* may include any other information, such as, a chair manufacture logo, a venue name or logo, promotional information, information as to whether a ticket has been purchased for the associated chair, a chair "owner's" information, sponsor information, advertising information, etc. An information plate 1115*a, c, e, g*/receptacle 1106*b, d* may be configured to define a display assembly 1100*a-f*. An information plate 1115*a, c, e, g*/receptacle 1106*b, d* may further include at least one sensor component (e.g., an occupancy sensor, an occupant pinch-point sensor, a chair location sensor, etc.). An information plate 1115*a, c, e, g* may be an etched piece of plastic with paint in the etched portion, a piece of plastic with a colored surface laser etched, a thin piece of metal with an etched portion painted, a thin piece of metal with a colored surface laser etched, etc.

A receptacle 1106*b, d* may be formed within an associated chair assembly (e.g., a chair bottom 1105*a*) via an associated mold. Alternatively, or additionally, a receptacle 1106*b, d* may be formed within an associated chair assembly (e.g., a chair bottom 1105*a*) via machining process (e.g., a drill, a router, etc.).

Figure 12A:
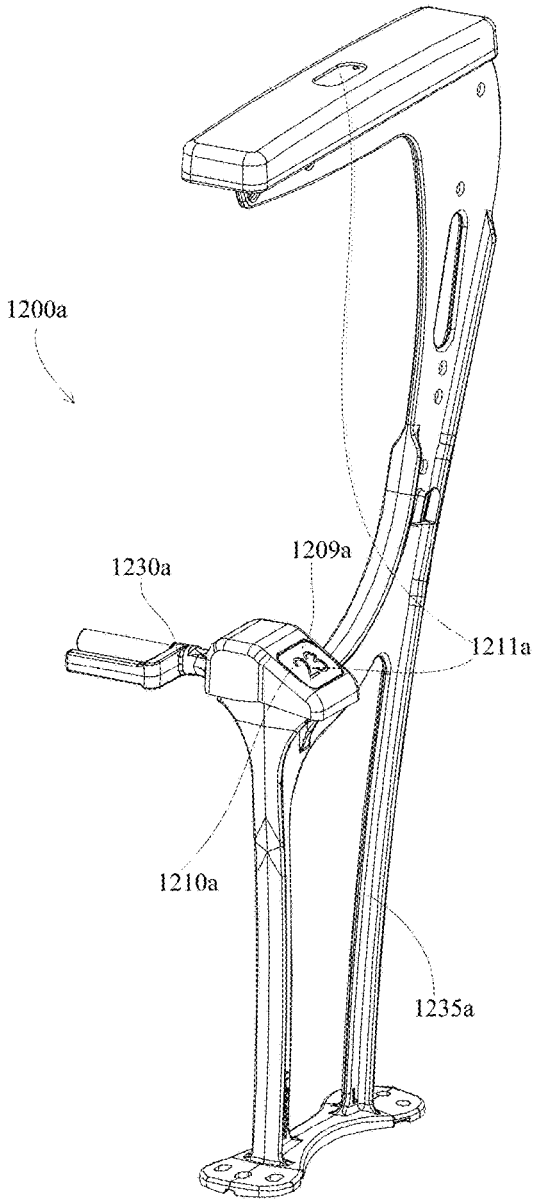
FIGS. 12A-F depict various views of an example display assemblies.
Figure 12B:
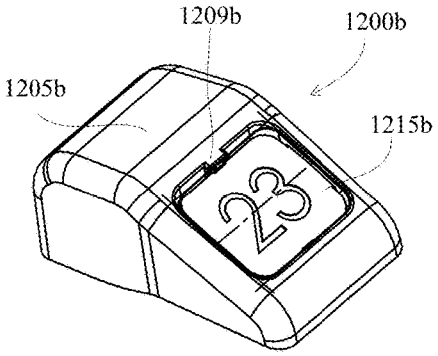
Figure 12D:
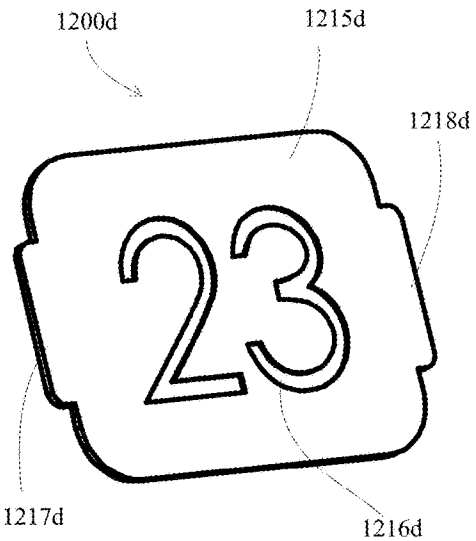
Figure 12C:
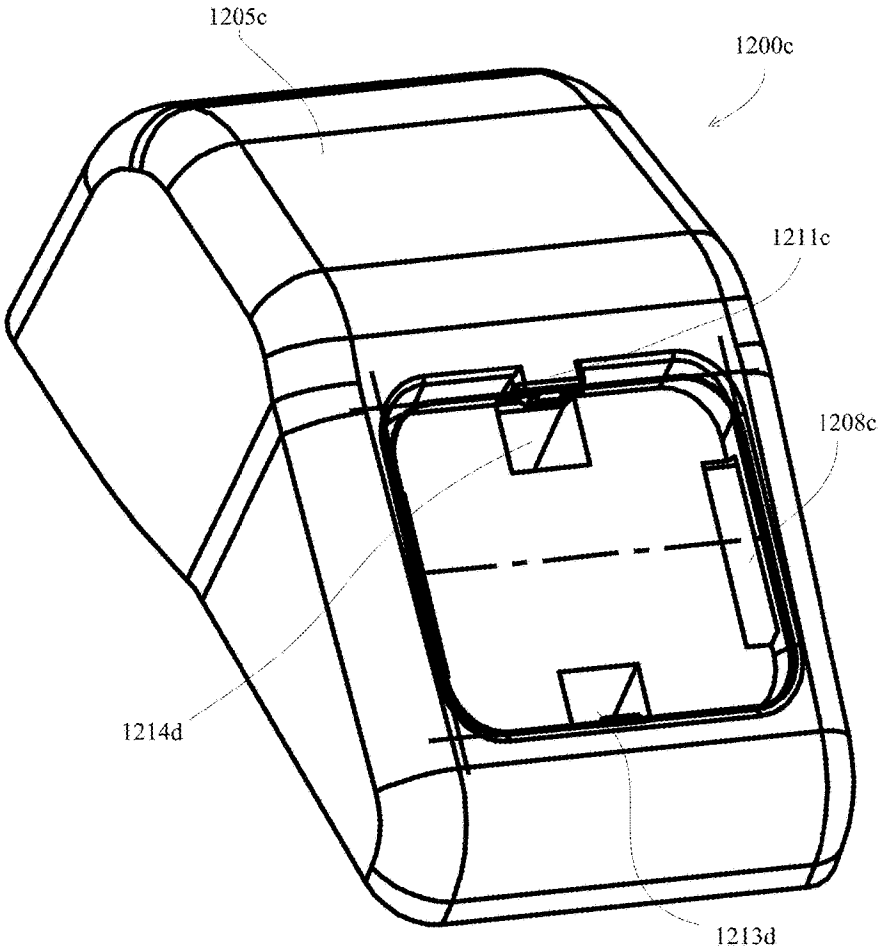
Figure 12E:
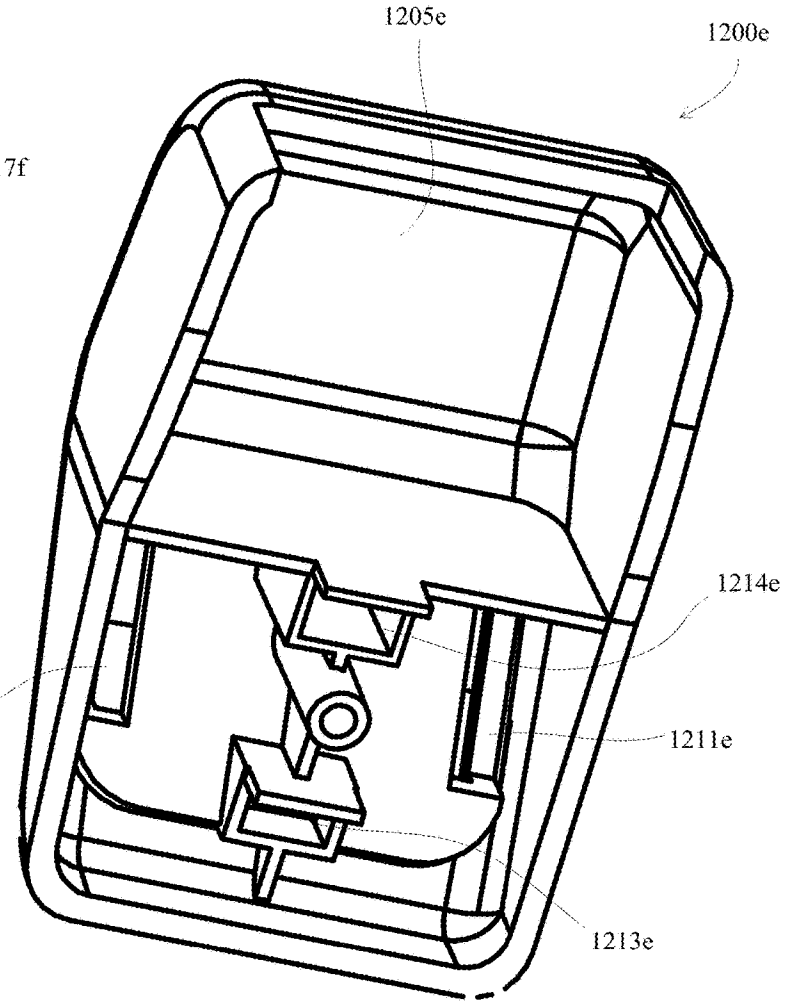
Figure 12F:
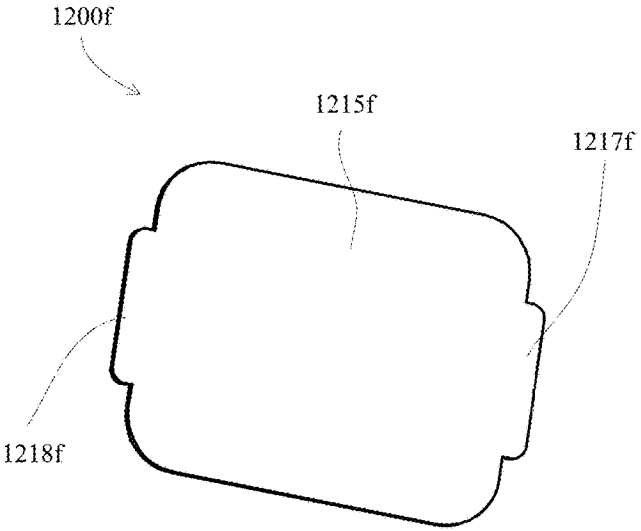

Turning to FIGS. 12A-F, a display assembly 1200*a-f* may include an information plate 1215*b, d, f* removably secured within a receptacle of an associated chair assembly (e.g., a chair bottom pivot assembly 1230*a* attached to, for example, a chair standard 1235*a*) such that, for example, when an associated chair seat is in an unoccupied orientation (i.e., tilted up), the information plate is visible (e.g., oriented as illustrated in FIG. 12A).

An information plate 1215*b, d, f* may be placed in a receptacle 1206*b, d* by, for example flexing the information plate 1215*b, d, f* and inserting the tabs 1217*c, g*, 1218*c, g* into a respective hole 1211*b, f*, 1212*b, f* and then releasing the information plate 1215*b, d, f* such that the information plate 1215*b, d, f* snaps behind retention features 1209*b*, 1210*b*. Thereby, no tools are required to install an information plate 1215*b, d, f*. An information plate 1215*b, d, f* may be removed by, for example, inserting a pin (or the like) into either, or both of the reside removal holes 1213*e, f*, 1214*e, f*. Alternatively, or additionally, an information plate 1215*b, d, f* may be removed from a receptacle by prying the information plate 1215*b, d, f* from a front side.

An information plate 1215*b, d, f* may include, for example, a chair number 1216*c* and/or a row number. Alternatively, or additionally, the information plate 1215*b, d, f* may include any other information, such as, a chair manufacture logo, a venue name or logo, promotional information, information as to whether a ticket has been purchased for the associated chair, a chair "owner's" information, sponsor information, advertising information, etc. An information plate 1215*b, d, f*/receptacle 1206*b, d* may be configured to define a display assembly 1200*a-f*. An information plate 1215*a, c, e, g*/receptacle 1206*b, d* may further include at least one sensor component (e.g., an occupancy sensor, an occupant pinch-point sensor, a chair location sensor, etc.). An information plate 1215*b, d, f* may be an etched piece of plastic with paint in the etched portion, a piece of plastic with a colored surface laser etched, a thin piece of metal with an etched portion painted, a thin piece of metal with a colored surface laser etched, etc.

A receptacle 1206*b, d* may be formed within an associated chair assembly (e.g., a chair seat pivot assembly 1230*a*) via an associated mold. Alternatively, or additionally, a receptacle 1206*b, d* may be formed within an associated chair assembly (e.g., a chair seat pivot assembly 1230*a*) via machining process (e.g., a drill, a router, etc.).

A thickness of a display circuit board may include a Mylar graphic with, for example, a thickness up to 4 mm. Alternatively, a Mylar graphic a 3 mm thickness or 1-2 mm thick. A display may include an injection molded light housing including, for example, a length of 11 mm, or as short as 6 mm. See if 9 mm. An associated display printed circuit board may include a thickness of approximately 2 mm, with connection pins and components on a backside with a total thickness of, for example, 3 mm. The connection pins may be located away from critical areas, such as, a lower edge so the connection pins don not interfere with related structures.

A display 1100*a-f*, 1200*a-f* may be configured with an ambient light sensor to control light output of a display. For example, during pre-show or non-movie times theatre lights may be on such that a seat number can automatically increase intensity. This may reduce the need to program light control thru, for example, an associated control network. Thus, a seat number may be bright when needed and dim when it gets dark during a show. Notably, bright seat lights, during bright sections of the show, may be desirable. A display assembly 1100*a-f*, 1200*a-f* may be configured as a "side display" oriented toward an associated chair. A side display may be located on both sides of, for example, a shared center armrest.

An occupant sensor may be incorporated within an associated display to detect if the chair is occupied. A sensor may be included within a display to indicate when an associated power recliner chair is reclined and/or extended. For example, symbols may be included within a display to indicate whether an associated chair is oriented in a reclined and/or non-reclined orientation. A display may include, for example, recline preset positions 1, 2, 3 and 4. A display may include an auto close button, an order call button, an emergency call button A chair may include features such as a massage feature, a vibration feature, a volume control for internal speakers, a USB or power port, a communications port, etc. A side display may be included and may be oriented toward a wall, an aisle, or another chair with its own controls. A display assembly 1100*a-f*, 1200*a-f* may include aisle lights, a row number/letter, an adults with disabilities (ADA) designation, an indicator when associated chairs are in a venue cleaning mode, a call light indicator for a patron/chair needing service in that row, etc.

Figure 13A:
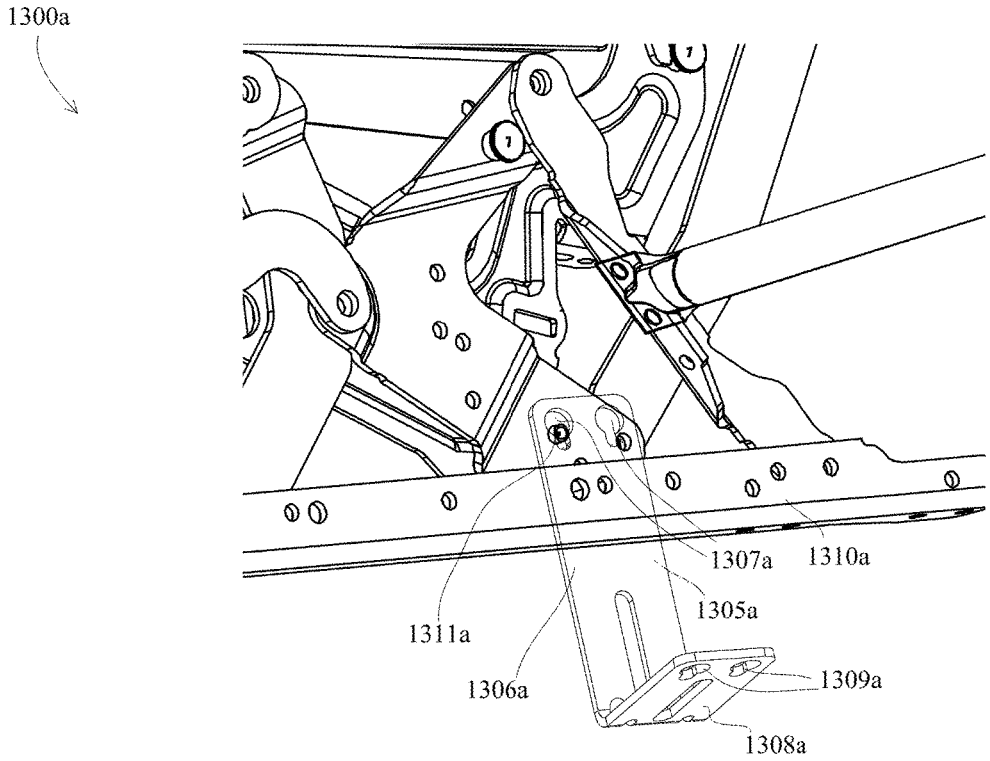
FIGS. 13A-C depict various views of an example mounting foot for use in a powered recliner chair assembly.
Figure 13B:
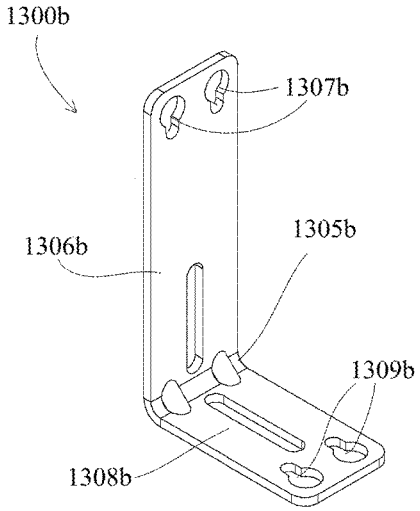
Figure 13C:
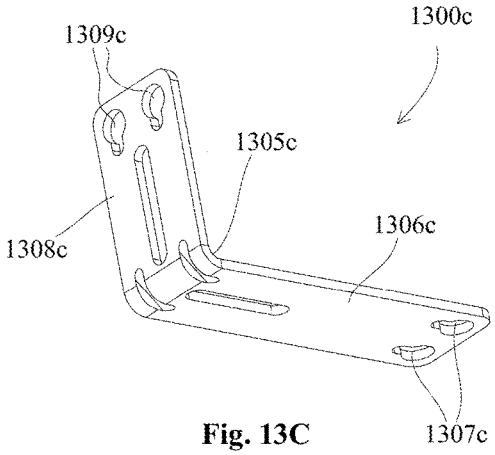

With reference to FIGS. 13A-C, an example mounting foot 1305*a-c* for use in a powered recliner chair assembly 1300*a-c* may include a long portion 1306*a-c* and a short portion 1308*a-c*. The long portion 1306*a-c* may be connected to the short portion 1308*a-c* at, for example, a ninety degree angle. The long portion 1306*a-c* may include first slotted holes 1307*a-c*. The short portion 1308*a-c* may include second slotted holes 1309*a-c*.

When a mounting foot engagement pin 1311*a* of an associated powered recliner chair assembly 1300*a-c* is received within a first slotted hole 1307*a-c*, a respective portion 1310*a* of the powered recliner chair assembly 1300*a-c* is farther from an associated chair support surface than when the engagement pin 1311*a* of the associated powered recliner chair assembly 1300*a-c* is received within a second slotted hole 1309*a-c*. Thereby, a height of the associated powered recliner chair assembly 1300*a-c* may be changed by reorienting associated mounting feet 1305*a-c*. For example, a powered recliner chair assembly 1300*a-c* may be levelly installed on a sloped chair support surface by orienting two front mounting feet 1305*a-c* with associated chair front engagement pins 1311*a* received within a respective first slotted hole 1306*a-c* and associated chair rear engagement pins 1311*a* received within a respective second slotted hole 1309*a-c*.

This detailed description is to be construed as exemplary only and does not describe every possible embodiment, as describing every possible embodiment would be impractical, if not impossible. One could implement numerous alternate embodiments, using either current technology or technology developed after the filing date of this application.

What is claimed is:

1. A beam mounted chair assembly, comprising:

a first beam having a first end and a second end, wherein the first beam is supported on at least one first standard;

a second beam having a first end and a second end, wherein the second beam is supported on at least one second standard, and wherein the second beam extends from the at least one second standard toward the first beam;

at least one chair assembly having a first chair bracket and a second chair bracket, wherein at least a first portion of the first chair bracket is secured to the first beam and at least a first portion of the second chair bracket is secured to either the first beam or the second beam; and at least one of: electrical data wiring or electrical power wiring incorporated within the first beam.

2. A beam mounted chair assembly as in claim 1, further comprising:

a beam coupler, wherein the beam coupler secures the first end of the first beam in alignment with the second end of the second beam.

3. A beam mounted chair assembly as in claim 2, wherein the first chair bracket is secured to the first beam such that a second portion of the first chair bracket is secured to the second beam.

4. A beam mounted chair assembly as in claim 2, wherein a first portion of first beam is secured to a first portion of the at least one first standard and a second portion of the second beam is secured to a second portion of the at least one first standard.

5. A beam mounted chair assembly as in claim 1, further comprising:

at least one electrical outlet incorporated within at least one of: the beam coupler, the first beam, the second beam, the at least one first standard, the at least one second standard, the first chair bracket, or the second chair bracket, wherein the at least one electrical outlet is selected from the group: a wired communications network access point, a wireless communications network access point, a communications network booster, an electrical connection, an electrical junction point, a communications network connection, or a communications network junction.

6. A beam mounted chair assembly as in claim 1, wherein at least one of the at least one first standard or the at least one second standard extends horizontally from an associated structure.

7. A beam mounted chair assembly as in claim 1, wherein at least one of the first beam or the second beam defines a curve in a horizontal plane.

8. A beam mounted chair assembly, comprising:

a first beam having a first end and a second end, wherein the first beam includes a first surface that is supported on at least one first standard;

a second beam having a first end and a second end, wherein the second beam is supported on at least one second standard, wherein the first beam extends from the at least one first standard toward the at least one second standard, and wherein the second beam extends from the at least one second standard toward the at least one first standard;

at least one chair assembly having a first chair bracket and a second chair bracket, wherein at least a first portion of the first chair bracket is secured to the first beam and at least a first portion of the second chair bracket is secured to the first beam or the second beam; and at least one of: electrical data wiring or electrical power wiring incorporated within the first beam.

9. A beam mounted chair assembly as in claim 8, further comprising:

a beam coupler, wherein the beam coupler secures the first end of the first beam in alignment with the second end of the second beam, and wherein a first portion of the beam coupler is inserted inside the first end of the first beam and a second portion of the beam coupler is inserted inside the second end of the second beam.

10. A beam mounted chair assembly as in claim 9, wherein the second chair bracket is secured to the second beam such that a second portion of the second chair bracket is secured to the first beam.

11. A beam mounted chair assembly as in claim 9, wherein a first portion of first beam is secured to a first portion of the at least one first standard and a second portion of the second beam is secured to a second portion of the at least one first standard.

12. A beam mounted chair assembly as in claim 8, further comprising:

at least one electrical outlet incorporated within at least one of: the first beam, the second beam, the at least one first standard, the at least one second standard, the first chair bracket, or the second chair bracket.

13. A beam mounted chair assembly as in claim 8, wherein at least one of the at least one first standard or the at least one second standard extends vertically from an associated structure.

14. A beam mounted chair assembly as in claim 8, wherein at least one of the first beam or the second beam defines a curve in a horizontal plane.

15. A beam mounted chair assembly, comprising:

a first beam having a first end and a second end, wherein the first beam is supported on at least one first standard;

a second beam having a first end and a second end, wherein the second beam is supported on at least one second standard, wherein the first beam extends from the at least one first standard toward the at least one second standard, and wherein the second beam extends from the at least one second standard toward the at least one first standard;

at least one chair assembly having a first chair bracket and a second chair bracket secured to at least one of: the first beam or the second beam; and at least one of: electrical data wiring or electrical power wiring incorporated within the first beam.

16. A beam mounted chair assembly as in claim 15, further comprising:

a beam coupler, wherein a first portion of the beam coupler is inserted outside the first end of the first beam.

17. A beam mounted chair assembly as in claim 15, wherein a portion of the first chair bracket is secured to the first beam and a second portion of the first chair bracket is secured to the second beam.

18. A beam mounted chair assembly as in claim 15, wherein a first portion of first beam is secured to a first portion of the at least one first standard and a second portion of the second beam is secured to a second portion of the at least one first standard.

19. A beam mounted chair assembly as in claim 15, further comprising:

at least one electrical outlet incorporated within at least one of: the first beam, the second beam, the at least one first standard, the at least one second standard, the first chair bracket, or the second chair bracket.

20. A beam mounted chair assembly as in claim 15, wherein the at least one first standard extends vertically from an associated structure and the at least one second standard extends horizontally from the associated structure.

* * * * *